US010344728B2

(12) United States Patent
Noguchi

(10) Patent No.: US 10,344,728 B2
(45) Date of Patent: Jul. 9, 2019

(54) NOZZLE PLATE FOR FUEL INJECTION DEVICE

(71) Applicant: Enplas Corporation, Saitama (JP)

(72) Inventor: Koji Noguchi, Saitama (JP)

(73) Assignee: ENPLAS CORPORATION, Saitama (JP)

( * ) Notice: Subject to any disclaimer, the term of this patent is extended or adjusted under 35 U.S.C. 154(b) by 228 days.

(21) Appl. No.: 14/907,966

(22) PCT Filed: Jun. 4, 2014

(86) PCT No.: PCT/JP2014/064810
§ 371 (c)(1),
(2) Date: Jan. 27, 2016

(87) PCT Pub. No.: WO2015/011995
PCT Pub. Date: Jan. 29, 2015

(65) Prior Publication Data

US 2016/0169179 A1 Jun. 16, 2016

(30) Foreign Application Priority Data

Jul. 23, 2013 (JP) ..... 2013-152758
Oct. 17, 2013 (JP) ..... 2013-216201
(Continued)

(51) Int. Cl.
*F02M 61/18* (2006.01)
*F02M 61/16* (2006.01)

(52) U.S. Cl.
CPC ..... *F02M 61/1853* (2013.01); *F02M 61/162* (2013.01); *F02M 61/166* (2013.01);
(Continued)

(58) Field of Classification Search
CPC ..... F02M 61/1853; F02M 61/1813; F02M 61/162; F02M 61/168; F02M 61/166;
(Continued)

(56) References Cited

U.S. PATENT DOCUMENTS 5,244,154 A * 9/1993 Buchholz ..... B05B 1/042 239/533.12
5,570,841 A * 11/1996 Pace ..... F02M 51/061 239/496
(Continued)

FOREIGN PATENT DOCUMENTS

JP 4-303172 10/1992
JP 9-242641 9/1997
(Continued)

OTHER PUBLICATIONS

International Search Report dated Aug. 12, 2014 in corresponding International Application No. PCT/JP2014/064810 (with English translation).

*Primary Examiner* — Jason J Boeckmann
*Assistant Examiner* — Qingzhang Zhou
(74) *Attorney, Agent, or Firm* — Wenderoth, Lind & Ponack, L.L.P.

(57) ABSTRACT

In a nozzle plate of the present invention, a part of fuel flowing out from a fuel injection port of a fuel injection device is atomized by colliding with an interference body, is rapidly bent in a flowing direction, and collides with the fuel that is flowing straight through a nozzle hole and an orifice to make the fuel that flows straight through the nozzle hole and the orifice turbulent. The orifice includes a corner portion which is defined by an outer edge portion of the interference body and has a pointed shape without roundness at a part of an opening edge. The corner portion makes an end portion of a liquid film of the fuel passing through the
(Continued)

orifice into a pointed shape for ease of atomization by friction with air.

12 Claims, 38 Drawing Sheets

(30) Foreign Application Priority Data

Dec. 12, 2013 (JP) ..... 2013-256869
Feb. 12, 2014 (JP) ..... 2014-024523

(52) U.S. Cl.
CPC ..... *F02M 61/168* (2013.01); *F02M 61/1813* (2013.01); *F02M 2200/8046* (2013.01); *F02M 2200/9015* (2013.01); *F02M 2200/9092* (2013.01)

(58) Field of Classification Search
CPC ... F02M 2200/9015; F02M 2200/8046; F02M 2200/9092
USPC ..... 239/596, 601, 590–590.5, 583–585
See application file for complete search history.

(56) References Cited

U.S. PATENT DOCUMENTS

| | | | | |
|---|---|---|---|---|
| 2002/0092930 | A1 | 7/2002 | Itatsu | |
| 2003/0127547 | A1* | 7/2003 | Nowak | F02M 61/1853 239/596 |

FOREIGN PATENT DOCUMENTS

| | | |
|---|---|---|
| JP | 10-122097 | 5/1998 |
| JP | 2002-210392 | 7/2002 |
| JP | 2004-190563 | 7/2004 |
| JP | 2008-31914 | 2/2008 |

* cited by examiner

NOZZLE PLATE FOR FUEL INJECTION DEVICE

TECHNICAL FIELD

The present invention relates to a nozzle plate for a fuel injection device mounted at a fuel injection port of the fuel injection device and configured to atomize and inject fuel flowed out from the fuel injection port.

BACKGROUND ART

Internal combustion engines (hereinafter, referred to as an "engine") of automotive vehicles and the like are configured to mix fuel injected from a fuel injection device with air introduced via an inlet pipe to generate a combustible gas mixture, and burn the combustible gas mixture within a cylinder. The engines of this type are known to have a configuration in which a state of mixture between the fuel injected from the fuel injection device and the air has significant influence on engine performances, and specifically, atomization of the fuel injected from the fuel injection device is an important factor which affects the engine performances.

FIG. 39 illustrates a nozzle plate 1002 mounted at a fuel injection port 1001 of a fuel injection device 1000. The nozzle plate 1002 is provided with nozzle holes 1003 having a square shape in plan view and formed so as to increase in size from one end side to the other end side in a plate thickness direction, and is mounted at the fuel injection port 1001 of the fuel injection device 1000 so that the one end side thereof in the plate thickness direction faces a side where the fuel injection port 1001 of the fuel injection device 1000 resides. The nozzle plate 1002 is provided with interference bodies 1005 formed at nozzle hole opening edges 1004 on the other end side in the plate thickness direction, and the interference bodies 1005 are configured to partly occlude the nozzle holes 1003.

The fuel injection device 1000 provided with the nozzle plate 1002 described above is configured in such a manner that when fuel flows out from the fuel injection port 1001, misty fuel F2 that has collided with the interference bodies 1005 and flowing along surfaces 1008 of the interference bodies 1005 collides with fuel F1 flowing along inner wall surfaces 1006 of the nozzle holes 1003, so that the fuels F1 and F2 are atomized and are injected from the nozzle holes 1003 into the inlet pipe (see JP-A-10-122097).

Technical Problem

However, the nozzle plate 1002 illustrated in FIG. 39 is provided with inlet-side nozzle hole portions 1003*a* located on the side where the fuel injection port 1001 of the fuel injection device 1000 resides and outlet-side nozzle hole portions 1003*b* located on a downstream side with respect to the inlet-side nozzle hole portions 1003*a* in a direction of fuel injection, which are machined by etching, and corner portions 1007 of the outlet-side nozzle hole portions 1003*b* are rounded. Consequently, fuel injected from the nozzle holes 1003 of the nozzle plate 1002 is less likely to form sharp liquid films, and hence atomization caused by friction with air is not sufficient.

SUMMARY OF INVENTION

Accordingly, it is an object of the present invention to provide a nozzle plate for a fuel injection device configured to sufficiently atomize and inject fuel flowed out from a fuel injection port of the fuel injection device.

Solution to Problem

As illustrated in FIG. 1 to FIG. 37, the present invention relates to a nozzle plate 3 for a fuel injection device mounted at a fuel injection port 4 of a fuel injection device 1 and provided with nozzle holes 7 which allow passage of fuel injected from the fuel injection port 4. In the nozzle plate 3 for a fuel injection device, the nozzle holes 7 are holes formed in a nozzle plate body 9, and orifices 8 which narrow down fuel flows on the outlet-side opening portions 15 side are formed by outlet-side opening portions 15, which are openings formed on the fuel outlet side and partly occluded by interference bodies 16, 16', 41, 54. The nozzle plate body 9 and the interference bodies 16, 16', 41, 54 are integrally molded by cooling and solidifying a melted material filled in a cavity 27. The interference bodies 16, 16', 41, 54 are configured to atomize part of the fuel passing through the nozzle holes 7 by making part of the fuel passing through the nozzle holes 7 collide therewith and rapidly bending part of the fuel flows passing through the nozzle holes 7 to cause the same to collide with fuel flowing straight through the nozzle holes 7 and the orifices 8 thereby making the fuel flow turbulent for ease of atomization of the fuel that has passed through the orifices 8 in the air. The orifices each include a corner portion 22' defined by outer edge portions 21, 33, 44, 58 of the interference bodies 16, 16', 41, 54 and having a sharply pointed shape without roundness at part of an opening edge. The corner portions 22' of the orifices 8 make end portions of liquid films of fuel passing through the orifices 8 into a sharply pointed shape for ease of atomization by friction with air.

Advantageous Effects of Invention

According to the present invention, part of fuel injected from the fuel injection port of the fuel injection device is atomized by colliding with interference bodies, is rapidly bent in a flowing direction, and collides with fuel that is flowing straight through the nozzle holes and the orifices to make the fuel flow that flows straight through the nozzle holes and orifices turbulent. In addition, according to the present invention, since the orifices each include the corner portion having a sharply pointed shape without roundness and thus make the liquid film of fuel injected from the corner portion of each of the orifices have a sharply pointed state, the fuel injected from the corner portion of each of the orifices is easily atomized by friction with air in the vicinity of the orifices. Therefore, the nozzle plate according to the present invention is capable of improving an extent of atomization of fuel further than the nozzle plate of the related art.

BRIEF DESCRIPTION OF DRAWINGS

FIG. 2(*a*) is a vertical cross-sectional view of the distal end side of the fuel injection device (a cross-sectional view taken along line B1-B1 in FIG. 2). FIG. 2(*b*) is a bottom view of the distal end side of the fuel injection device (the drawing illustrating a distal end surface of the fuel injection device viewed in an A1 direction in FIG. 2(*a*)).

FIG. 3(*b*) is a cross-sectional view taken along line B2-B2 in FIG. 3(*a*).

FIG. 4(*a*) is a vertical cross-sectional view of the injection molding die, and FIG. 4(*b*) is a plan view of an in-cavity surface of a first die.

FIG. 5(*a*) is a plan view of part of the nozzle plate for a fuel injection device. FIG. 5(*b*) is a cross-sectional view taken along line B3-B3 in FIG. 5(*a*).

FIG. 6(*a*) is a plan view of part of the nozzle plate for a fuel injection device. FIG. 6(*b*) is a cross-sectional view taken along line B4-B4 in FIG. 6(*a*).

FIG. 7(*a*) is a plan view of part of the nozzle plate for a fuel injection device. FIG. 7(*b*) is a cross-sectional view taken along line B5-B5 in FIG. 7(*a*).

FIG. 8(*a*) is a plan view of part of the nozzle plate for a fuel injection device. FIG. 8(*b*) is a cross-sectional view taken along line B6-B6 in FIG. 8(*a*).

FIG. 9(*a*) is a plan view of part of the nozzle plate for a fuel injection device. FIG. 9(*b*) is a cross-sectional view taken along line B7-B7 in FIG. 9(*a*).

FIG. 10(*a*) is a plan view of part of the nozzle plate for a fuel injection device. FIG. 10(*b*) is a side view of part of the nozzle plate for a fuel injection device.

FIG. 11(*a*) is a plan view of part of the nozzle plate for a fuel injection device. FIG. 11(*b*) is a cross-sectional view taken along line B8-B8 in FIG. 11(*a*).

FIG. 12(*a*) is a plan view of part of the nozzle plate for a fuel injection device. FIG. 12(*b*) is a cross-sectional view taken along line B9-B9 in FIG. 12(*a*).

FIG. 13(*a*) is a plan view of part of the nozzle plate for a fuel injection device. FIG. 13(*b*) is a cross-sectional view taken along line B10-B10 in FIG. 13(*a*).

FIG. 14(*a*) is a plan view of part of the nozzle plate for a fuel injection device. FIG. 14(*b*) is a cross-sectional view taken along line B11-B11 in FIG. 14(*a*).

FIG. 15(*a*) is a plan view of part of the nozzle plate for a fuel injection device. FIG. 15(*b*) is a cross-sectional view taken along line B12-B12 in FIG. 15(*a*). FIG. 15(*c*) is an enlarged view of a portion C in FIG. 15(*a*).

FIG. 16(*a*) is a front view of the nozzle plate. FIG. 16(*b*) is a cross-sectional view of the nozzle plate taken along line B13-B13 in FIG. 16(*a*). FIG. 16(*c*) is a back view of the nozzle plate.

FIG. 18(*a*) is a front view of the nozzle plate. FIG. 18(*b*) is a cross-sectional view of the nozzle plate taken along line B15-B15 in FIG. 18(*a*). FIG. 18(*c*) is a back view of the nozzle plate.

FIG. 19(*b*) is a cross-sectional view taken along line B16-B16 in FIG. 19(*a*). FIG. 19(*c*) is an enlarged view of a center portion of FIG. 18(*a*).

FIG. 20(*a*) is a front view of the nozzle plate 3. FIG. 20(*b*) is an enlarged drawing of the peripheral portion of the nozzle hole illustrated in FIG. 20(*a*). FIG. 20(*c*) is a cross-sectional view taken along line B17-B17 in FIG. 20(*b*).

FIG. 31(*a*) is a front view of the nozzle plate of the present embodiment, FIG. 31(*b*) is a cross-sectional view of the nozzle plate taken along line B25-B25 in FIG. 31(*a*), FIG. 31(*c*) is a cross-sectional view of the nozzle plate taken along line B26-B26 in FIG. 31(*a*), and FIG. 31(*d*) is a back view of the nozzle plate of the present embodiment.

FIG. 32(*a*) is an enlarged view of part (center portion) of the nozzle plate illustrated in FIG. 31(*a*), FIG. 32(*b*) is a partially enlarged view of the nozzle plate of a nozzle hole and the vicinity thereof, and FIG. 32(*c*) is an enlarged cross-sectional view taken along line B27-B27 in FIG. 32(*b*).

FIG. 37(*a*) is a drawing corresponding to FIG. 33(*a*), and FIG. 37(*b*) is a drawing corresponding to FIG. 33(*b*).

FIG. 38(*a*) is a plan view of a center portion of the nozzle plate and FIG. 38(*b*) is a cross-sectional view taken along line B29-B29 in FIG. 38(*a*).

FIG. 39(*a*) is a cross-sectional view of a distal end side of the fuel injection device on which the nozzle plate of the related art is mounted. FIG. 39(*b*) is a plan view of the nozzle plate of the related art. FIG. 39(*c*) is an enlarged view of a portion D in FIG. 39(*b*) (plan view of part of the nozzle plate). FIG. 39(*d*) is a cross-sectional view taken along line B30-B30 in FIG. 39(*c*).

DESCRIPTION OF EMBODIMENTS

Embodiments of the present invention will be described below with reference to the drawings.

First Embodiment

Figure 1:
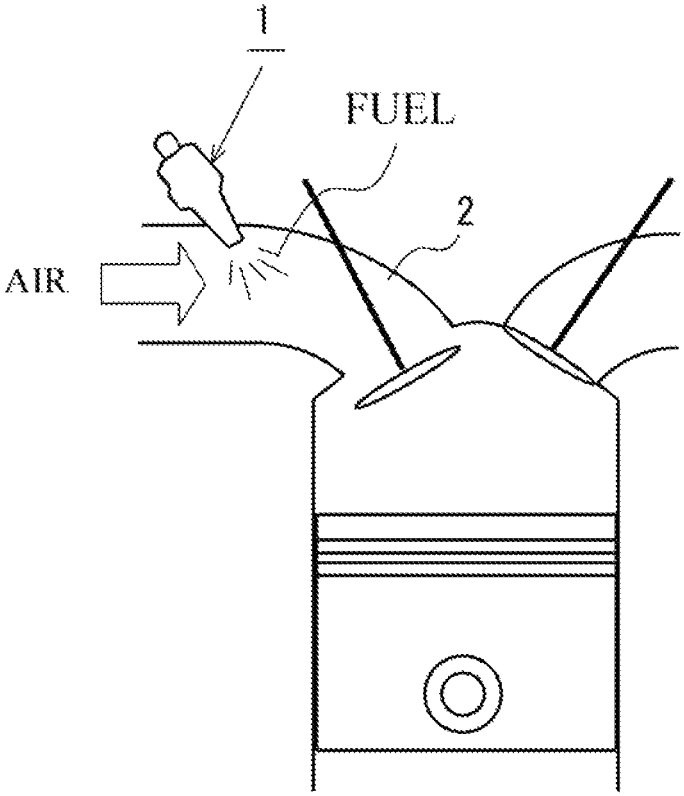
FIG. 1 is a drawing schematically illustrating a state of usage of a fuel injection device provided with a nozzle plate for a fuel injection device according to a first embodiment of the present invention mounted thereon.

FIG. 1 is a drawing schematically illustrating a state of usage of a fuel injection device 1 provided with a nozzle plate for a fuel injection device according to a first embodiment of the present invention mounted thereon. As illustrated in FIG. 1, the fuel injection device 1 of a port-injection system is installed at a midpoint of an inlet pipe 2 of an engine, and is configured to inject fuel into the inlet pipe 2 to mix air and the fuel introduced into the inlet pipe 2 and generate combustible gas mixture.

Figure 2A:
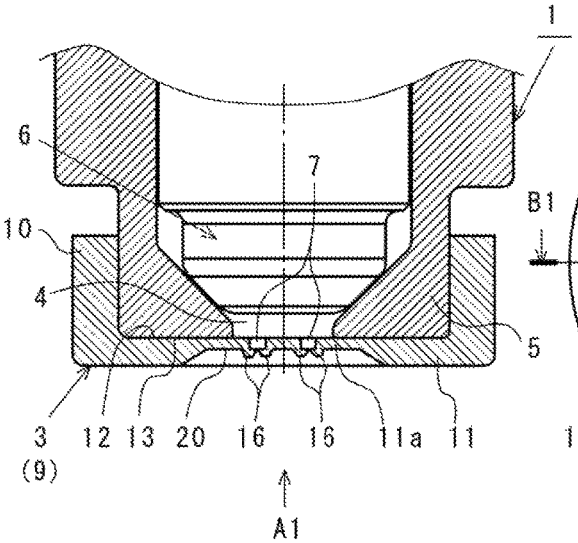
FIG. 2 is a drawing illustrating a distal end side of the fuel injection device provided with a nozzle plate for a fuel injection device according to the first embodiment of the present invention mounted thereon.
Figure 2B:
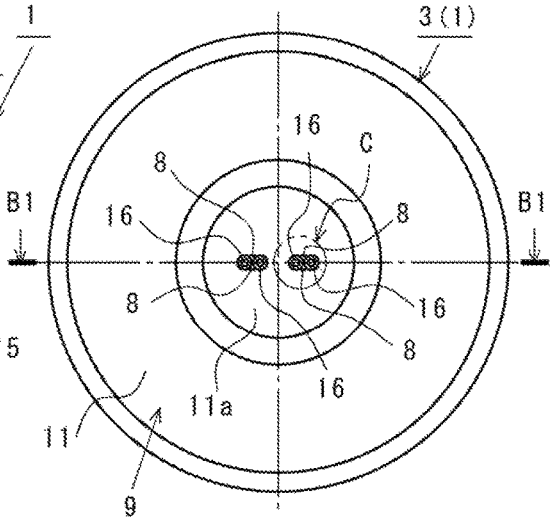
Figure 3A:
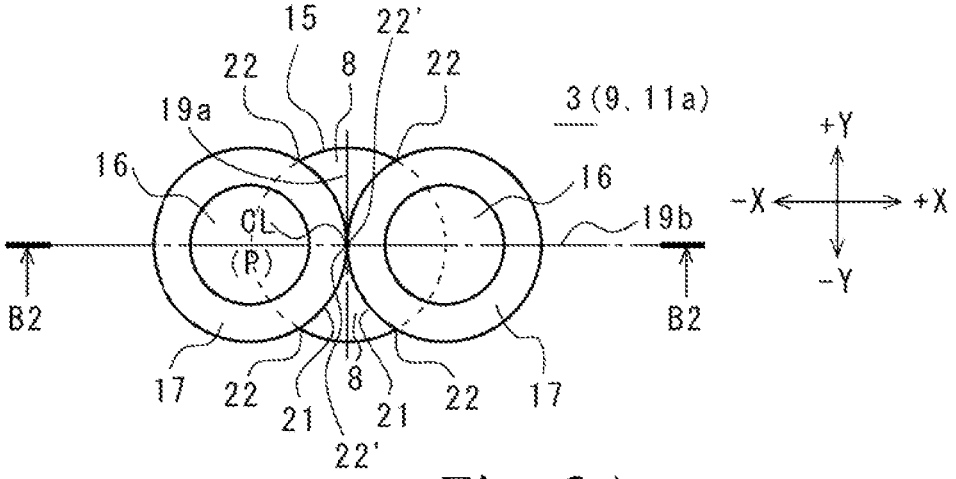
FIG. 3(*a*) is an enlarged view of a portion C in FIG. 2(*b*) (a plan view of part of the nozzle plate for a fuel injection device).
Figure 3B:
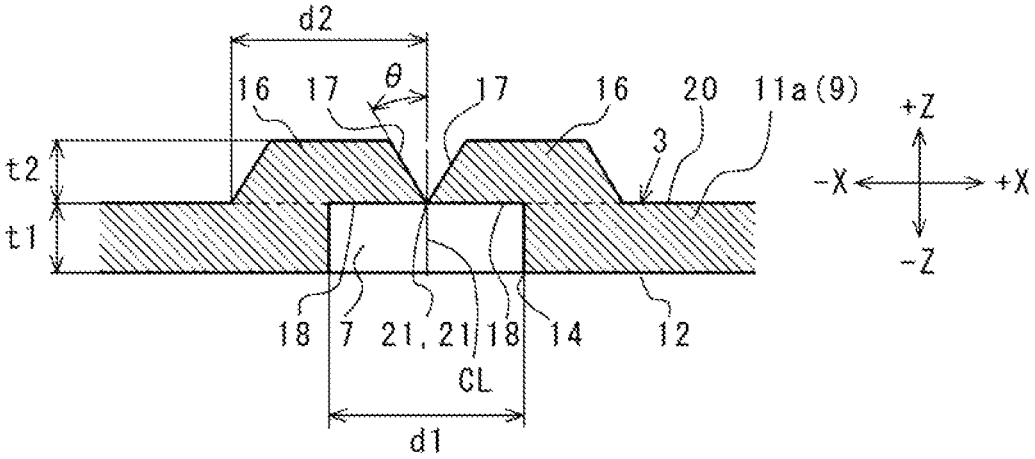

FIG. 2 is a drawing illustrating a distal end side of the fuel injection device 1 provided with a nozzle plate 3 for a fuel injection device (hereinafter, referred to as a nozzle plate) mounted thereon. FIG. 2(*a*) is a vertical cross-sectional view of the distal end side of the fuel injection device 1 (a cross-sectional view taken along line B1-B1 in FIG. 2(*b*)). FIG. 2(*b*) is a bottom view of the distal end side of the fuel injection device 1 (the drawing illustrating a distal end surface of the fuel injection device 1 viewed in an A1 direction in FIG. 2(*a*)). FIG. 3(*a*) is an enlarged view of a portion C in FIG. 2(*b*) (a plan view of part of the nozzle plate 3). FIG. 3(*b*) is a cross-sectional view of the nozzle plate 3 taken along line B2-B2 in FIG. 3(*a*).

As illustrated in FIG. 2, the fuel injection device 1 is provided with the nozzle plate 3 mounted on a distal end side of a valve body 5 having a fuel injection port 4 formed therein. The fuel injection device 1 is configured to open and close a needle valve 6 by a solenoid, which is not illustrated, and when the needle valve 6 is opened, fuel in the valve body 5 is injected from the fuel injection port 4, and inject the fuel injected from the fuel injection port 4 to outside through nozzle holes 7 and orifices 8 of the nozzle plate 3.

As illustrated in FIG. 2 and FIG. 3, the nozzle plate 3 includes a nozzle plate body 9 and interference bodies 16, 16. The nozzle plate body 9 is a bottom cylindrical member formed of a synthetic resin material (for example, PPS, PEEK, POM, PA, PES, PEI, LCP) including a cylindrical wall portion 10 and a bottom wall portion 11 formed integrally on one end side of the cylindrical wall portion 10. The nozzle plate body 9 is fixed to the valve body 5 in a state in which the cylindrical wall portion 10 is fitted to an outer periphery of the valve body 5 on the distal end side without a clearance, and an inner surface 12 of the bottom wall portion 11 is in abutment with a distal end surface 13 of the valve body 5. The nozzle plate body 9 is provided with a plurality (pair) of nozzle holes 7 that communicate the fuel injection port 4 of the valve body 5 with outside in the bottom wall portion 11 thereof. The nozzle holes 7 of the nozzle plate body 9 are straight round holes orthogonal to the inner surface 12 of the bottom wall portion 11, and are configured to introduce fuel injected from the fuel injection port 4 of the valve body 5 from inlet-side opening portions 14 facing the fuel injection port 4 and inject the fuel introduced from the inlet-side opening portions 14 from an outlet-side opening portion 15 side (opening portion side where the fuel flows out) which faces outside. The outlet-side opening portions 15 of the nozzle holes 7 of the nozzle plate body 9 have a circular shape. The nozzle holes 7 are formed in a thin portion 11*a* like a counterbore in the bottom wall portion 11.

As illustrated in FIG. 2 and FIG. 3, the outlet-side opening portions 15 of the nozzle holes 7 of the nozzle plate body 9 are each partly occluded by the pair of interference bodies 16, 16. The pair of interference bodies 16, 16 have the same shape, are arranged in line symmetry with respect to a straight line 19*a* along a Y-axis direction passing through a center CL of the nozzle hole 7, and are formed integrally with the nozzle plate body 9 so as to butt with each other at the center CL of the nozzle hole 7. The interference bodies 16 each have a truncated conical shape, which has an outer diameter dimension gradually reduced as it goes in a +Z-axis direction of FIG. 3(*b*) from the outlet-side opening portion 15 of the nozzle hole 7 and has a tapered side surface 17. The side surfaces (inclined surfaces) 17 of the interference bodies 16 intersect with each other at an acute angle with fuel colliding surfaces 18 with which parts of fuel passing through the nozzle hole 7 collide. The fuel colliding surfaces 18 of the interference bodies 16 are formed so as to be flush with an outer surface 20 (a surface located on a side opposite to the inner surface 12) of the bottom wall portion 11. The pair of interference bodies 16 form the orifices 8 on the outlet-side opening portion 15 of the nozzle hole 7 by partly occluding the outlet-side opening portion 15 of the nozzle hole 7. The pair of orifices 8 are formed in line symmetry with respect to a straight line 19*b* extending along an X-axis direction passing though the center CL of the nozzle hole 7 so as to rapidly narrow down the fuel flowing in the nozzle hole 7. An opening edge of each of the orifices 8 is defined by the circular outlet-side opening portion 15 of the nozzle hole 7 and parts (arcuate-shaped outer edge portions) of circular outer edge portions 21 of the pair of interference bodies 16. The opening edges of the orifices 8 each include corner portions 22, 22 formed at intersecting portions between the outlet-side opening portion 15 of the nozzle hole 7 and the circular outer edge portions 21, 21 of the interference bodies 16, 16 and a corner portion 22' formed at a butting portion P between the circular outer edge portions 21, 21 of the pair of interference bodies 16, 16. These corner portions 22, 22, 22' have a sharply pointed shape without roundness.

In FIG. 3, the nozzle plate 3 here is configured to have a dimension of a hole diameter (diameter of the outlet-side opening portion 15) d1 of the nozzle holes 7, and a diameter d2 of the circular outer edge portions 21 of the interference bodies 16 and the ratio (d1:d2) thereof, an angle of inclination θ of the side surfaces 17 of the interference bodies 16 (an angle θ formed between each of the side surfaces 17 of the interference bodies 16 and a direction along the +Z axis), a plate thickness t1 of the thin portion 11*a* of the bottom wall portion 11 (the length of the nozzle holes 7), and a plate thickness t2 of the interference bodies 16 determined to have optimal numerical values depending on required fuel injection properties and the like. For example, an optimal value of d1 is determined within a range from 0.03 to 1.0 mm.

Figure 4A:
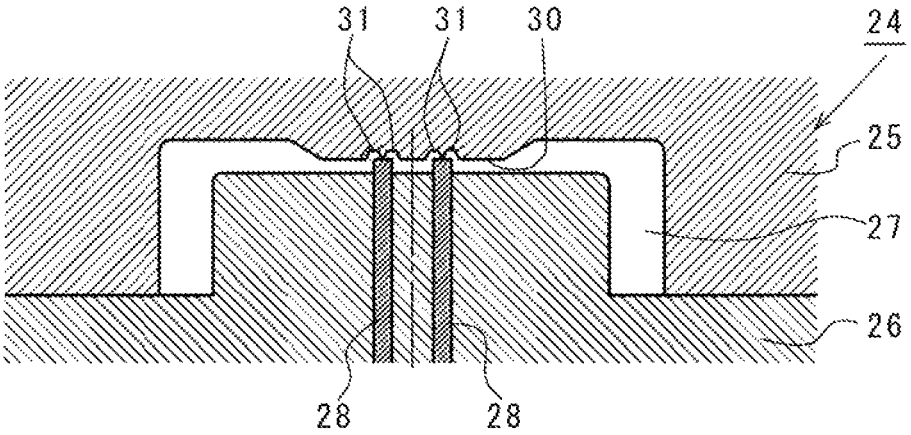
FIG. 4 illustrates structure drawings of an injection molding die used for injection-molding the nozzle plate for a fuel injection device.
Figure 4B:
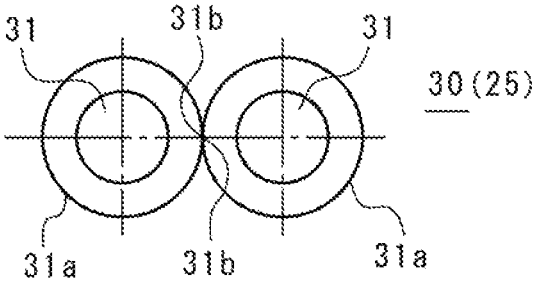

FIG. 4 illustrates structure drawings of an injection molding die 24 used for injection-molding of the nozzle plate 3. FIG. 4(*a*) is a vertical cross-sectional view of the injection molding die 24, and FIG. 4(*b*) is a plan view of an in-cavity surface 30 of a first die 25.

As illustrated in FIG. 4(*a*), the injection molding die 24 includes a cavity 27 formed between the first die 25 and a second die 26, and nozzle hole forming pins 28, 28 configured to form the nozzle holes 7, 7 project into the cavity 27. The nozzle hole forming pins 28, 28 are butted at distal ends thereof with the in-cavity surface 30 of the first die 25. Depressed portions 31, 31 configured to form the interference bodies 16, 16 are formed in the vicinity of positions where the nozzle hole forming pins 28 of the first die 25 are butted. In the first die 25, corner portions 31*b*, 31*b* formed at an intersecting portion (butting portion) between circular outer edge portions 31*a*, 31*a* of the depressed portions 31, 31 have a sharply pointed shape without roundness to form the corner portions 22', 22' at the butting portion P between the pair of interference bodies 16, 16.

With the injection molding die 24 in this configuration, when melted resin (melted material) is injected from a gate, which is not illustrated, into the cavity 27 and the melted resin in the cavity 27 is cooled and solidified, the nozzle plate 3 with the interference bodies 16, 16, 16, 16 molded integrally with the nozzle plate body 9 is formed (FIG. 2 and FIG. 3). The nozzle plate 3 injection-molded by using the injection molding die 24 in this configuration is formed so that the fuel colliding surfaces 18 of the interference bodies 16 are flush with the outer surface 20 of the bottom wall portion 11, and includes the corner portions 22, 22, 22' having a sharply pointed shape without roundness formed at the opening edges of the pair of orifices 8, 8. The nozzle plate 3 injection-molded in this manner has a high production efficiency compared with the nozzle plate formed by etching or electrical spark machining, so that a unit price can be reduced.

According to the nozzle plate 3 of the present embodiment configured as described above, part of fuel injected from the fuel injection port 4 of the fuel injection device 1 is atomized by colliding with the fuel colliding surfaces 18 of the interference bodies 16, is rapidly bent in flowing direction by the fuel colliding surfaces 18, and collides with fuel that is flowing straight through the nozzle holes 7 and the orifices 8 to make the fuel flow that flows straight through the nozzle holes 7 and orifices 8 turbulent. Furthermore, the nozzle plate 3 of the present embodiment includes the corner portions 22, 22, 22' having a sharply pointed shape without roundness at the opening edges of the orifices 8, and the opening edges of the orifices 8 are narrowed as they go toward the corner portions 22, 22, 22'. Consequently, according to the nozzle plate 3 of the present embodiment, liquid films of fuel injected from the corner portions 22, 22, 22' of the orifices 8 and the vicinities thereof, which are parts of fuel injected from the orifices 8, become thinner and a sharply pointed state, so that the fuel injected from the corner portions 22, 22, 22' of the orifices 8 and the vicinity thereof is easily atomized by a friction with respect to the air in the vicinity of the orifices 8.

Therefore, the nozzle plate 3 of the present embodiment can further improve the degree of atomization of the fuel injected from the orifices 8 compared with the nozzle plate of the related art.

In addition, according to the nozzle plate 3 of the present embodiment, the side surfaces 17 of the interference bodies 16 are formed so as to intersect the fuel colliding surfaces 18 of the interference bodies 16 at an acute angle and air layers are formed between the fuel that has passed through the orifices 8 and the side surfaces 17 of the interference bodies 16, the fuel that has passed through the orifices 8 is likely to involve air and thus atomization of the fuel passing through the orifices 8 is accelerated and the atomized fuel can be dispersed uniformly in the inlet pipe 2 (see FIG. 1).

According to the nozzle plate 3 of the present embodiment, the pair of orifices 8 are formed, each of the orifices 8 includes the corner portions 22, 22, 22' having a sharply pointed shape without roundness, and the opening edges of the orifices 8 are narrowed as they go toward the corner portions 22, 22, 22'. Therefore, compared with the case where the orifices 8 are formed to have constant width, fuel to be injected from the orifices 8 can be provided with directivity so that a density of fuel injected from the orifice 8 becomes the highest in a specific direction.

According to the nozzle plate 3 of the present embodiment, an angle of injection of fuel can be changed easily by changing any one or a plurality of a dimension of the hole diameter (diameter of the outlet-side opening portion 15) d1 of the nozzle holes 7, and the diameter d2 of the circular outer edge portions 21 of the interference bodies 16 and the ratio (d1:d2) thereof, the angle of inclination θ of the side surfaces 17 of the interference bodies 16 (an angle θ formed between each of the side surfaces 17 of the interference bodies 16 and a direction along the +Z axis), the plate thickness t1 of the thin portion 11*a* of the bottom wall portion 11 (a length of the nozzle holes 7), and the plate thickness t2 of the interference bodies 16 as needed.

Second Embodiment

Figure 5A:
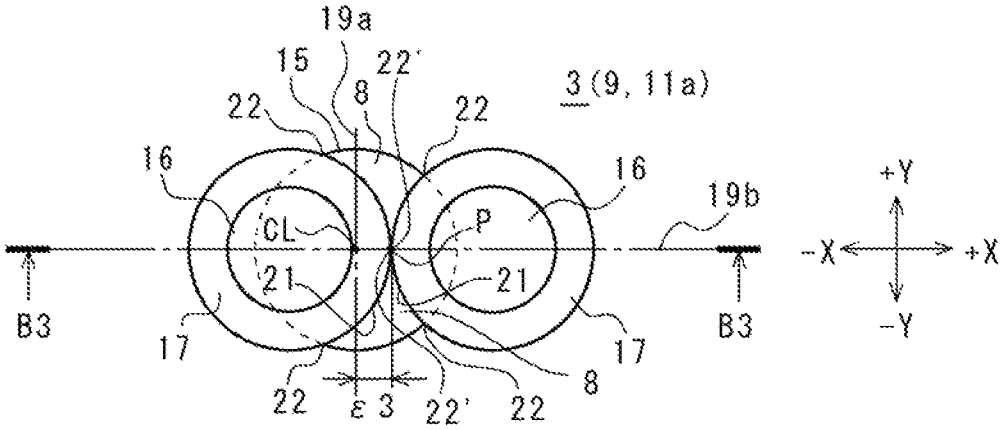
FIG. 5 illustrates a principal portion of a nozzle plate for a fuel injection device according to a second embodiment, which corresponds to FIG. 3.
Figure 5B:
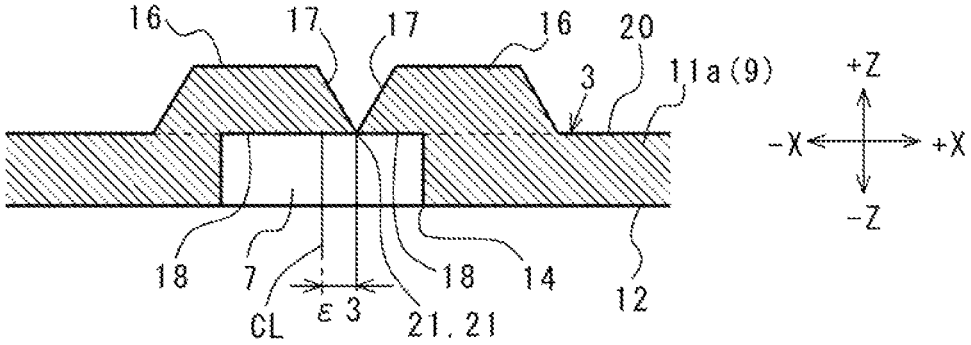

FIG. 5 illustrates a principal portion of a nozzle plate 3 according to a second embodiment of the present invention. Components of the nozzle plate 3 of the present embodiment common to the nozzle plate 3 of the first embodiment are denoted by the same reference numerals, and description overlapped with the description of the nozzle plate 3 in the first embodiment will be omitted.

The nozzle plate 3 of the present embodiment is configured in such a manner that the pair of interference bodies 16, 16 of the first embodiment are shifted by ε3 in a +X direction with respect to the center CL of the nozzle hole 7. The nozzle plate 3 of the present embodiment also includes two corner portions 22' at the butting portion P between the pair of interference bodies 16, 16 in addition to corner portions (four corner portions) 22 of the opening edges of the orifices 8 formed by the circular outlet-side opening portion 15 of the nozzle hole 7 and the circular outer edge portions 21, 21 of the pair of interference bodies 16, 16 in the same manner as the nozzle plate 3 of the first embodiment.

These corner portions 22, 22' have a sharply pointed shape without roundness and are capable of thinning the liquid films passing through the corner portions 22, 22' of the orifices 8 and in the vicinity thereof to easily atomize end portions of liquid films of fuel passing through the orifices 8 by friction with air. Furthermore, in the nozzle plate 3 of the present embodiment, surface areas of portions of the nozzle hole 7 occluded by the pair of interference bodies 16, 16 are different from each other, and thus the surface area of one (one on a side of a −X direction in FIG. 15) interference body 16 that occludes the nozzle hole 7 is larger than the surface area of the other (one on a side of the +X direction in FIG. 15) interference body 16 that occludes the nozzle hole 7, and thus an amount of fuel which collides with the one interference body 16 and then is changed in a flowing direction toward the other interference body 16 is larger than the amount of fuel which collides with the other interference body 16 and then is changed in the flowing direction toward the one interference body 16. In addition, the orifices 8 are located at positions shifted in the +X direction with respect to the center CL of the nozzle hole 7. Consequently, with the nozzle plate 3 of the present embodiment, the direction of fuel injection from the orifices 8 can be shifted in the +X direction with respect to the center CL of the nozzle hole 7.

Although an example in which the pair of interference bodies 16, 16 are shifted in the +X direction with respect to the center CL of the nozzle hole 7 has been described as the nozzle plate 3 of the present embodiment, the interference bodies 16, 16 are not limited thereto, and how the interference bodies 16, 16 are to be shifted with respect to the center CL of the nozzle 7 is determined depending on the direction in which injection of fuel wants to be shifted with respect to the center CL of the orifices 8.

Third Embodiment

Figure 6A:
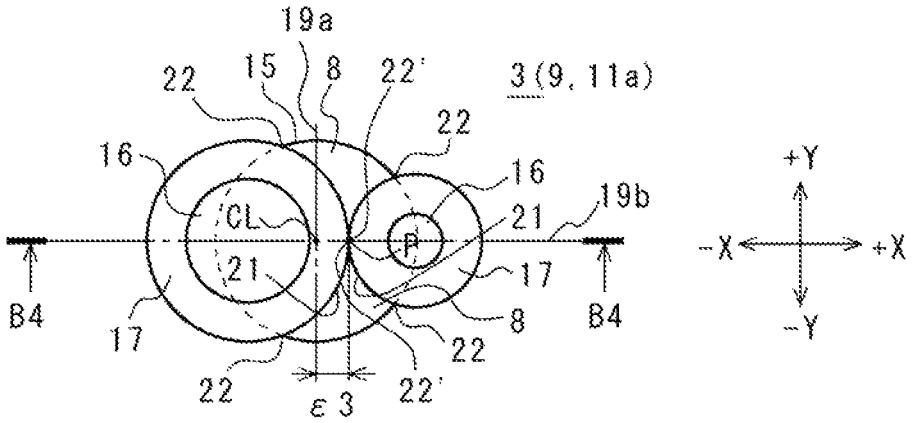
FIG. 6 illustrates a principal portion of a nozzle plate for a fuel injection device according to a third embodiment, which corresponds to FIG. 3.
Figure 6B:
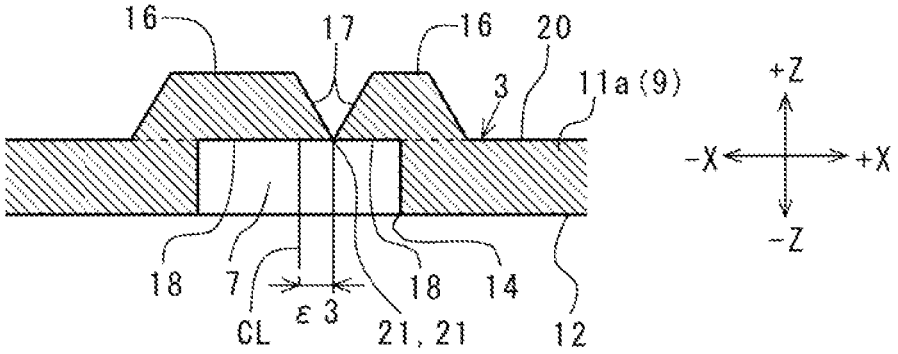

FIG. 6 illustrates a principal portion of the nozzle plate 3 according to a third embodiment of the present invention, and illustrates a modification of the nozzle plate 3 according to the second embodiment. Components of the nozzle plate 3 of the present embodiment common to the nozzle plate 3 of the first and second embodiments are denoted by the same reference numerals, and description overlapped with the description of the nozzle plate 3 in the first and second embodiments will be omitted.

According to the nozzle plate 3 of the present embodiment, one (the right side: the interference body 16 on the +X side) of the pair of interference bodies 16, 16 is formed to be smaller than the other (the left side: the interference body 16 on the −X side). Consequently, with the nozzle plate 3 of the present embodiment, even though an amount of shift (ε3) of the orifices 8 in the +X direction with respect to the center CL of the nozzle hole 7 is the same as that of the nozzle plate 3 of the second embodiment, the difference in surface area between one or the other one of the pair of interference bodies 16, 16 that occlude the nozzle hole 7 is increased, and opening surface areas of the orifices 8 are increased, so that fuel injection properties different from those of the nozzle plate 3 according to the second embodiment can be obtained. In the same manner as the nozzle plate 3 of the second embodiment, the nozzle plate 3 of the present embodiment also includes two corner portions 22' formed at the butting portion between the pair of interference bodies 16, 16 in addition to corner portions (corner portions at four positions) 22 on the opening edges of the orifices 8 formed by the circular outlet-side opening portion 15 of the nozzle hole 7 and the circular outer edge portions 21, 21 of the pair of interference bodies 16, 16. The corner portions 22, 22 have a sharply pointed shape without roundness and make end portions of liquid films of fuel passing through the orifices 8 have a sharply pointed shape for ease of atomization by friction with air.

Fourth Embodiment

Figure 7A:
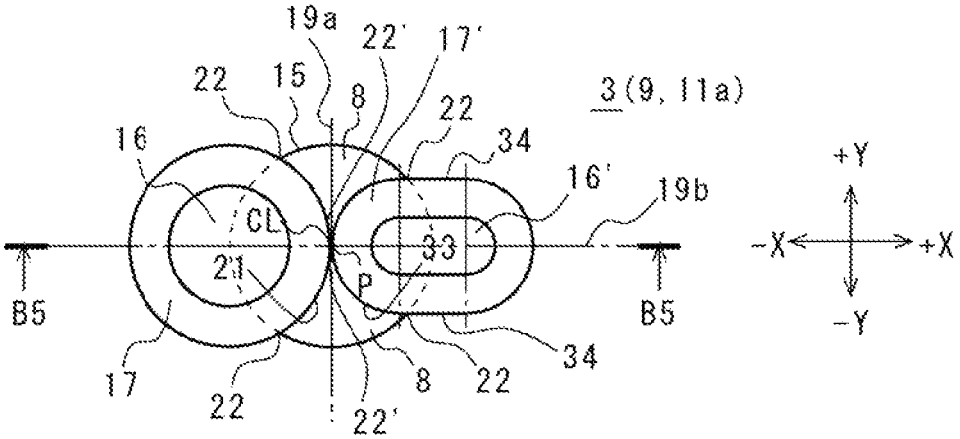
FIG. 7 illustrates a principal portion of a nozzle plate for a fuel injection device according to a fourth embodiment, which corresponds to FIG. 3.
Figure 7B:
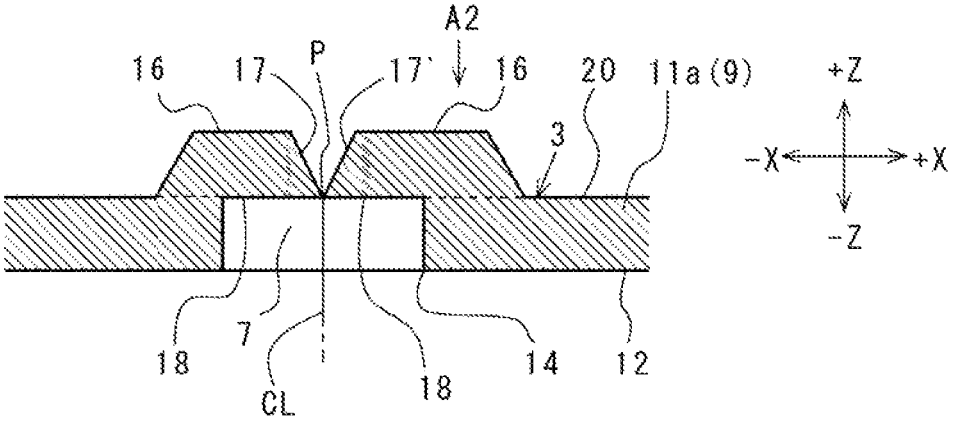

FIG. 7 illustrates a principal portion of the nozzle plate 3 according to a fourth embodiment of the present invention, and illustrates a modification of the nozzle plate 3 according to the first embodiment. Components of the nozzle plate 3 of the present embodiment common to the nozzle plate 3 of the first embodiment are denoted by the same reference numerals, and description overlapped with the description of the nozzle plate 3 in the first embodiment will be omitted.

According to the nozzle plate 3 of the present embodiment, one (right side: the interference body 16 on the +X side) of the pair of interference bodies 16, 16 of the nozzle plate 3 according to the first embodiment is replaced by an interference body 16' so that the other interference body 16 (left side: the interference body 16 on the −X side) and the one interference body 16' are butted with each other. The interference body 16' has a shape having semicircular shapes at both end portions in a longitudinal direction of the rectangular shape in plan view (the shape viewed in a direction A2 in FIG. 7(*b*)). The interference body 16' is formed so that the longitudinal direction thereof extends along a straight line 19*b* (the X-axis direction) passing through the center CL of the pair of nozzle holes 7, 7, and a semicircular-shaped outer edge portion (arcuate-shaped outer edge portion) 33 on one end side and linear outer edge portions 34 define parts of the orifices 8. The orifices 8 are formed by the circular outer edge portion 21 of the interference body 16, a semicircular-shaped outer edge portion 33 and the linear outer edge portions 34 of the interference body 16', and the circular outlet-side opening portion 15 of the nozzle hole 7.

The orifices 8 each include the corner portion 22 formed by the circular outer edge portion 21 of the interference body 16 and the outlet-side opening portion 15 of the nozzle hole 7, the corner portion 22 formed by the linear outer edge portions 34 of the interference body 16' and the outlet-side opening portion 15 of the nozzle hole 7, and the corner portion 22' formed at the butting portion P between the interference body 16 and the interference body 16'. These corner portions 22, 22' of the opening edges of the orifices 8 each have a sharply pointed shape without roundness and make end portions of liquid films of fuel passing through the orifices 8 have a sharply pointed shape for ease of atomization by friction with air. In the nozzle plate 3 of the present embodiment, the interference body 16' is formed so that the side surface 17' intersects the fuel colliding surface 18 at an acute angle in the same manner as the interference body 16 having a truncated conical shape in the first embodiment descried above.

Fifth Embodiment

Figure 8A:
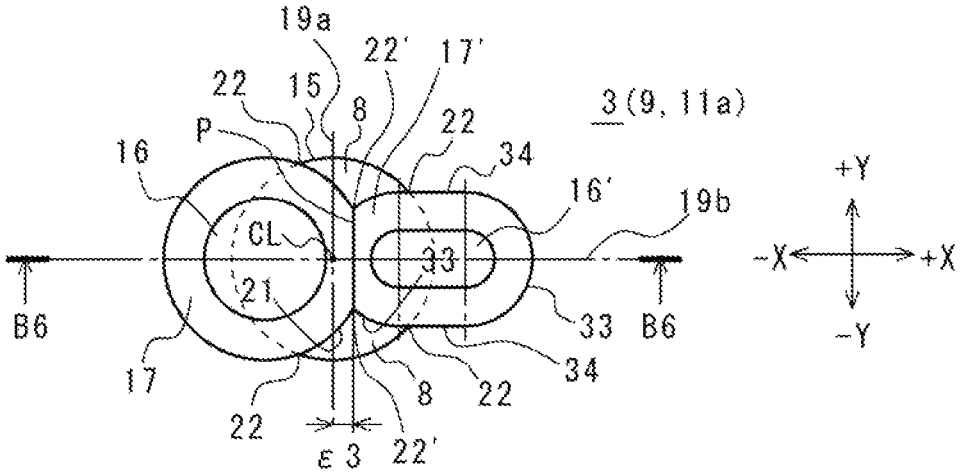
FIG. 8 illustrates a principal portion of a nozzle plate for a fuel injection device according to a fifth embodiment, which corresponds to FIG. 3.
Figure 8B:
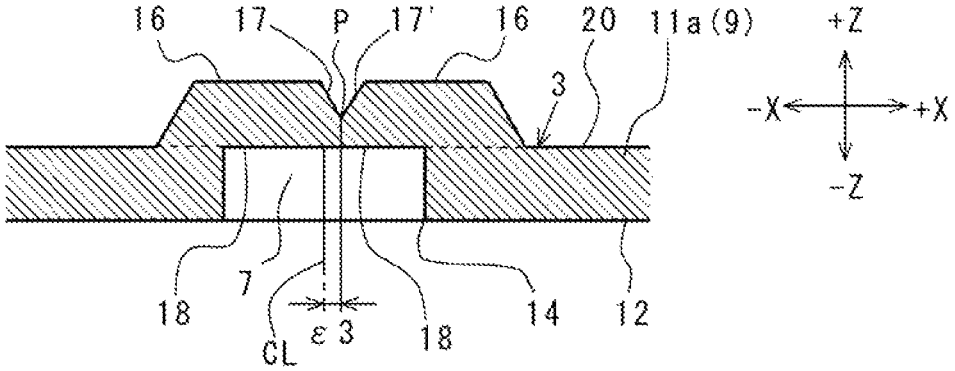

FIG. 8 illustrates a principal portion of a nozzle plate 3 according to a fifth embodiment of the present invention, and illustrates a modification of the nozzle plate 3 according to the fourth embodiment. Components of the nozzle plate 3 of the present embodiment common to the nozzle plate 3 of the first and fourth embodiments are denoted by the same reference numerals, and description overlapped with the description of the nozzle plate 3 in the first and fourth embodiments will be omitted.

The nozzle plate 3 of the present embodiment has a shape having the one interference body 16' and the other interference body 16 of the nozzle plate 3 of the fourth embodiment butted with each other so as to be flattened out (so as to come into contact with each other in the ±Y direction by a predetermined width) and the butting portion P between the one interference body 16', and the other interference body 16 is shifted from the center CL of the nozzle hole 7 by ε3 in the +X direction.

The nozzle plate 3 of the present embodiment having the configuration described above has smaller opening surface areas of the orifices 8 compared with the nozzle plate 3 according to the fourth embodiment, and the differences between the surface areas of the one interference body 16' and the other interference body 16 that occlude the nozzle hole 7 are also different. Consequently, the nozzle plate 3 of the present embodiment may obtain fuel injection properties different from those of the nozzle plate 3 according to the thirteenth modification.

The orifices 8 of the nozzle plate 3 of the present embodiment each include the corner portion 22 formed by the circular outlet-side opening portion 15 of the nozzle hole 7 and part of the circular outer edge portion 21 of the interference body 16 and having a sharply pointed shape without roundness, the corner portion 22 formed by the circular outlet-side opening portion 15 of the nozzle hole 7 and the linear outer edge portions 34 of the interference body 16' having a sharply pointed shape without roundness, and the corner portion 22' formed at the butting portion P between the one interference body 16' and the other interference body 16 and having a sharply pointed shape without roundness. These corner portions 22, 22' can make end portions of liquid films of fuel passing through the orifices 8 have a sharply pointed shape for ease of atomization by friction with air.

Sixth Embodiment

Figure 9A:
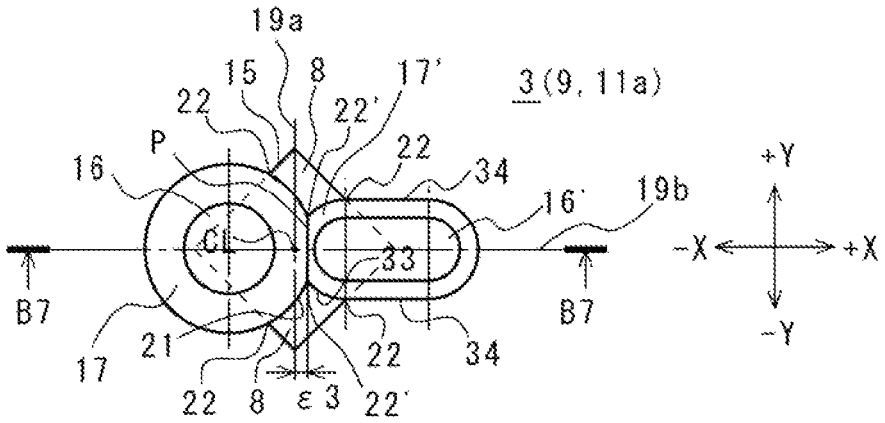
FIG. 9 illustrates a principal portion of a nozzle plate for a fuel injection device according to a sixth embodiment, which corresponds to FIG. 3.
Figure 9B:
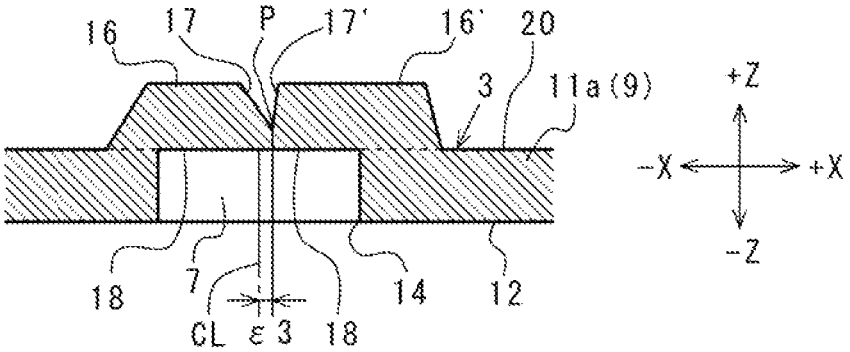

FIG. 9 illustrates a principal portion of a nozzle plate 3 according to a sixth embodiment of the present invention, and illustrates a modification of the nozzle plate 3 according to the fifth embodiment. Components of the nozzle plate 3 of the present embodiment common to the nozzle plate 3 of the first and fifth embodiments are denoted by the same reference numerals, and description overlapped with the description of the nozzle plate 3 in the first and fifth embodiments will be omitted.

The nozzle plate 3 of the present embodiment is different from the nozzle plate 3 according to the fifth embodiment in that the nozzle holes 7 in the nozzle plate body 9 according to the fifth embodiment are formed into a square shape and the shape of the outlet-side opening portions 15 of the nozzle holes 7 is formed into a square shape.

In the nozzle plate 3 of the present embodiment having the configuration as described above, the butting portion P between the one interference body 16' and the other interference body 16 is located at a position shifted in the +X direction by ε3 with respect to the center CL of the nozzle hole 7. In the nozzle plate 3 of the present embodiment, the two corner portions 22 formed by the outlet-side opening portion 15 of the nozzle hole 7 and the linear outer edge portion 34 of the interference body 16', the two corner portions 22 formed by the outlet-side opening portion 15 of the nozzle hole 7 and the circular outer edge portion 21 of the interference body 16, and the two corner portion 22' formed at the butting portion P between the interference body 16' and the interference body 16 have a sharply pointed shape without roundness and can make end portions of liquid films of fuel passing through the orifices 8 have a sharply pointed shape for ease of atomization by friction with air.

Seventh Embodiment

Figure 10A:
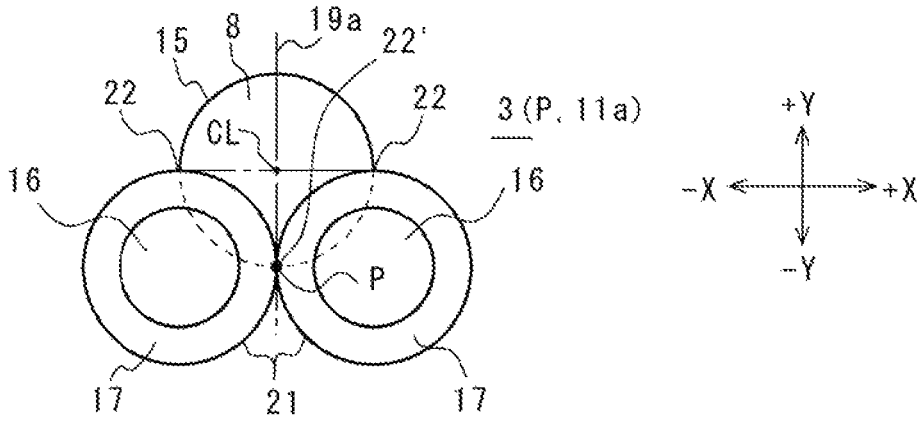
FIG. 10 illustrates a principal portion of a nozzle plate for a fuel injection device according to a seventh embodiment, which corresponds to FIG. 3.
Figure 10B:
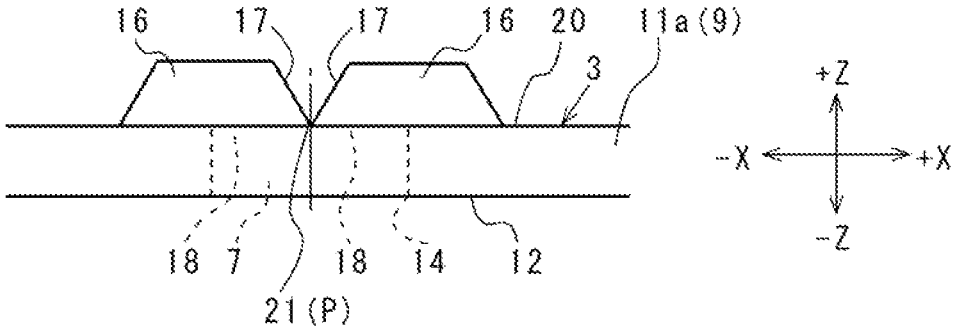

FIG. 10 illustrates a principal portion of a nozzle plate 3 according to a seventh embodiment of the present invention. Components of the nozzle plate 3 of the present embodiment common to the nozzle plate 3 of the first embodiment are denoted by the same reference numerals, and description overlapped with the description of the nozzle plate 3 in the first embodiment will be omitted.

The nozzle plate 3 of the present embodiment includes the butting portion P between the pair of interference bodies 16, 16 located at an intersection between the straight line (centerline along the Y-axis direction) 19*a* passing through the center CL of the nozzle hole 7 and the outlet-side opening portion 15 of the nozzle hole 7, and is different from the nozzle plate 3 of the first embodiment having the butting portion P between the pair of interference bodies 16, 16 located at the center CL of the nozzle hole 7.

The nozzle plate 3 of the present embodiment also includes the corner portion 22' at one position formed at the butting portion P between the pair of interference bodies 16, 16 in addition to two corner portions 22, 22 formed on an opening edge of the orifice 8 formed by the circular outlet-side opening portion 15 of the nozzle hole 7 and the circular outer edge portions 21, 21 of the pair of interference bodies 16, 16. The corner portions 22 on the opening edge of the orifice 8 formed by the circular outlet-side opening portion 15 of the nozzle hole 7 and the circular outer edge portions 21, 21 of the pair of interference bodies 16, 16 and the corner portions 22' formed by the butting portion between the pair of interference bodies 16, 16 each have a sharply pointed shape without roundness, and are capable of thinning end portions of a liquid film passing through the orifice 8 and making the end portions of the liquid film of fuel passing through the orifice 8 have a sharply pointed shape for ease of atomization by friction with air.

The nozzle plate 3 of the present embodiment has the orifice 8 at one position, and the position of the center of the opening edge of the orifice 8 is shifted in the +Y direction with respect to the center CL of the nozzle hole 7. In this point of view, the nozzle plate 3 of the present embodiment is different from the nozzle plate 3 of the first embodiment configured in such a manner that the fuel is injected from the pair of orifices 8 by being split into two directions.

Eighth Embodiment

Figure 11A:
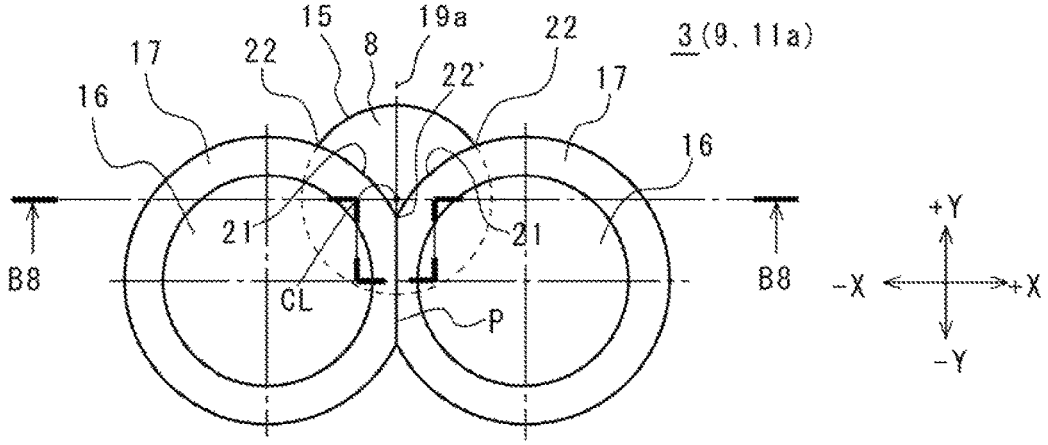
FIG. 11 illustrates a principal portion of a nozzle plate for a fuel injection device according to an eighth embodiment, which corresponds to FIG. 3.
Figure 11B:
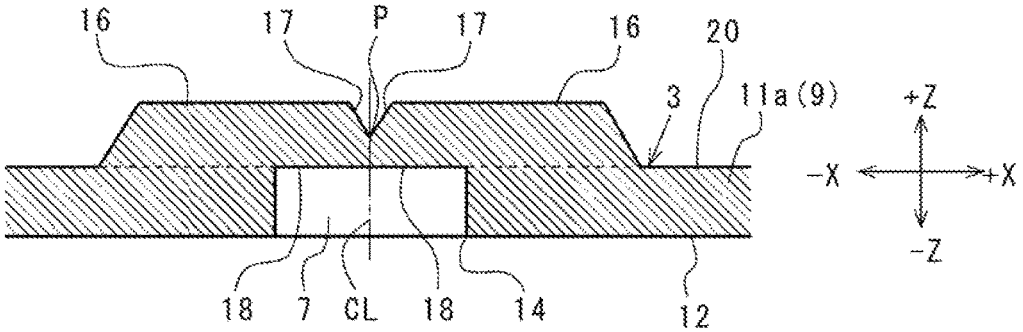

FIG. 11 illustrates a principal portion of a nozzle plate 3 according to an eighth embodiment of the present invention, and illustrates a modification of the nozzle plate 3 according to the seventh embodiment. Components of the nozzle plate 3 of the present embodiment common to the nozzle plate 3 of the first and seventh embodiments are denoted by the same reference numerals, and description overlapped with the description of the nozzle plate 3 in the first and seventh embodiments will be omitted.

The nozzle plate 3 of the present embodiment includes the pair of interference bodies 16, 16 larger than the nozzle hole 7, and the butting portion P between the pair of interference bodies 16, 16 located on the straight line (the centerline extending along the Y-axis direction) 19*a* passing through the center CL of the nozzle hole 7, one end (corner portion 22') of the butting portion P between the pair of interference bodies 16, 16 is located in the vicinity of the center CL of the nozzle hole 7, and the other end of the butting portion P between the pair of interference bodies 16, 16 is located out of the nozzle hole 7. The nozzle plate 3 of the present embodiment includes the nozzle hole 7 partly occluded by the pair of interference bodies 16, 16, so that the outlet-side opening portion 15 of the nozzle hole 7 and the circular outer edge portions 21, 21 of the pair of interference bodies 16, 16 form a substantially fan-shaped orifice 8. The orifice 8 is provided at the opening edge thereof with the corner portions 22, 22 formed by the outlet-side opening portion 15 of the nozzle hole 7 and the circular outer edge portions 21, 21 of the pair of interference bodies 16, 16 and the corner portion 22' formed at the butting portion P between the pair of interference bodies 16, 16. The corner portions 22, 22' of the orifice 8 have a sharply pointed shape without roundness and are capable of thinning end portions of a liquid film passing through the orifice 8 and making the end portions the liquid film of fuel passing through the orifice 8 have a sharply pointed shape for ease of atomization by friction with air.

The nozzle plate 3 of the present embodiment is different from the nozzle plate 3 of the seventh embodiment in that the opening surface area of the orifice 8 is smaller and the orifice 8 is located at a position biased in the +Y direction side with respect to the center CL of the nozzle hole 7. Consequently, the nozzle plate 3 of the present embodiment can exert fuel injection properties different from the nozzle plate 3 of the seventh embodiment.

Ninth Embodiment

Figure 12A:
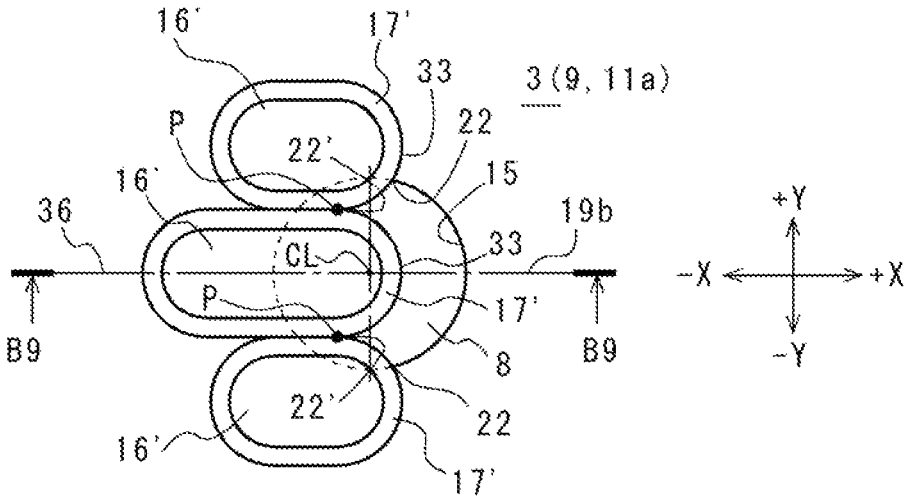
FIG. 12 illustrates a principal portion of a nozzle plate for a fuel injection device according to a ninth embodiment, which corresponds to FIG. 3.
Figure 12B:
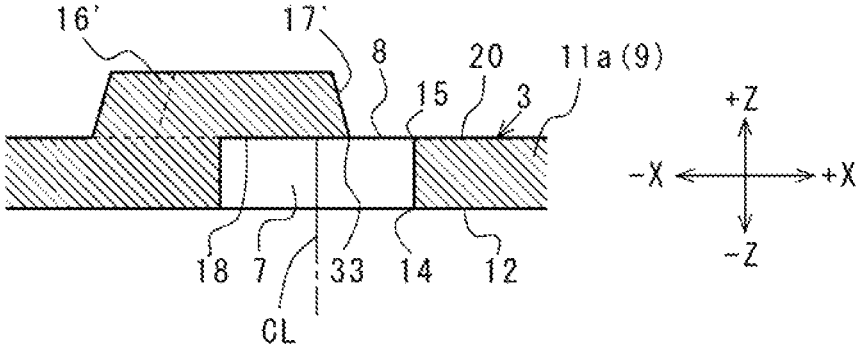

FIG. 12 illustrates a principal portion of a nozzle plate 3 according to a ninth embodiment of the present invention, and illustrates a modification of the nozzle plate 3 according to the fourth embodiment. Components of the nozzle plate 3 of the present embodiment common to the nozzle plate 3 of the first and fourth embodiments are denoted by the same reference numerals, and description overlapped with the description of the nozzle plate 3 in the first and fourth embodiments will be omitted.

The nozzle plate 3 of the present embodiment includes three interference bodies 16', which are the same as the interference body 16' of the nozzle plate 3 according to the fourth embodiment described above, arranged in tight contact with each other along the Y-axis direction, and a centerline 36 in the longitudinal direction of the interference body 16' located at the center is arranged so as to match a straight line (centerline extending along the X-axis) 19*b* passing through the center CL of the nozzle hole 7.

The nozzle plate 3 of the present embodiment includes the orifice 8 formed by the semicircular-shaped outer edge portions 33 of the three interference bodies 16' on one end side and the outlet-side opening portion 15 of the nozzle hole 7. The corner portions 22 at the opening edge of the orifice 8 formed by the outlet-side opening portion 15 of the nozzle hole 7 and the semicircular-shaped outer edge portions 33 of the interference bodies 16' have a sharply pointed shape without roundness and are capable of making end portions of a liquid film of fuel passing through the orifice 8 have a sharply pointed shape for ease of atomization by friction with air. The nozzle plate 3 of the present modification includes the corner portions 22' which are formed at the butting portions P between the semicircular-shaped outer edge portions 33, 33 of the adjacent interference bodies 16', 16' have a sharply pointed shape without roundness, and are capable of making the end portions of the liquid film of fuel passing through the orifice 8 have a sharply pointed shape for ease of atomization by friction with air. In other words, the nozzle plate 3 of the present modification includes the corner portions 22, 22' having a sharply pointed shape without roundness formed at four positions.

Tenth Embodiment

Figure 13A:
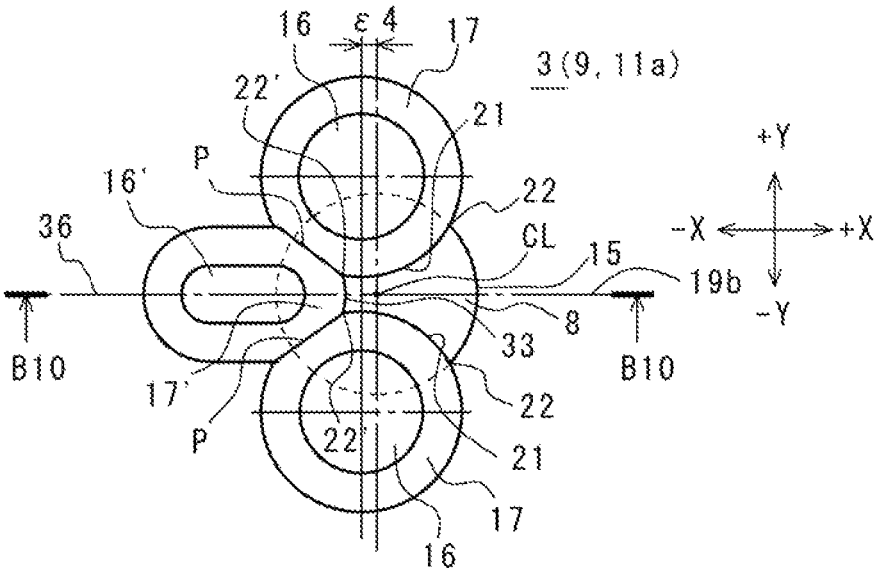
FIG. 13 illustrates a principal portion of a nozzle plate for a fuel injection device according to a tenth embodiment, which corresponds to FIG. 3.
Figure 13B:
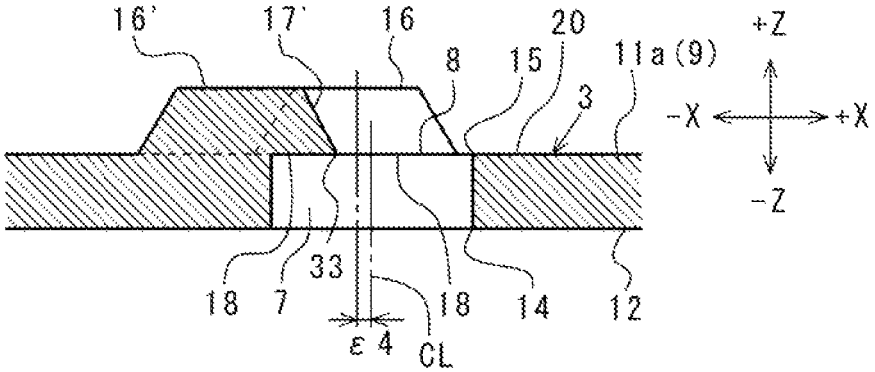

FIG. 13 illustrates a principal portion of a nozzle plate 3 according to a tenth embodiment of the present invention, and illustrates a modification of the nozzle plate 3 according to the ninth embodiment. Components of the nozzle plate 3 of the present embodiment common to the nozzle plate 3 of the first and ninth embodiments are denoted by the same reference numerals, and description overlapped with the description of the nozzle plate 3 in the first and ninth embodiments will be omitted.

The nozzle plate 3 of the present embodiment has a shape modified from the nozzle plate 3 of the ninth embodiment in such a manner that the interference body 16' located at the center is shifted in the −X direction, and the interference body 16' located adjacent thereto in the +Y-axis direction and the interference body 16' located adjacent thereto in the −Y-axis direction are changed to the interference bodies 16, 16 having a truncated conical shape. Consequently, the nozzle plate 3 of the present embodiment has the orifice 8 narrowed toward the X-axis compared with the nozzle plate 3 of the ninth embodiment, so that the amount of fuel which can be injected increases as it goes in the +X-axis direction.

The pair of interference bodies 16, 16 have a line symmetrical shape about the X-axis, and the center position is located at a position shifted from the Y-axis in the −X-axis direction by a predetermined dimension ε4.

In the nozzle plate 3 of the present embodiment, the corner portions 22, 22 formed by the circular outer edge portions 21, 21 of the pair of interference bodies 16, 16 and the outlet-side opening portion 15 of the nozzle hole 7 and the corner portions 22', 22' formed at the butting portions P, P between the pair of interference bodies 16, 16 and the interference body 16' have a sharply pointed shape without roundness and can make end portions of liquid films of fuel passing through the orifices 8 have a sharply pointed shape for ease of atomization by friction with air.

Eleventh Embodiment

Figure 14A:
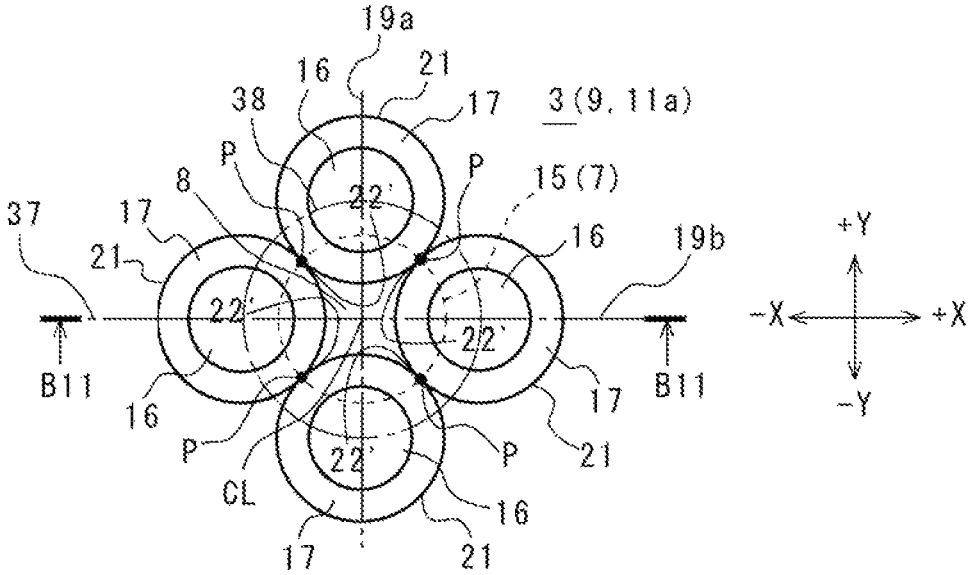
FIG. 14 illustrates a principal portion of a nozzle plate for a fuel injection device according to an eleventh embodiment, which corresponds to FIG. 3.
Figure 14B:
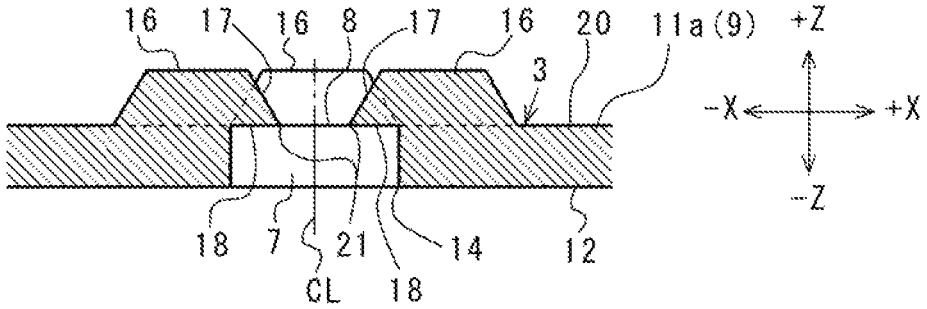

FIG. 14 illustrates a principal portion of a nozzle plate 3 according to an eleventh embodiment of the present invention. Components of the nozzle plate 3 of the present embodiment common to the nozzle plate 3 of the first embodiment are denoted by the same reference numerals, and description overlapped with the description of the nozzle plate 3 in the first embodiment will be omitted.

The nozzle plate 3 of the present embodiment includes the interference bodies 16 having a truncated conical shape arranged equidistantly formed at four positions on a circle 38 which is concentric with the circular outlet-side opening portion 15 of the nozzle hole 7. The butting portion P between the adjacent interference bodies 16, 16 is located on the outlet-side opening portion 15 of the nozzle hole 7, and the circular outer edge portions 21 of the interference bodies 16 at the four positions form the orifice 8. The corner portions 22', which are an intersecting portion between the circular outer edge portions 21, 21 of the adjacent interference bodies 16, 16 are formed at the butting portions P between the adjacent interference bodies 16, 16. Four of the corner portions 22' are formed equidistantly on the opening edge of the orifice 8.

These corner portions 22' of the orifice 8 each have a sharply pointed shape without roundness and make end portions of liquid films of fuel passing through the orifices 8 have a sharply pointed shape for ease of atomization by friction with air.

The nozzle plate 3 of the present embodiment may have a configuration in which the butting portions P of the circular outer edge portions 21, 21 of the adjacent interference bodies 16, 16 are arranged radially inside (positions biased to the center CL of the nozzle hole 7) of the outlet-side opening portion 15 of the nozzle hole 7.

The nozzle plate 3 of the present embodiment includes the four interference bodies 16 formed to have the same size. However, at least one of the interference bodies 16 may be formed to have a different size from other interference bodies 16.

Twelfth Embodiment

Figure 15A:
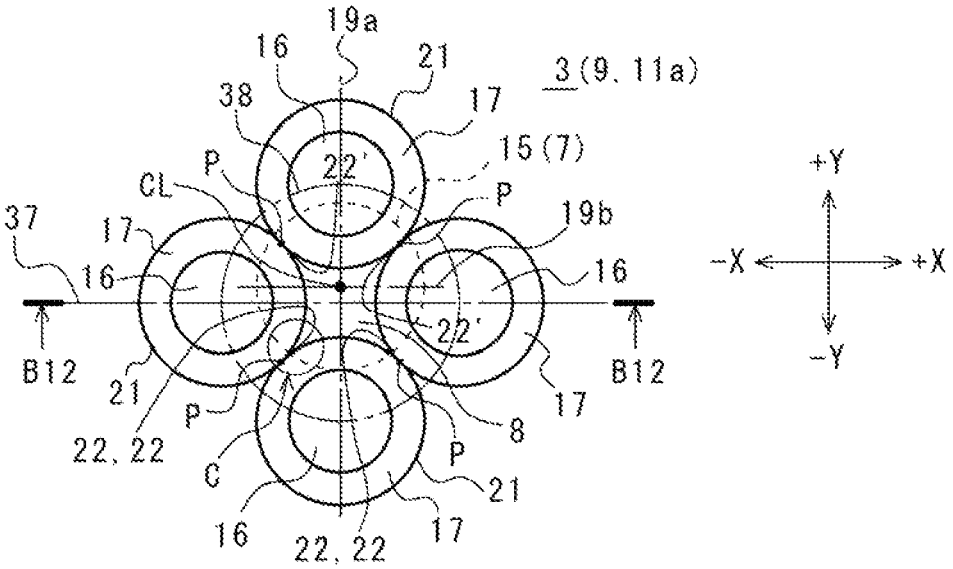
FIG. 15 illustrates a principal portion of a nozzle plate for a fuel injection device according to a twelfth embodiment, which corresponds to FIG. 3.
Figure 15B:
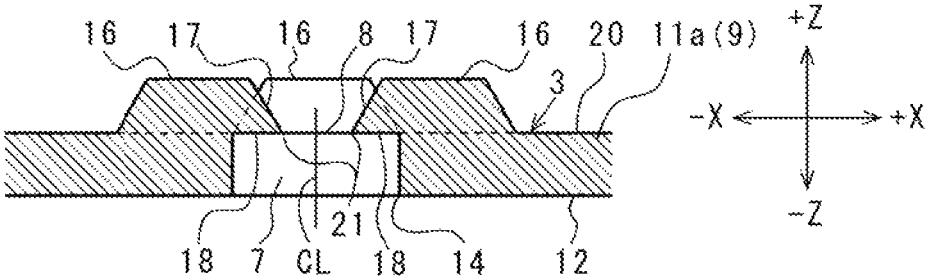
Figure 15C:
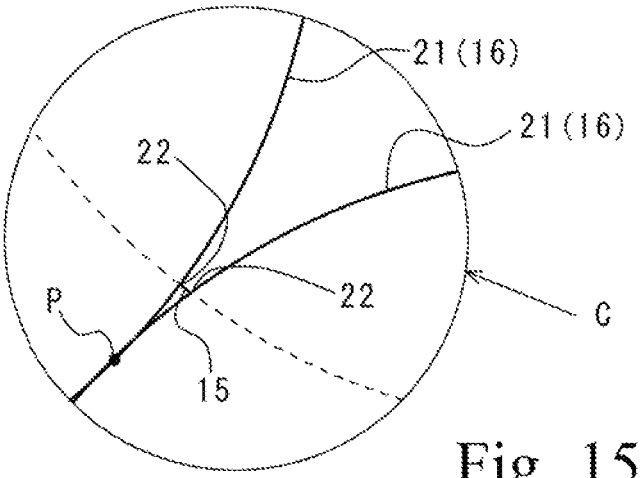

FIG. 15 illustrates a principal portion of a nozzle plate 3 according to a twelfth embodiment of the present invention, and illustrates a modification of the nozzle plate 3 according to the eleventh embodiment. Components of the nozzle plate 3 of the present embodiment common to the nozzle plate 3 of the first and eleventh embodiments are denoted by the same reference numerals, and description overlapped with the description of the nozzle plate 3 in the first and eleventh embodiments will be omitted.

The nozzle plate 3 of the present embodiment has a shape in which the four interference bodies 16 formed on the nozzle plate 3 of the eleventh embodiment are shifted in the −Y-axis direction with respect to the center CL of the nozzle hole 7. In other words, in the nozzle plate 3 of the present embodiment, a center of the circle 38 on which the four interference bodies 16 are arranged equidistantly is shifted in the −Y-axis direction with respect to the center CL of the nozzle hole 7 and a centerline (a straight line connecting centers of the pair of interference bodies 16, 16 opposing to each other in the X-axis direction) 37 passing through the center of the circle 38 and extending in the X-axis direction is shifted in the −Y-axis direction with respect to the straight line 19*b* passing through the center CL of the nozzle hole 7 and extending in the X-axis direction. In the nozzle plate 3 of the eleventh embodiment, the center of the circle 38 on which the four interference bodies 16 are arranged equidistantly matches the center CL of the nozzle hole 7.

The nozzle plate 3 of the present embodiment includes the orifice 8 formed by the circular outer edge portions 21 of the four interference bodies 16 and the outlet-side opening portion 15 of the nozzle hole 7. Two of the butting portions P of the pair of adjacent interference bodies 16, 16 are located radially inward of the outlet-side opening portion 15 of the nozzle hole 7 and other two are located radially outward of the outlet-side opening portion 15 of the nozzle hole 7. Consequently, the nozzle plate 3 of the present embodiment includes the two corner portions 22' formed at the butting portions P of the circular outer edge portions 21, 21 of the adjacent interference bodies 16, 16 and the four corner portions 22 formed by the circular outer edge portions 21, 21 of the adjacent interference bodies 16, 16 and the circular outlet-side opening portions 15 of the nozzle hole 7 formed at the opening edge of the orifice 8. These corner portions 22, 22' formed on the opening edge of the orifice 8 have a sharply pointed shape without roundness, and are capable of making end portions of a liquid film of fuel passing through the orifice 8 have a sharply pointed shape for ease of atomization by friction with air.

Thirteenth Embodiment

Figure 16C:
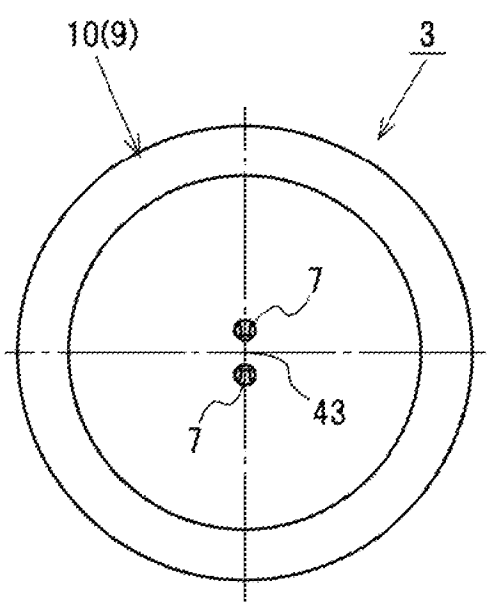
FIG. 16 illustrates a nozzle plate according to a thirteenth embodiment.
Figure 16B:
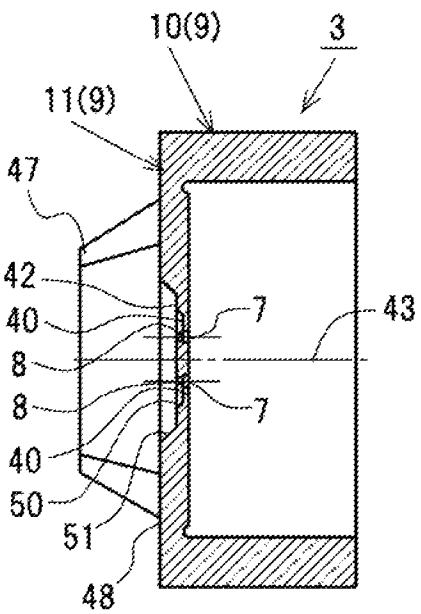
Figure 16A:
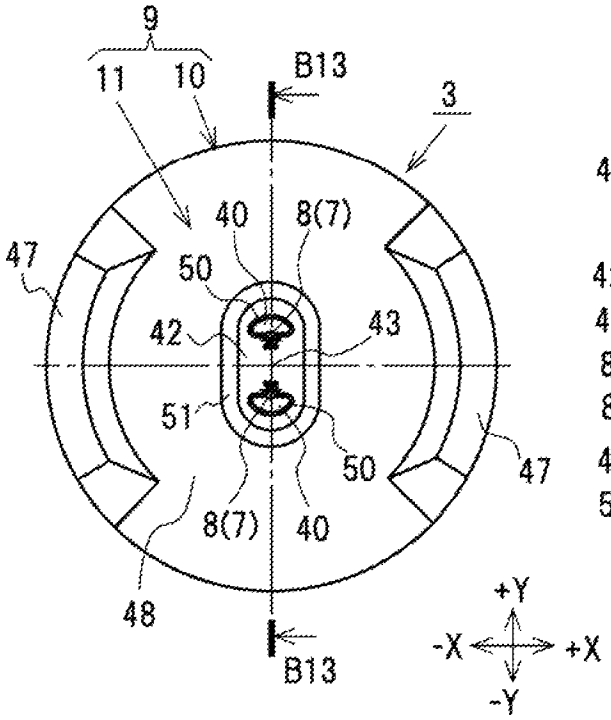
Figure 17A:
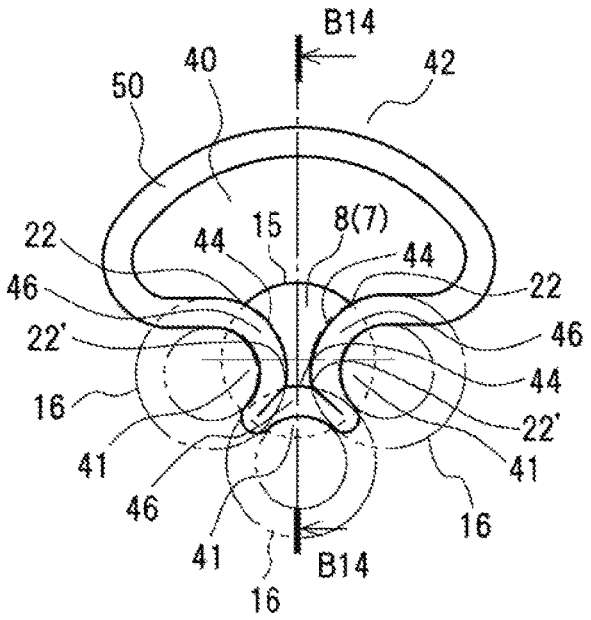
FIG. 17(*a*) is an enlarged drawing illustrating a peripheral portion of a nozzle hole illustrated in FIG. 16(*a*), and FIG. 17(*b*) is a partial cross-sectional view of the nozzle plate taken along line B14-B14 in FIG. 17(*a*).
Figure 17B:
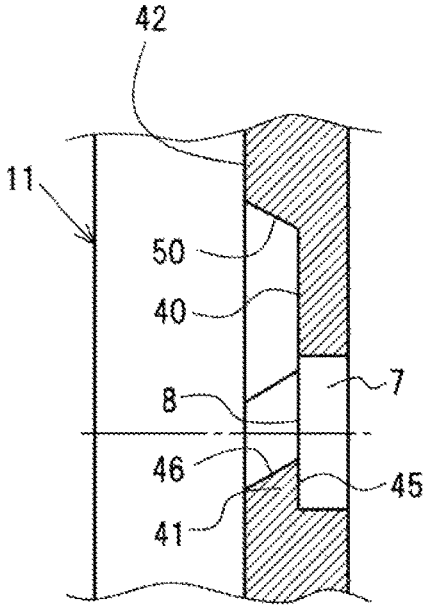

FIG. 16 to FIG. 17 illustrate a nozzle plate 3 according to a thirteenth embodiment of the present invention. FIG. 16(*a*) is a front view of the nozzle plate 3, FIG. 16(*b*) is a cross-sectional view of the nozzle plate 3 taken along line B13-B13 in FIG. 16(*a*) and FIG. 16(*c*) is a back view of the nozzle plate 3. FIG. 17(*a*) is a view illustrating a peripheral portion of the nozzle hole 7 illustrated in FIG. 16(*a*) in an enlarged scale, and FIG. 17(*b*) is a partial cross-sectional view of the nozzle plate 3 taken along line B14-B14 in FIG. 17(*a*).

As illustrated in these drawings, in the nozzle plate 3 of the present embodiment, a nozzle plate body 9 includes a cylindrical wall portion 10 fitted to a distal end side of the valve body 5 and a bottom wall portion 11 formed so as to occlude one end side of the cylindrical wall portion 10 (See FIG. 2). The bottom wall portion 11 includes nozzle hole plate portions 40 having the nozzle holes 7 opened therein, and an interference body plate portion 42 provided with interference bodies 41 formed therein. The interference body plate portion 42 is formed by being counterbored into a substantially oval shape (formed so as to be elongated along the Y-axis direction of FIG. 16(*a*) and to have both ends rounded into a semi-circular shape) around a center axis 43 of the bottom wall portion 11. The nozzle hole plate portion 40 has a shape formed by partly counterboring the interference body plate portion 42 in the periphery of the nozzle hole 7, and is formed to be thinner than the interference body plate portion 42. The bottom wall portion 11 includes the two nozzle holes 7 at two positions equidistantly around the center axis 43 so that parts of the nozzle holes 7 penetrate from the front to the rear of the nozzle hole plate portion 40 (so as to open to the front and the rear). The bottom wall portion 11 includes interference bodies 41 configured to partly occlude each of the nozzle holes 7 formed at three positions on the interference body plate portion 42.

The three interference bodies 41 formed in the interference body plate portion 42 have the same shape as part of the interference bodies 16 described in the first embodiment, and form the orifice 8 by occluding parts of the nozzle hole 7. The corner portions 22 formed by arcuate-shaped outer edge portions 44 of the interference bodies 41 and the outlet-side opening portion 15 of the nozzle hole 7 and the corner portions 22' formed by the interference bodies 41 and the butting portions between the interference bodies 41 have a sharply pointed shape without roundness, and are capable of making end portions of a liquid film of fuel passing through the orifice 8 have a sharply pointed shape for ease of atomization by friction with air. The orifice 8 on the nozzle plate 3 of the present embodiment is similar in shape to the orifice 8 illustrated in FIG. 13(*a*).

The three interference bodies 41 formed on the interference body plate portion 42 have fuel colliding surfaces 45 and side surfaces (inclined surfaces) 46 similar to the fuel colliding surfaces 18 and the side surfaces (inclined surface) 17 of the interference bodies 16 described in the first embodiment, and the same advantageous effects as the advantageous effects achieved by the fuel colliding surfaces 18 and the side surfaces 17 of the interference bodies 16 described in the first embodiment are achieved.

The bottom wall portion 11 includes a pair of nozzle guard projections 47 at positions surrounding the nozzle hole plate portion 40 on an outer surface 48 on a radially outer end side thereof so as to oppose to each other. The nozzle guard projections 47 are block members formed so as to project along a direction of extension of the center axis (the center axis 43 of the nozzle plate 3) of the valve body 5 in a state in which the nozzle plate 3 is mounted at the distal end side of the valve body 5 (see FIG. 2). The nozzle guard projections 47 are formed so as to form a gap between a virtual plane and the bottom wall portion 11 when the distal ends thereof come into contact with the virtual plane. In this manner, the nozzle guard projections 47 formed on the bottom wall portion 11 prevent a tool or the like from colliding with the nozzle holes 7 or the periphery thereof when fastening the nozzle plate 3 on the valve body 5 to prevent the nozzle holes 7 and the periphery thereof on the bottom wall portion 11 from becoming damaged, and prevent engine parts or the like from colliding with the nozzle holes 7 and the periphery thereof when fastening the fuel injection device 1 having the nozzle plate 3 fastened on the valve body 5 on the inlet pipe 2 of the engine to prevent the nozzle holes 7 and the periphery thereof on the bottom wall portion 11 from becoming damaged.

On the bottom wall portion 11, side surfaces (inclined surfaces) 50 connecting the outer surfaces of the nozzle hole plate portions 40 and the outer surface of the interference body plate portion 42 are formed at positions away from the outlet-side opening portions 15 of the nozzle holes 7 so as to be located at the same distance from the outlet-side opening portions 15 of the nozzle holes 7 opening in the nozzle hole plate portions 40 so as not to intercept spray injected from the nozzle holes 7. A side surface (inclined surface) 51 connecting the outer surface of the interference body plate portion 42 and the outer surface of the bottom wall portion 11 and the nozzle guard projections 47 are formed at positions that do not intercept spray injected from the nozzle holes 7.

The nozzle plate 3 of the present embodiment as described above may have a large thickness over a wide range around the nozzle holes 7 and the nozzle hole plate portions 40 compared with the case where the interference bodies 16 are formed independently for each of the nozzle holes 7 (see FIG. 2), so that an improvement in strength of the bottom wall portion 11 is achieved.

In the present embodiment, a mode in which the pair of nozzle holes 7 are provided equidistantly around the center axis 43 of the bottom wall portion 11 has been exemplified. However, the present invention is not limited thereto, and the nozzle hole 7 only needs to be formed at one position. The thicknesses of the nozzle hole plate portion 40 and the interference body plate portion 42 of the bottom wall portion 11 are changed as needed depending on required fuel injection properties and the like. The nozzle guard projections 47 may be an annular member formed in an annular shape along a circumferential direction of the bottom wall portion 11 on the outer peripheral end side and so as to surround the nozzle hole plate portion 40 as long as spray injected from the nozzle holes 7 is not intercepted.

Fourteenth Embodiment

Figure 18C:
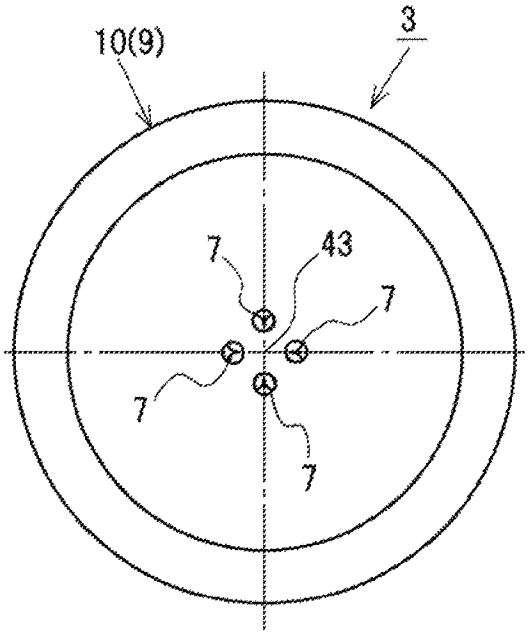
FIG. 18 illustrates a nozzle plate according to a fourteenth embodiment.
Figure 18B:
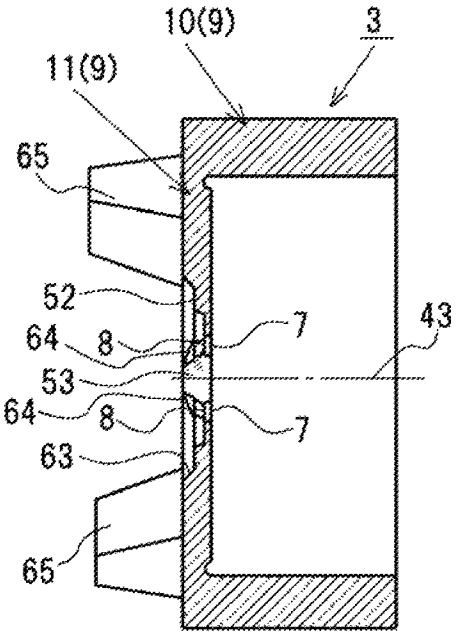
Figure 18A:
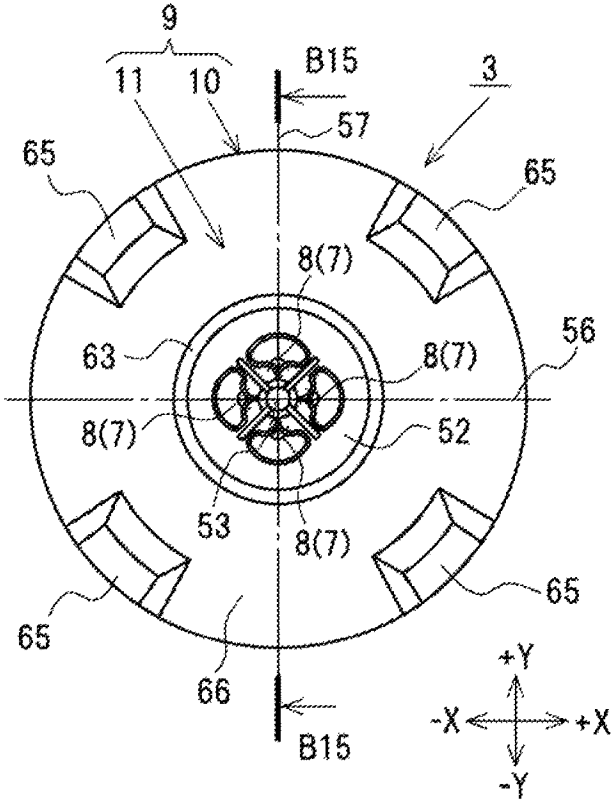
Figure 19A:
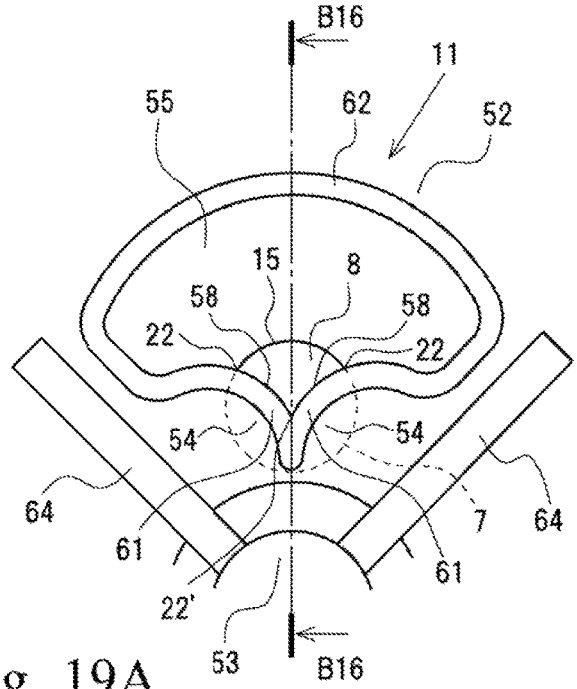
FIG. 19(*a*) is an enlarged drawing of the peripheral portion of the nozzle hole illustrated in FIG. 18(*a*).
Figure 19B:
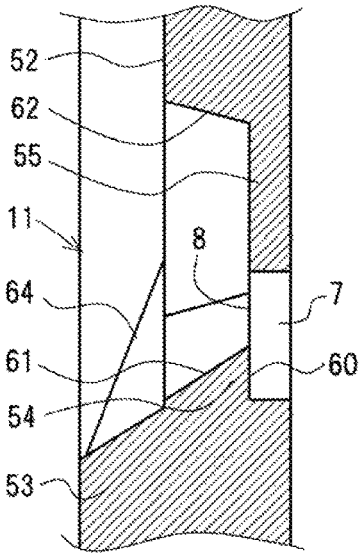
Figure 19C:
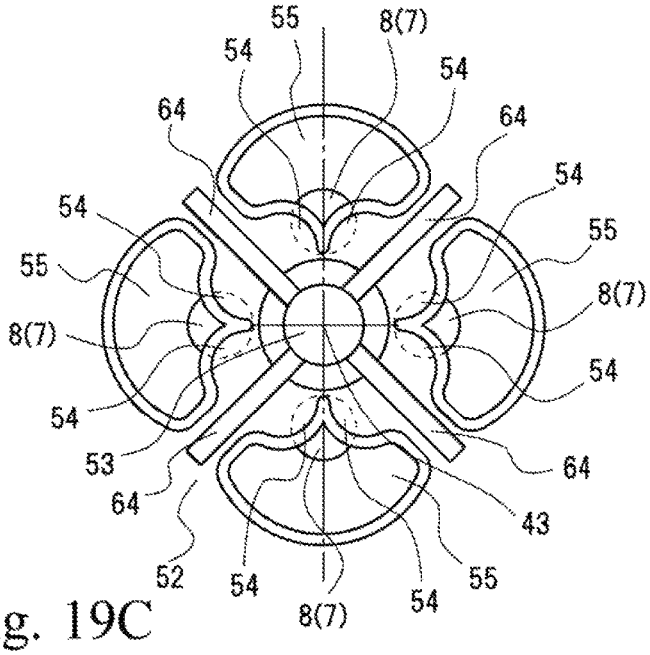

FIG. 18 to FIG. 19 illustrate a nozzle plate 3 according to a fourteenth embodiment of the present invention. FIG. 18(*a*) is a front view of the nozzle plate 3, FIG. 18(*b*) is a cross-sectional view of the nozzle plate 3 taken along line B15-B15 in FIG. 18(*a*) and FIG. 18(*c*) is a back view of the nozzle plate 3. FIG. 19(*a*) is a view illustrating a peripheral portion of the nozzle hole 7 illustrated in FIG. 18(*a*) in an enlarged scale, FIG. 19(*b*) is a cross-sectional view taken along line B16-B16 in FIG. 19(*a*), and FIG. 19(*c*) is a drawing of a center portion of FIG. 18(*a*) illustrated in an enlarged scale.

As illustrated in the drawings, in the nozzle plate 3 of the present embodiment, an interference body plate portion 52 is formed by counterboring the periphery of the center axis 43 of a bottom wall portion 11 into a hollow disc shape, and a reinforcing strut portion 53 having a truncated conical shape at a center of the bottom wall portion 11. The nozzle holes 7 are formed at four positions equidistantly around the center axis 43 of the bottom wall portion 11. Each of the nozzle holes 7 is partly occluded by interference bodies 54 formed on the interference body plate portion 52, other portions thereof open to nozzle hole plate portions 55 formed by partly counterboring the interference body plate portion 52. A pair of the nozzle holes 7 are located on a centerline 56 parallel to the X-axis in FIG. 18(*a*), and a pair of the nozzle holes 7 are located on a centerline 57 parallel to the Y-axis.

The interference body plate portion 52 is provided with two of the interference bodies 54 for each of the nozzle holes 7, and eight in total of the interference bodies 54 are formed for four in total of the nozzle holes 7. The two interference bodies 54 formed in the interference body plate portion 52 form the orifice 8 by partly occluding the outlet-side opening portion 15 of the nozzle hole 7 in the same manner as the pair of interference bodies 16, 16 illustrated in FIG. 11. The orifice 8 is formed into a substantially fan shape by the outlet-side opening portion 15 of the nozzle hole 7 and arcuate-shaped outer edge portions 58 of the interference bodies 54. The orifice 8 is provided at the opening edge thereof with the corner portions 22 formed by the outlet-side opening portion 15 of the nozzle hole 7 and the arcuate-shaped outer edge portions 58 of the interference bodies 54 and the corner portion 22' formed at the butting portion between the interference bodies 54, 54. These corner portions 22, 22' of the orifice 8 have a sharply pointed shape without roundness and are capable of thinning end portions of a liquid film passing through the orifice 8 and making the end portions of the liquid film of fuel passing through the orifice 8 have a sharply pointed shape for ease of atomization by friction with air.

The two interference bodies 54 formed on the interference body plate portion 52 have fuel colliding surfaces 60 and side surfaces (inclined surfaces) 61 similar to the fuel colliding surfaces 18 and the side surfaces (inclined surfaces) 17 of the interference bodies 16 described in the first embodiment, and the same advantageous effects as the advantageous effects achieved by the fuel colliding surfaces 18 and the side surfaces 17 of the interference bodies 16 described in the first embodiment are achieved.

On the bottom wall portion 11, a side surface (inclined surface) 62 connecting the outer surface of the nozzle hole plate portion 55 and an outer surface of the interference body plate portion 52 is formed at a position away from the outlet-side opening portion 15 of the nozzle hole 7 so as to be located at the substantially same distance from the outlet-side opening portion 15 of the nozzle hole 7 opening in the nozzle hole plate portion 55 so as not to intercept spray injected from the nozzle hole 7. A side surface (inclined surface) 63 connecting the outer surface of the interference body plate portion 52 and the outer surface of the bottom wall portion 11 is formed at a position that does not intercept spray injected from the nozzle holes 7.

The bottom wall portion 11 includes reinforcing ribs 64 connecting the interference body plate portion 52 between the adjacent nozzle hole plate portions 55, 55 to the reinforcing strut portion 53, so that parts of the interference body plate portion 52 in the vicinity of the nozzle holes 7 and the nozzle hole plate portions 55 are reinforced.

The bottom wall portion 11 includes four nozzle guard projections 65 formed at four positions surrounding the nozzle hole plate portion 55 equidistantly on a radially outer end side of an outer surface 66. The nozzle guard projections 65 are block members formed so as to project along a direction of extension of the center axis (the center axis 43 of the nozzle plate 3) of the valve body 5 in a state in which the nozzle plate 3 is mounted at the distal end side of the valve body 5 (see FIG. 2). The nozzle guard projections 65 are formed so as to form a gap between a virtual plane and the bottom wall portion 11 when the distal ends thereof come into contact with the virtual plane. In this manner, the nozzle guard projections 65 formed on the bottom wall portion 11 prevent a tool or the like from colliding with the nozzle holes 7 and the periphery thereof when fastening the nozzle plate 3 on the valve body 5 to prevent the nozzle holes 7 and the periphery thereof on the bottom wall portion 11 from becoming damaged, and prevent engine parts or the like from colliding with the nozzle holes 7 and the periphery thereof when fastening the fuel injection device 1 having the nozzle plate 3 fastened on the valve body 5 on the inlet pipe 2 to prevent the nozzle holes 7 and the periphery thereof on the bottom wall portion 11 from becoming damaged. The four nozzle guard projections 65 are located so as to be shifted by 45 degrees with respect to the centerline 56 parallel to the X-axis and formed at positions which do not intercept spray injected from the nozzle holes 7 as illustrated in FIG. 18(*a*).

The nozzle plate 3 of the present embodiment as described above may have a large thickness over a wide range around the nozzle holes 7 and the nozzle hole plate portions 55 compared with the case where the interference bodies 16 are formed independently for each of the nozzle holes 7 (see FIG. 2), so that an improvement in strength of the bottom wall portion 11 is achieved.

In the present embodiment, the thicknesses of the nozzle hole plate portions 55 and the interference body plate portions 52 of the bottom wall portion 11 are changed as needed depending on required fuel injection properties and the like. The nozzle guard projections 65 may be an annular member formed in an annular shape along the circumferential direction of the bottom wall portion 11 on the outer peripheral end side and so as to surround the four nozzle hole plate portions 55 as long as spray injected from the nozzle holes 7 is not intercepted.

Fifteenth Embodiment

Figure 20A:
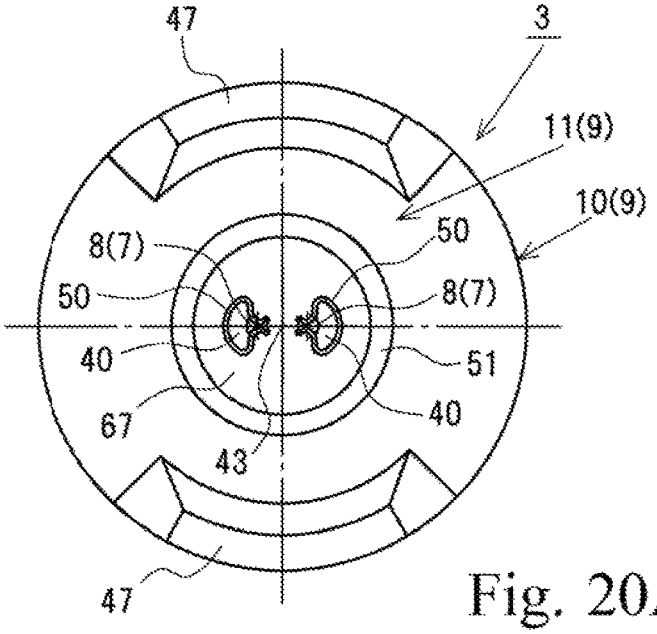
FIG. 20 illustrates a nozzle plate according to a fifteenth embodiment, and illustrates a modification of the nozzle plate according to the thirteenth embodiment.
Figure 20B:
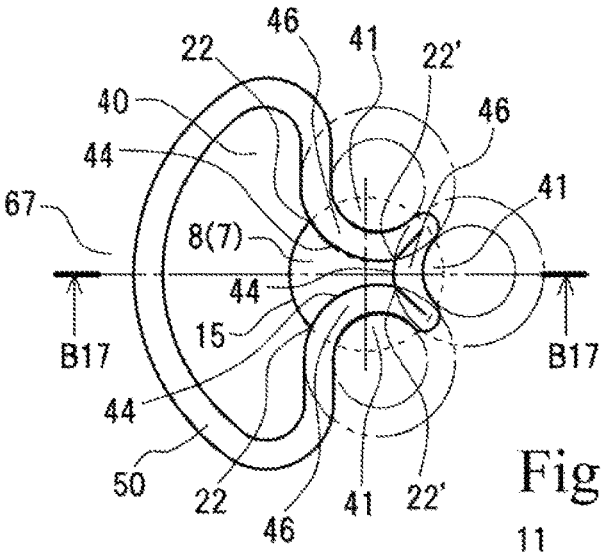
Figure 20C:
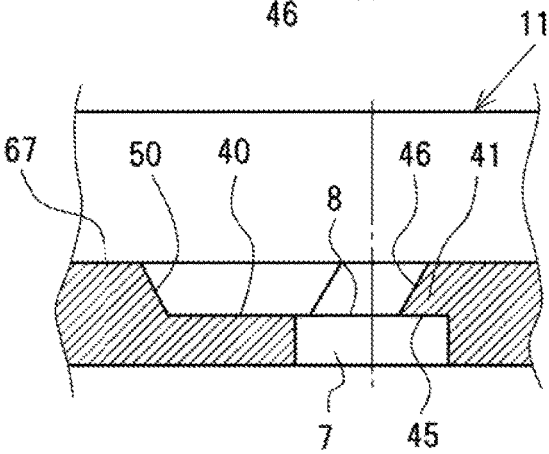

FIG. 20 illustrates a nozzle plate 3 according to a fifteenth embodiment of the present invention, and illustrates a modification of the nozzle plate 3 according to the thirteenth embodiment. FIG. 20(*a*) is a front view of the nozzle plate 3, FIG. 20(*b*) is an enlarged drawing of the peripheral portion of a nozzle hole 7 illustrated in FIG. 20(*a*), and FIG. 20(*c*) is a cross-sectional view taken along line B17-B17 in FIG. 20(*b*).

As illustrated in FIG. 20, the nozzle plate 3 of the present embodiment is different from the interference body plate portion 42 of the nozzle plate 3 of the thirteenth embodiment in the shape of the interference body plate portion 67. However, other configurations are the same as the nozzle plate 3 of the thirteenth embodiment. Therefore, description of the nozzle plate 3 of the present embodiment overlapped with the description of the nozzle plate 3 of the thirteenth embodiment will be omitted. In the nozzle plate 3 of the present embodiment illustrated in FIG. 20, common components to those of the nozzle plate 3 of the thirteenth embodiment are denoted by the same reference numerals.

In other words, the nozzle plate 3 of the present embodiment includes the interference body plate portion 67 formed into a circular shape around the center axis 43 of the bottom wall portion 11 (see FIG. 20(*a*)), and is different from the nozzle plate 3 of the thirteenth embodiment having the interference body plate portion 42 formed into a substantially oval shape. Like the nozzle plate 3 of the present embodiment, the interference body plate portion 67 may be modified as needed as long as spray injected from the nozzle holes 7 is not intercepted.

Sixteenth Embodiment

Figure 21A:
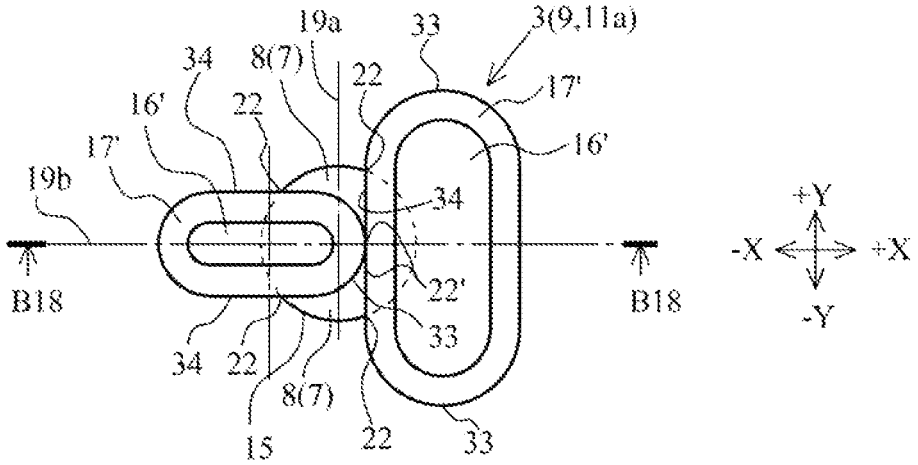
FIG. 21 illustrates a nozzle plate according to a sixteenth embodiment.
Figure 21B:
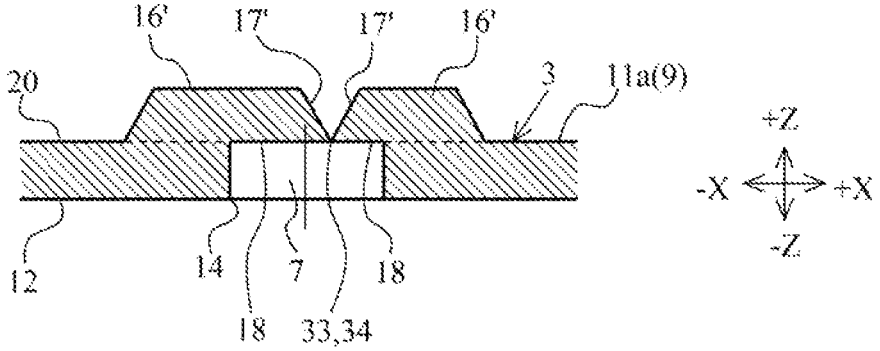
Figure 22A:
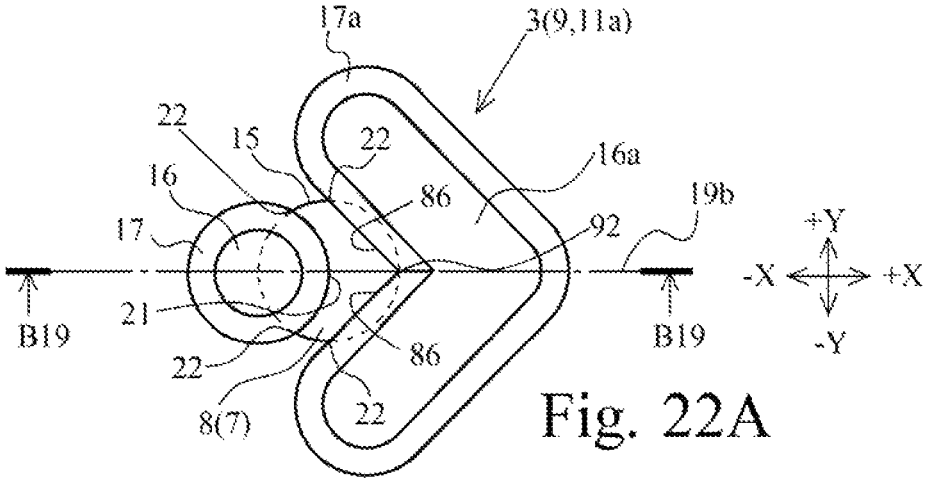
FIG. 22 illustrates a nozzle plate according to a seventeenth embodiment.
Figure 22B:
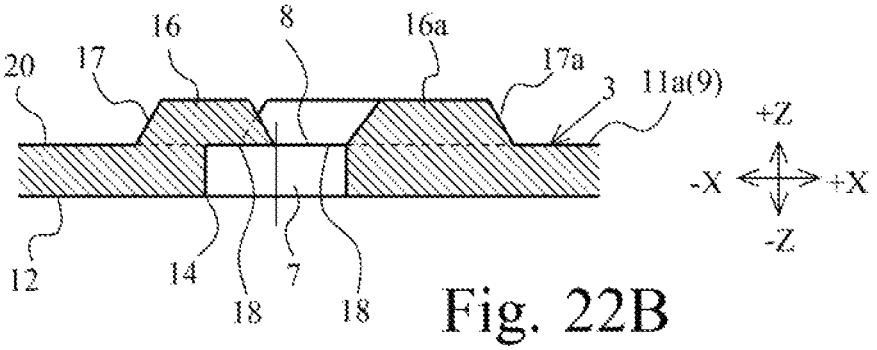
Figure 22C:
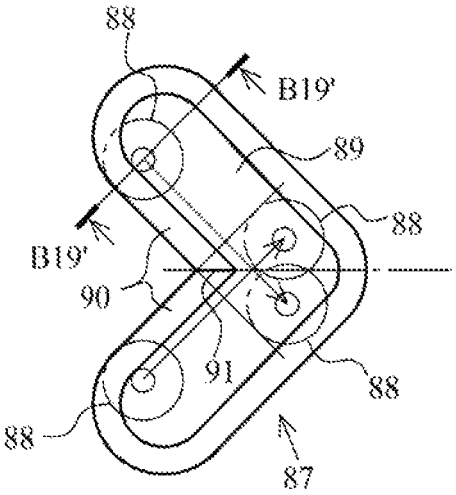
Figure 22D:
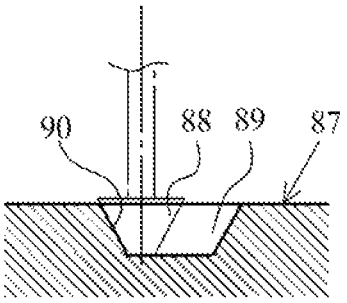

FIG. 21 illustrates a nozzle plate 3 according to a sixteenth embodiment of the present invention. FIG. 21(*a*) is a plan view of part of the nozzle plate 3 and FIG. 21(*b*) is a cross-sectional view of part of the nozzle plate 3 taken along line B18-B18 in FIG. 21(*a*). In the nozzle plate 3 of the present embodiment illustrated in FIG. 21, components common to the nozzle plates 3 of the embodiments described above are denoted by the same reference numerals as those of the components of the nozzle plates 3 of the embodiments described above, and overlapped description with those of the nozzle plates 3 of the embodiments described above will be omitted.

As illustrated in FIG. 21, the nozzle plate 3 of the present embodiment is characterized by a point in which linear outer edge portions 34, 34 of a first interference body 16' and a second interference body 16' constitute part of the orifice 8. In other words, in the nozzle plate 3 of the present embodiment, the first interference body 16' and the second interference body 16' partly occlude the outlet-side opening portion 15 of the nozzle hole 7, and the orifices 8 are formed by the linear outer edge portions 34, 34 of the first interference body 16' and the second interference body 16', the semicircular-shaped outer edge portion (arcuate-shaped outer edge portions) 33 of the first interference body 16', and the circular outlet-side opening portion 15 of the nozzle hole 7. The first and second interference bodies 16' have a shape having semicircular shapes at both end portions in the longitudinal direction of the rectangular shape in plan view. The first interference body 16' is arranged along the straight line (centerline) 19*b* so that the longitudinal direction extends in parallel to the X-axis, a distal end of the semicircular-shaped outer edge portion 33 on one end side butts the linear outer edge portions 34 of the second interference body 16'. The second interference body 16' is arranged so that the longitudinal direction extends parallel to the Y-axis, and is formed to be larger than the first interference body 16'.

As illustrated in FIG. 21, in the nozzle plate 3 of the present embodiment, the corner portions 22 formed by the linear outer edge portion 34 of the first interference body 16' and the circular outlet-side opening portion 15 of the nozzle hole 7 have a substantially crescent moon shaped sharply pointed shape without roundness in plan view, and thus the end portions of liquid films of fuel passing through the orifices 8 have a shape easily atomized by friction with air. The corner portions 22 formed by the linear outer edge portion 34 of the second interference body 16' and the circular outlet-side opening portion 15 of the nozzle hole 7 have a sharply pointed shape without roundness, and thus the end portions of liquid films of fuel passing through the orifices 8 have a shape easily atomized by friction with air. The corner portions 22', 22' formed at the butting portion between the semicircular-shaped outer edge portion 33 of the first interference body 16' and the linear outer edge portion 34 of the second interference body 16' have a substantially crescent moon shaped sharply pointed shape without roundness in plan view, and thus the end portions of liquid films of fuel passing through the orifices 8 have a shape easily atomized by friction with air.

The nozzle plate 3 of the present embodiment as described above is configured in such a manner that the first interference body 16' and the second interference body 16' partly occlude the outlet-side opening portion 15 of the nozzle hole 7, so that part of fuel passing through the nozzle hole 7 collides with the fuel colliding surfaces 18, 18 of the first interference body 16' and the second interference body 16', and thus the flowing direction is rapidly changed, and a fuel flow rapidly changed in the flowing direction and a fuel flow proceeding in the nozzle hole 7 collide with each other to make the fuel flow passing through the nozzle hole 7 and the orifice 8 turbulent. In the nozzle plate 3 of the present embodiment as described above, the corner portion 22 formed by the linear outer edge portions 34 of the first interference body 16' and the circular outlet-side opening portion 15 of the nozzle hole 7, the corner portion 22 formed by the linear outer edge portion 34 of the second interference body 16' and the circular outlet-side opening portion 15 of the nozzle hole 7, and the corner portions 22', 22' formed at a contact portion between the semicircular-shaped outer edge portion 33 of the first interference body 16' and the linear outer edge portions 34 of the second interference body 16' have a sharply pointed shape without roundness and thus the end portions of liquid films of fuel passing through the orifices 8 have a shape easily atomized by friction with air. Therefore, the nozzle plate 3 of the present embodiment can further improve the degree of atomization of the fuel injected from the orifices 8 compared with the nozzle plate of the related art.

Seventeenth Embodiment

FIG. 22 illustrates a nozzle plate 3 according to a seventeenth embodiment of the present invention. FIG. 22(*a*) is a plan view of part of the nozzle plate 3 and FIG. 22(*b*) is a partly cross-sectional view of the nozzle plate 3 taken along line B19-B19 in FIG. 22(*a*). FIG. 22(*c*) is a plan view illustrating a relationship between a shape of a cavity 89 of a die 87 and a rotary forming tool 88. FIG. 22(*d*) is a cross-sectional view taken along line B19'-B19' in FIG. 22(*c*). In the nozzle plate 3 of the present embodiment illustrated in FIG. 22, components common to the nozzle plates 3 of the embodiments described above are denoted by the same reference numerals as those of the components of the nozzle plates 3 of the embodiments described above, and overlapped description with those of the nozzle plates 3 of the embodiments described above will be omitted.

As illustrated in FIG. 22, the nozzle plate 3 of the present embodiment is characterized by a point in which linear outer edge portions 86, 86 of a V-shaped interference body 16*a* constitute part of the orifice 8. In other words, in the nozzle plate 3 of the present embodiment, an interference body 16 and the V-shaped interference body 16*a* partly occlude an outlet-side opening portion 15 of a nozzle hole 7, and an orifice 8 is formed by an arcuate outer edge portion 21 of the interference body 16, the linear outer edge portions (outer edge portions) 86, 86 of the V-shaped interference body 16*a* and the circular outlet-side opening portion 15 of the nozzle hole 7. The interference body 16 has a circular shape in plan view. The V-shaped interference body 16*a* has a shape that a pair of interference bodies 16', 16' butted each other in plan view. The V-shaped interference body 16*a* is formed by forming the V-shaped cavity 89 for injection molding by cutting or grinding the die 87 with the rotary forming tool (end mill or the like) 88 and injecting melted resin into the cavity 89 of the die 87 as illustrated in FIGS. 22(*c*) to (*d*). V-shaped inner side walls 90, 90 of the cavity 89 are side walls for forming the linear outer edge portions 86, 86 located so as to occlude the nozzle hole 7. The V-shaped inner side walls 90, 90 form a sharp ridge line 91 without roundness by the rotary forming tool 88 whereof a movement locus intersects at a bottom of a V-shaped valley at a portion of intersection of the rotary forming tool 88. Therefore, the interference body 16*a* molded by the V-shaped cavity 89 for injection molding has a sharply pointed shape without roundness at a corner portion (an intersecting portion between the pair of linear outer edge portions 86, 86) 92 of the pair of linear outer edge portions 86, 86 intersecting in a V-shape. A side surface 17*a* of the V-shaped interference body 16*a* is formed so as to intersect a fuel colliding surface 18 at an acute angle in the same manner as a side surface 17 of the interference body 16 having a truncated conical shape.

As illustrated in FIG. 22, the nozzle plate 3 of the present embodiment is formed in such a manner that the center of the interference body 16 is located on a straight line (a centerline extending in a direction along an X-axis) 19*b* passing through a center of the nozzle hole 7. The nozzle plate 3 of the present embodiment is formed in such a manner that a distal end of the corner portion 92 of the pair of linear outer edge portions 86, 86 intersecting in the V-shape is located on the straight line 19*b*, and the distal end of the corner portion 92 of the pair of linear outer edge portions 86, 86 intersecting in the V-shape is located on an opening edge of the outlet-side opening portion 15. The V-shaped interference body 16*a* is formed so as to have a line symmetry shape with respect to the straight line 19*b* as an axis of symmetry.

As illustrated in FIG. 22, in the nozzle plate 3 of the present embodiment, the interference body 16 and the V-shaped interference body 16*a* partly occlude the circular outlet-side opening portion 15 of the nozzle hole 7, and the orifice 8 is formed by the arcuate outer edge portion 21 of the interference body 16, the pair of linear outer edge portions 86, 86 of the V-shaped interference body 16*a*, and the circular outlet-side opening portion 15 of the nozzle hole 7. The corner portions 22 formed by the arcuate outer edge portion 21 of the interference body 16 and the circular outlet-side opening portion 15 of the nozzle hole 7 have a crescent moon shaped sharply pointed shape without roundness in plan view, and an end portion of a liquid film of fuel passing through the orifice 8 has a sharply pointed shape for ease of atomization by friction with air. The corner portions 22 formed by the linear outer edge portions 86, 86 of the V-shaped interference body 16*a* and the circular outlet-side opening portion 15 of the nozzle hole 7 have a sharply pointed shape without roundness, and thus the end portions of liquid films of fuel passing through the orifices 8 have a shape easily atomized by friction with air. The V-shaped corner portion 92 of the V-shaped interference body 16*a* has a sharply pointed shape without roundness, and thus the end portions of liquid films of fuel passing through the orifices 8 have a shape easily atomized by friction with air.

The nozzle plate 3 of the present embodiment as described above is configured in such a manner that the interference body 16 and the V-shaped interference body 16*a* partly occlude the outlet-side opening portion 15 of the nozzle hole 7, so that part of fuel passing through the nozzle hole 7 collides with the fuel colliding surfaces 18, 18 of the interference body 16 and the V-shaped interference body 16*a*, and hence a flowing direction is rapidly changed, and the fuel flow whereof the flowing direction is rapidly changed and the fuel flow proceeding straight forward in the nozzle hole 7 collide with each other to make the fuel flow passing through the nozzle hole 7 and the orifice 8 turbulent. In the nozzle plate 3 of the present embodiment as described above, the corner portions 22 formed by the arcuate outer edge portion 21 of the interference body 16 and the circular outlet-side opening portion 15 of the nozzle hole 7, the corner portions 22 formed by the linear outer edge portions 86, 86 of the V-shaped interference body 16*a* and the circular outlet-side opening portion 15 of the nozzle hole 7, and the V-shaped corner portion 92 of the V-shaped interference body 16*a* have a sharply pointed shape without roundness, and thus the end portions of liquid films of fuel passing through the orifices 8 have a shape easily atomized by friction with air. Therefore, the nozzle plate 3 of the present embodiment can further improve the degree of atomization of the fuel injected from the orifices 8 compared with the nozzle plate of the related art.

Eighteenth Embodiment

Figure 23A:
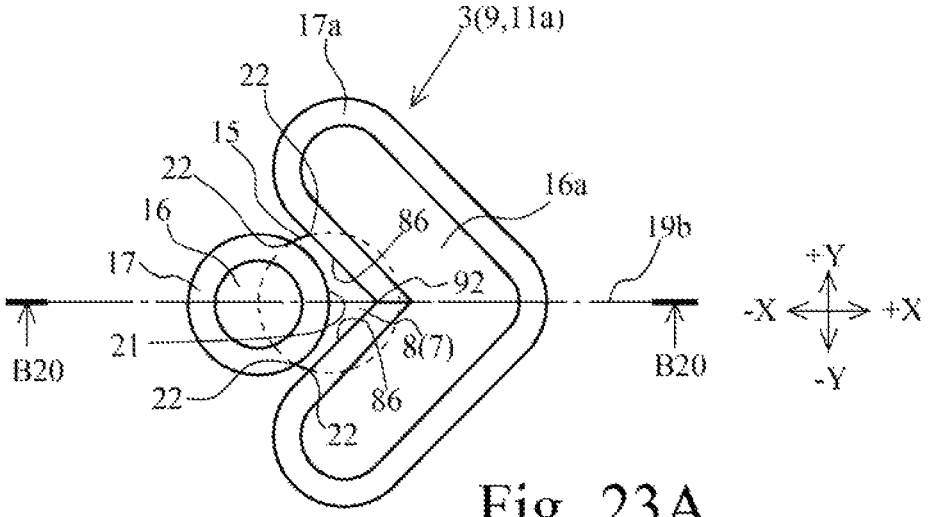
FIG. 23 illustrates a nozzle plate according to an eighteenth embodiment.
Figure 23B:
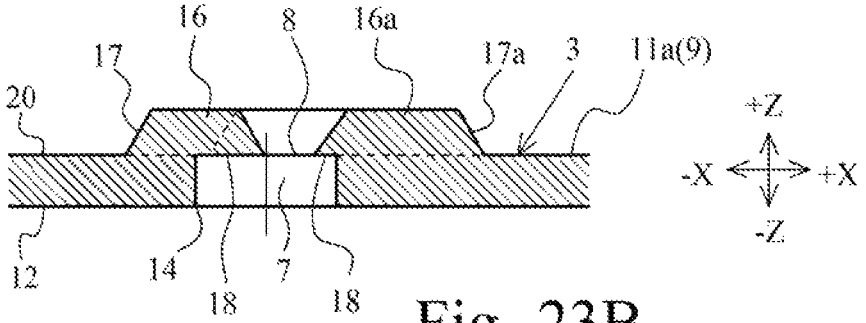

FIG. 23 illustrates a nozzle plate 3 according to an eighteenth embodiment of the present invention, and illustrates a modification of the nozzle plate 3 according to the seventeenth embodiment. FIG. 23(*a*) is a plan view of part of the nozzle plate 3 and FIG. 23(*b*) is a cross-sectional view of part of the nozzle plate 3 taken along line B20-B20 in FIG. 23(*a*). In the nozzle plate 3 of the present embodiment illustrated in FIG. 23, components common to the nozzle plate 3 of the seventeenth embodiment are denoted by the same reference numerals as those of the components of the nozzle plate 3 of the seventeenth embodiment, and overlapped description with those of the nozzle plate 3 of the seventeenth embodiment will be omitted.

The nozzle plate 3 of the present embodiment illustrated in FIG. 23 is characterized in that a V-shaped interference body 16*a* is located to be closer to an interference body 16 to reduce an opening surface area of an orifice 8 compared with the nozzle plate 3 of the seventeenth embodiment. In the nozzle plate 3 of the present embodiment, a distal end of a V-shaped corner portion 92 is located radially inward of an outlet-side opening portion 15 of a nozzle hole 7.

With the nozzle plate 3 of the present embodiment, the same advantageous effects as those of the nozzle plate 3 of the seventeenth embodiment are achieved as a matter of course, and the thickness of a liquid film of fuel passing through the orifice 8 can be reduced as a whole, so that an improvement of the degree of atomization of fluid injected from the orifice 8 is achieved further effectively.

Nineteenth Embodiment

Figure 24A:
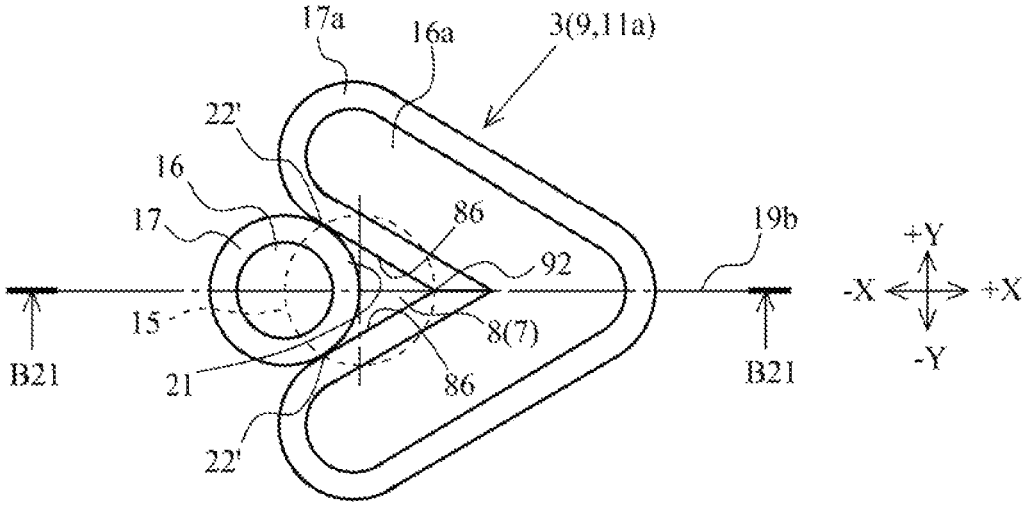
FIG. 24 illustrates a nozzle plate according to a nineteenth embodiment.
Figure 24B:
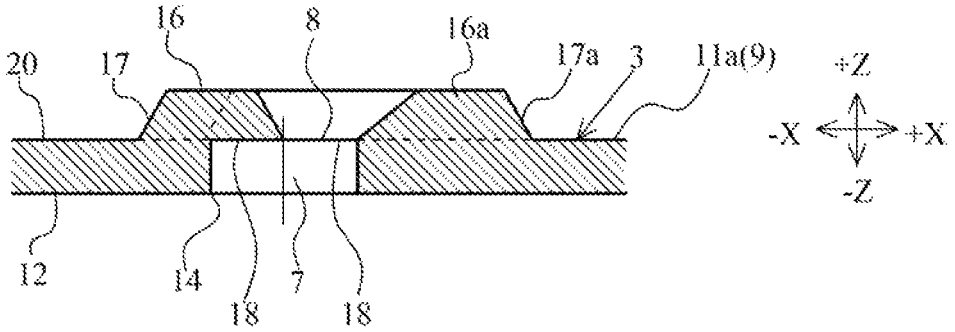

FIG. 24 illustrates a nozzle plate 3 according to a nineteenth embodiment of the present invention, and illustrates a modification of the nozzle plate 3 according to the seventeenth embodiment. FIG. 24(*a*) is a plan view of part of the nozzle plate 3 and FIG. 24(*b*) is a cross-sectional view of part of the nozzle plate 3 taken along line B21-B21 in FIG. 24(*a*). In the nozzle plate 3 of the present embodiment illustrated in FIG. 24, components common to the nozzle plate 3 of the seventeenth embodiment are denoted by the same reference numerals as those of the components of the nozzle plate 3 of the seventeenth embodiment, and overlapped description with those of the nozzle plate 3 of the seventeenth embodiment will be omitted.

In the nozzle plate 3 of the present embodiment illustrated in FIG. 24, an opening angle of the pair of linear outer edge portions 86, 86 of the V-shaped interference body 16*a* intersecting in the V-shape (an angle of intersection between the pair of linear outer edge portions 86, 86) is formed into an acute angle, and the pair of linear outer edge portions 86, 86 of the V-shaped interference body 16*a* intersecting in the V-shape are brought into contact with the arcuate outer edge portion 21 of the interference body 16 compared with the nozzle plate 3 of the seventeenth embodiment. The corner portions 22' formed at a contact portion between linear outer edge portions 86 of the V-shaped interference body 16*a* and the arcuate outer edge portion 21 of the interference body 16 have a substantially crescent moon shaped sharply pointed shape without roundness in plan view. Therefore, end portions of a liquid film of fuel passing through the orifices 8 have a shape for ease of atomization by friction with air. The V-shaped corner portion 92 of the V-shaped interference body 16*a* has a sharply pointed shape without roundness, and thus the end portions of liquid films of fuel passing through the orifice 8 have a shape easily atomized by friction with air. Therefore, the nozzle plate 3 of the present embodiment can further improve the degree of atomization of the fuel injected from the orifice 8 compared with the nozzle plate of the related art.

Twentieth Embodiment

Figure 25A:
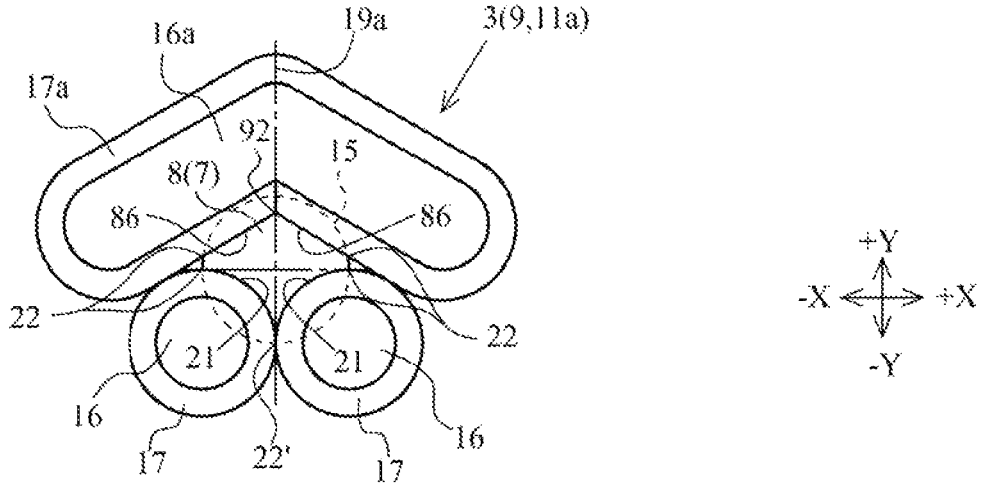
FIG. 25 illustrates a nozzle plate according to a twentieth embodiment.
Figure 25B:
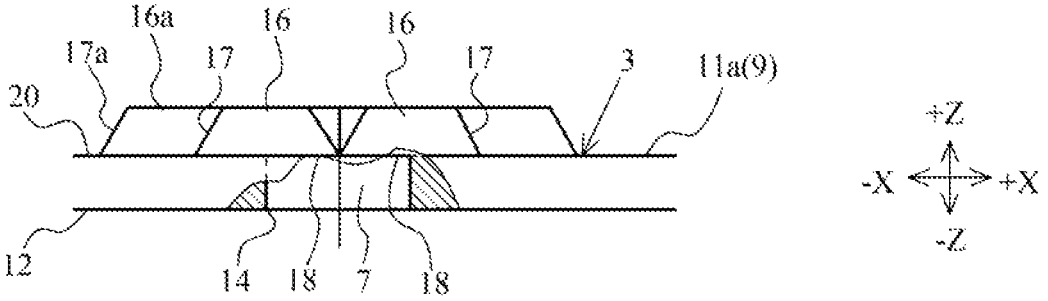

FIG. 25 illustrates a nozzle plate 3 according to a twentieth embodiment of the present invention, and illustrates a modification of the nozzle plate 3 according to the seventeenth embodiment. FIG. 25(*a*) is a partly plan view of the nozzle plate 3 and FIG. 25(*b*) is a side view illustrating part of the nozzle plate 3 partly exploded. In the nozzle plate 3 of the present embodiment illustrated in FIG. 25, components common to the nozzle plate 3 of the seventeenth embodiment are denoted by the same reference numerals as those of the components of the nozzle plate 3 of the seventeenth embodiment, and overlapped description with those of the nozzle plate 3 of the seventeenth embodiment will be omitted.

In the nozzle plate 3 of the present embodiment illustrated in FIG. 25, the pair of interference bodies 16, 16 and a V-shaped interference body 16*a* partly occlude the outlet-side opening portion 15 of the nozzle hole 7. The nozzle plate 3 includes the orifice 8 formed by arcuate outer edge portions 21, 21 of the pair of interference bodies 16, 16, the pair of linear outer edge portions 86, 86 of the V-shaped interference body 16*a*, and the outlet-side opening portion 15 of the nozzle hole 7.

In the present embodiment, the pair of interference bodies 16, 16 are in contact with each other on a centerline 19*a* extending along the Y-axis of the nozzle hole 7 and on an opening edge of the outlet-side opening portion 15. The V-shaped interference body 16*a* is formed in such a manner that the pair of linear outer edge portions 86, 86 come into contact with the arcuate outer edge portions 21 of the interference bodies 16 on a radially outside of the nozzle hole 7 and are located in line symmetry with respect to the straight line (centerline) 19*a* extending along the Y-axis of the nozzle hole 7 as an axis of symmetry. A V-shaped corner portion 92 of the V-shaped interference body 16*a* is located radially inside of the opening edge of the outlet-side opening portion 15.

In the nozzle plate 3 of the present embodiment illustrated in FIG. 25, corner portions 22 formed by the arcuate outer edge portions 21 of the interference bodies 16 and the outlet-side opening portion 15 of the nozzle hole 7 have a sharply pointed shape without roundness, and corner portions 22 formed by the linear outer edge portions 86 of the V-shaped interference body 16*a* and the outlet-side opening portion 15 of the nozzle hole 7 have a sharply pointed shape without roundness. A corner portion 22' formed by contact between the arcuate outer edge portions 21, 21 of the pair of interference bodies 16, 16 has a sharply pointed shape without roundness. The V-shaped corner portion 92 of the V-shaped interference body 16*a* has a sharply pointed shape without roundness.

In the nozzle plate 3 of the present embodiment as described above, the pair of interference bodies 16, 16 and a V-shaped interference body 16*a* partly occlude the outlet-side opening portion 15 of the nozzle hole 7, so that part of fuel passing through the nozzle hole 7 collides with the fuel colliding surfaces 18 of the pair of interference bodies 16, 16 and the V-shaped interference body 16*a*, and thus a flowing direction is rapidly changed, and part of the fuel flow whereof the flowing direction is rapidly changed and the fuel flow proceeding straight forward in the nozzle hole 7 collide with each other to make the fuel flow passing through the nozzle hole 7 and the orifice 8 turbulent. In addition, since the nozzle plate 3 of the present embodiment includes the six corner portions (22, 22', 92) of the orifice 8 having a sharply pointed shape without roundness, and thus end portions of the liquid film of fuel passing through the orifice 8 are likely to be atomized by friction with air. Therefore, the nozzle plate 3 of the present embodiment can further improve the degree of atomization of the fuel injected from the orifices 8 compared with the nozzle plate of the related art.

Twenty-First Embodiment

Figure 26A:
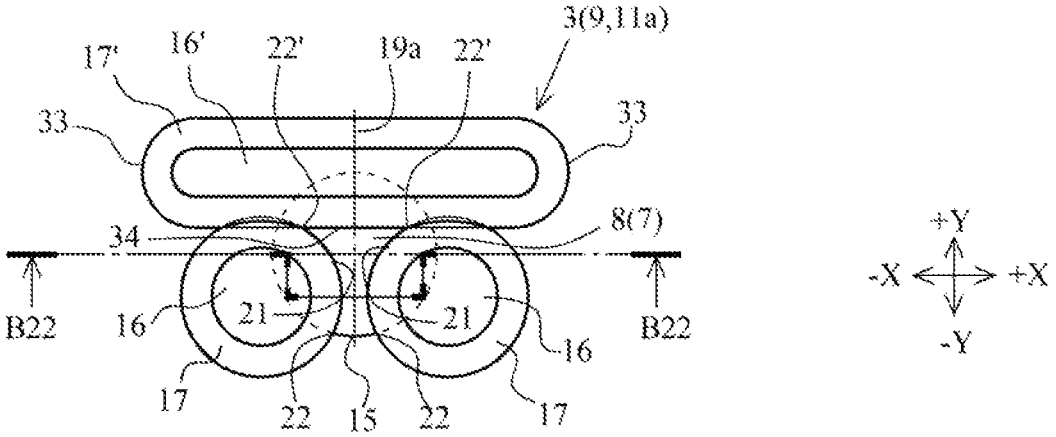
FIG. 26 illustrates a nozzle plate according to a twenty-first embodiment.
Figure 26B:
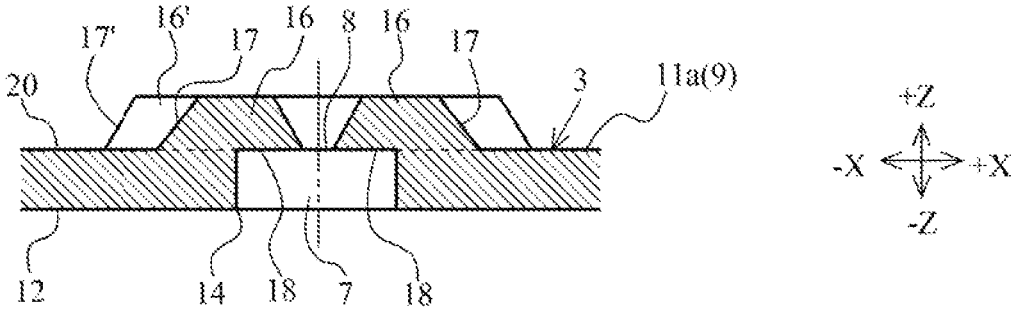

FIG. 26 illustrates a nozzle plate 3 according to a twenty-first embodiment of the present invention. FIG. 26(*a*) is a plan view of part of the nozzle plate 3 and FIG. 26(*b*) is a cross-sectional view of part of the nozzle plate 3 taken along line B22-B22 in FIG. 26(*a*). In the nozzle plate 3 of the present embodiment illustrated in FIG. 26, components common to the nozzle plates 3 of the embodiments described above are denoted by the same reference numerals as those of the components of the nozzle plates 3 of the embodiments described above, and overlapped description with those of the nozzle plates 3 of the embodiments described above will be omitted.

As illustrated in FIG. 26, in the nozzle plate 3 of the present embodiment, a linear outer edge portion 34 of an interference body 16' is butted with arcuate outer edge portions 21, 21 of a pair of interference bodies 16, 16, and a pair of interference bodies 16, 16 and the interference body 16' partly occlude a circular outlet-side opening portion 15 of a nozzle hole 7. The nozzle plate 3 includes the orifice 8 formed by the arcuate outer edge portions 21, 21 of the pair of interference bodies 16, 16, the linear outer edge portions 34 of the interference body 16', and the outlet-side opening portion 15 of the nozzle hole 7.

As illustrated in FIG. 26, in the nozzle plate 3 of the present embodiment, corner portions 22' formed by the arcuate outer edge portions 21, 21 of the pair of interference bodies 16, 16 and the linear outer edge portion 34 of the interference body 16' have a sharply pointed shape without roundness, and thus the end portions of liquid films of fuel passing through the orifices 8 have a shape being likely to be atomized by friction with air. The corner portions 22 formed by the arcuate outer edge portions 21, 21 of the interference bodies 16, 16 and the circular outlet-side opening portion 15 of the nozzle hole 7 have a sharply pointed shape without roundness, and thus the end portions of liquid films of fuel passing through the orifices 8 have a shape being likely to be atomized by friction with air.

As illustrated in FIG. 26, in the nozzle plate 3 of the present embodiment, the pair of interference bodies 16, 16 and the interference body 16' partly occlude the circular outlet-side opening portion 15 of the nozzle hole 7, part of fuel passing through the nozzle hole 7 collides with fuel colliding surfaces 18, 18 of the pair of interference bodies 16, 16 and the interference body 16', and thus a flowing direction is rapidly changed, so that the fuel flow whereof the flowing direction is rapidly changed and the fuel flow proceeding straight forward in the nozzle hole 7 collide with each other to make the fuel flow passing through the nozzle hole 7 and the orifice 8 turbulent. In addition, since the nozzle plate 3 of the present embodiment includes the corner portions 22, 22' of the orifice 8 having a sharply pointed shape without roundness, the end portions of the liquid film of fuel passing through the orifice 8 are easily atomized by friction with air. Therefore, the nozzle plate 3 of the present embodiment can further improve the degree of atomization of the fuel injected from the orifices 8 compared with the nozzle plate of the related art.

Twenty-Second Embodiment

Figure 27A:
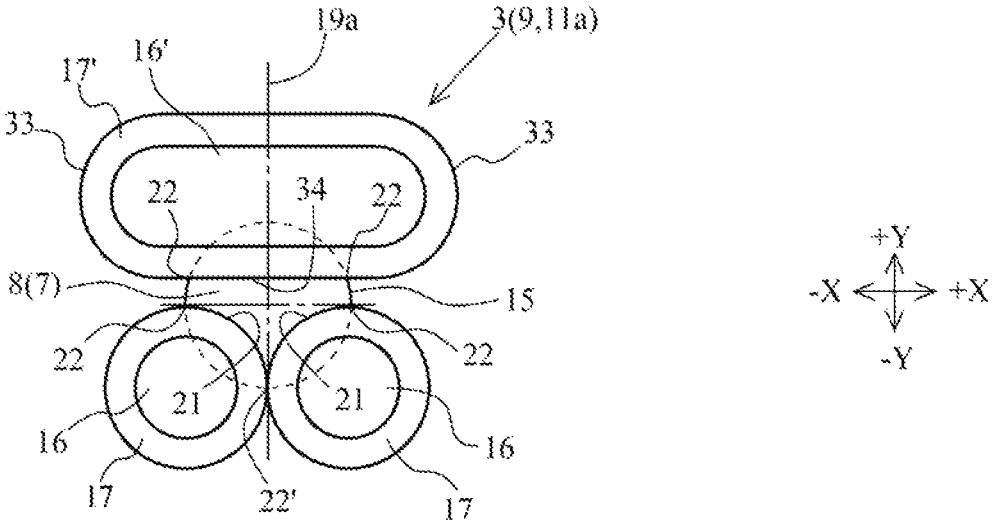
FIG. 27 illustrates a nozzle plate according to a twenty-second embodiment.
Figure 27B:
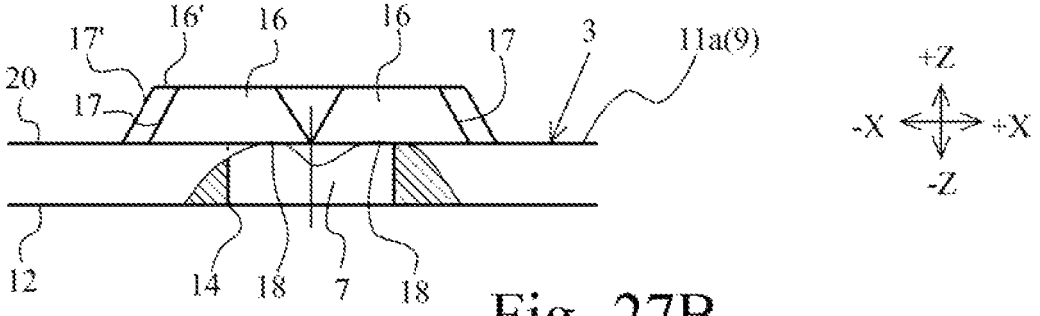

FIG. 27 illustrates a nozzle plate 3 according to a twenty-second embodiment of the present invention. FIG. 27(*a*) is a plan view of part of the nozzle plate 3 and FIG. 27(*b*) is a side view of part of the nozzle plate 3. In the nozzle plate 3 of the present embodiment illustrated in FIG. 27, components common to the nozzle plates 3 of the embodiments described above are denoted by the same reference numerals as those of the components of the nozzle plates 3 of the embodiments described above, and overlapped description with those of the nozzle plates 3 of the embodiments described above will be omitted.

As illustrated in FIG. 27, in the nozzle plate 3 of the present embodiment, arcuate outer edge portions 21, 21 of a pair of interference bodies 16, 16 are butted with each other, and the pair of interference bodies 16, 16 and the interference body 16' partly occlude a circular outlet-side opening portion 15 of a nozzle hole 7. The nozzle plate 3 includes an orifice 8 formed by the arcuate outer edge portions 21, 21 of the pair of interference bodies 16, 16, a linear outer edge portion 34 of the interference body 16', and the circular outlet-side opening portion 15 of the nozzle hole 7. In the nozzle plate 3 of the present embodiment, the pair of interference bodies 16, 16 and the interference body 16' are arranged away from each other in the Y-axis direction (the direction in which the straight line 19*a* extends).

As illustrated in FIG. 27, in the nozzle plate 3 of the present embodiment, a corner portion 22' formed at a butting portion of the pair of interference bodies 16, 16 with the arcuate outer edge portions 21, 21 has a sharply pointed shape without roundness, and thus the end portions of liquid films of fuel passing through the orifices 8 have a shape easily atomized by friction with air. The corner portions 22 formed by the arcuate outer edge portions 21, 21 of the pair of interference bodies 16, 16 and a circular outlet-side opening portion 15 of the nozzle hole 7 have a sharply pointed shape without roundness, and thus the end portions of liquid films of fuel passing through the orifices 8 have a shape easily atomized by friction with air. The corner portions 22 formed by the linear outer edge portion 34 of the interference body 16' and the outlet-side opening portion 15 of the nozzle hole 7 have a sharply pointed shape without roundness, and thus the end portions of liquid films of fuel passing through the orifices 8 have a shape easily atomized by friction with air.

As illustrated in FIG. 27, in the nozzle plate 3 of the present embodiment, the pair of interference bodies 16, 16 and the interference body 16' partly occlude the circular outlet-side opening portion 15 of the nozzle hole 7, part of fuel passing through the nozzle hole 7 collides with fuel colliding surfaces 18, 18 of the pair of interference bodies 16, 16 and the interference body 16', and thus a flowing direction is rapidly changed, and the fuel flow whereof the flowing direction is rapidly changed and the fuel flow proceeding straight forward in the nozzle hole 7 collide with each other to make the fuel flow passing through the nozzle hole 7 and the orifice 8 turbulent. In addition, since the nozzle plate 3 of the present embodiment includes the corner portions 22, 22' of the orifice 8 having a sharply pointed shape without roundness, the end portions of the liquid film of fuel passing through the orifice 8 are easily atomized by friction with air. Therefore, the nozzle plate 3 of the present embodiment can further improve the degree of atomization of the fuel injected from the orifices 8 compared with the nozzle plate of the related art.

Twenty-Third Embodiment

Figure 28A:
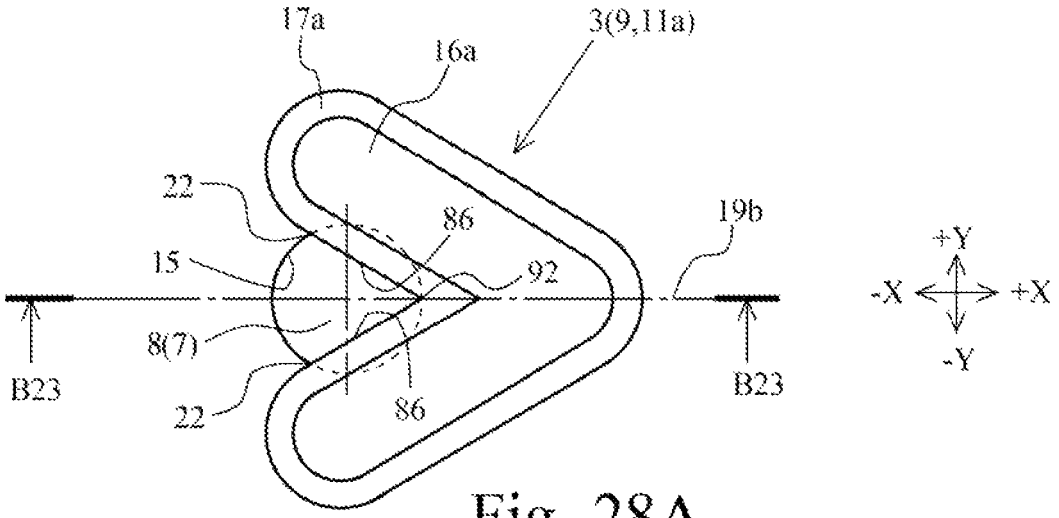
FIG. 28 illustrates a nozzle plate according to a twenty-third embodiment.
Figure 28B:
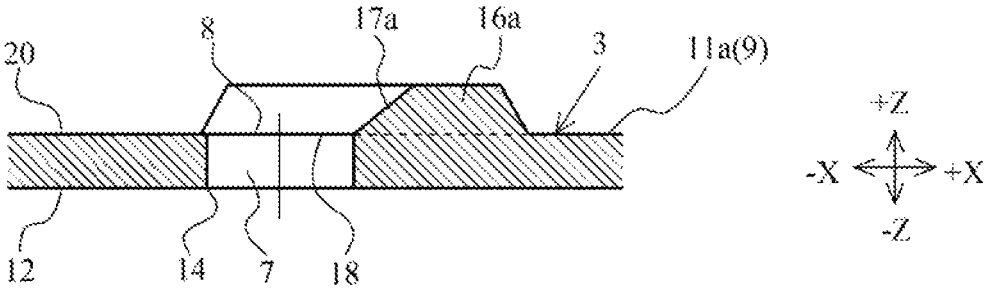

FIG. 28 illustrates a nozzle plate 3 according to a twenty-third embodiment of the present invention, and illustrates a modification of the nozzle plate 3 according to the nineteenth embodiment. FIG. 28(*a*) is a plan view of the nozzle plate 3 and FIG. 28(*b*) is a cross-sectional view of the nozzle plate 3 taken along line B23-B23 in FIG. 28(*a*). In the nozzle plate 3 of the present embodiment illustrated in FIG. 28, components common to the nozzle plate 3 of the nineteenth embodiment are denoted by the same reference numerals as those of the components of the nozzle plate 3 of the nineteenth embodiment, and overlapped description with those of the nozzle plate 3 of the nineteenth embodiment will be omitted.

As illustrated in FIG. 28, the nozzle plate 3 of the present embodiment has a structure in which the interference body 16 of the nozzle plate 3 of the nineteenth embodiment is omitted, and the outlet-side opening portion 15 of the nozzle hole 7 is partly occluded by the V-shaped interference body 16*a*. In the nozzle plate 3 of the present embodiment, the corner portions 22 formed by the pair of linear outer edge portions 86, 86 and the circular outlet-side opening portion 15 of the nozzle hole 7 and a V-shaped corner portion 92 formed at an intersecting portion between the pair of linear outer edge portions 86, 86 have a sharply pointed shape without roundness, and thus the end portions of a liquid film of fuel passing through the orifice 8 have a shape being likely to be atomized by friction with air. In the nozzle plate 3 of the present embodiment, part of fuel passing through the nozzle hole 7 collides with the fuel colliding surface 18 of the V-shaped interference body 16*a*, the flowing direction of fuel that has collided with the fuel colliding surface 18 is rapidly changed, the fuel flow whereof the flowing direction is rapidly changed, and the fuel flow proceeding straight forward in the nozzle hole 7 collide with each other to make the fuel flow passing through the nozzle hole 7 and the orifice 8 turbulent. Therefore, the nozzle plate 3 of the present embodiment can further improve the degree of atomization of the fuel injected from the orifice 8 compared with the nozzle plate of the related art.

Twenty-Fourth Embodiment

Figure 29A:
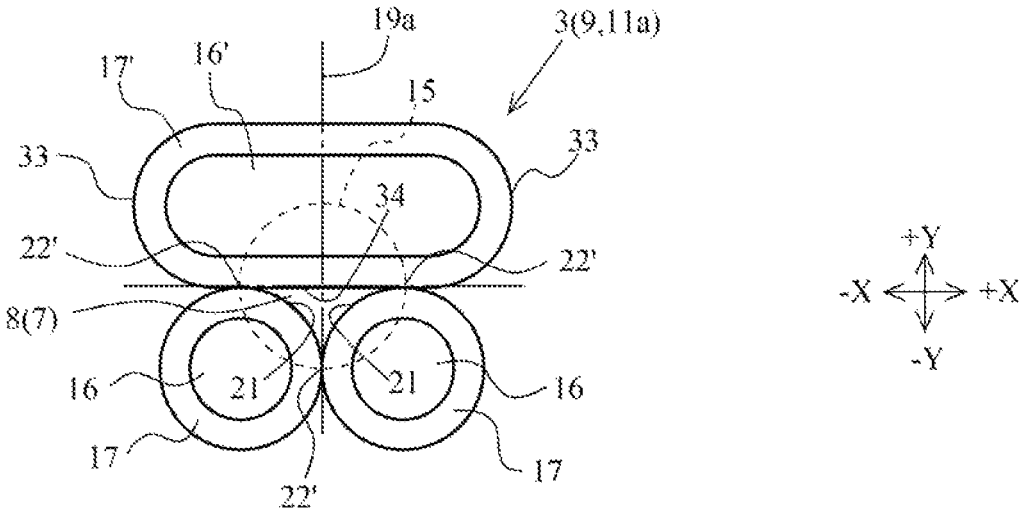
FIG. 29 illustrates a nozzle plate according to a twenty-fourth embodiment.
Figure 29B:
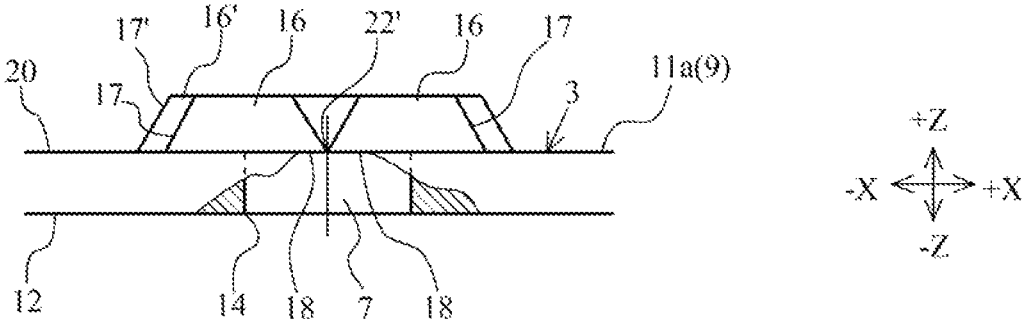

FIG. 29 illustrates a nozzle plate 3 according to a twenty-fourth embodiment of the present invention, and illustrates a modification of the nozzle plate 3 according to the twenty-second embodiment. FIG. 29(*a*) is a plan view of part of the nozzle plate 3, and FIG. 29(*b*) is a side view of the nozzle plate 3 illustrated in a partly exploded manner. In the nozzle plate 3 of the present embodiment illustrated in FIG. 29, components common to the nozzle plate 3 of the twenty-second embodiment are denoted by the same reference numerals as those of the components of the nozzle plate 3 of the twenty-second embodiment, and overlapped description with those of the nozzle plate 3 of the twenty-second embodiment will be omitted.

As illustrated in FIG. 29, in the nozzle plate 3 of the present embodiment, the arcuate outer edge portions 21, 21 of the pair of interference bodies 16, 16 are butted with each other and the arcuate outer edge portions 21, 21 of the pair of interference bodies 16, 16 are butted with the linear outer edge portion 34 of the interference body 16', and the pair of interference bodies 16, 16 and the interference body 16' partly occlude the circular outlet-side opening portion 15 of the nozzle hole 7. The nozzle plate 3 includes the orifice 8 formed by the arcuate outer edge portions 21, 21 of the pair of interference bodies 16, 16 and the linear outer edge portion 34 of the interference body 16'.

As illustrated in FIG. 29, in the nozzle plate 3 of the present embodiment, corner portions 22' formed at butting portions between the pair of interference bodies 16, 16 and the arcuate outer edge portions 21, 21 have a sharply pointed shape without roundness, and thus the end portions of liquid films of fuel passing through the orifice 8 have a shape easily atomized by friction with air. Corner portions 22', 22' formed at butting portions between the arcuate outer edge portions 21, 21 of the pair of interference bodies 16, 16 and the linear outer edge portion 34 of the interference body 16' have a sharply pointed shape without roundness, and thus the end portions of liquid films of fuel passing through the orifices 8 have a shape easily atomized by friction with air.

As illustrated in FIG. 29, in the nozzle plate 3 of the present embodiment, the pair of interference bodies 16, 16 and the interference body 16' partly occlude the circular outlet-side opening portion 15 of the nozzle hole 7, part of fuel passing through the nozzle hole 7 collides with fuel colliding surfaces 18, 18 of the pair of interference bodies 16, 16 and the interference body 16', and thus a flowing direction is rapidly changed, and the fuel flow whereof the flowing direction is rapidly changed and the fuel flow proceeding straight forward in the nozzle hole 7 collide with each other to make the fuel flow passing through the nozzle hole 7 and the orifice 8 turbulent. In addition, since the nozzle plate 3 of the present embodiment includes the corner portions 22' of the orifice 8 having a sharply pointed shape without roundness, and thus end portions of the liquid film of fuel passing through the orifice 8 are likely to be atomized by friction with air. Therefore, the nozzle plate 3 of the present embodiment can further improve the degree of atomization of the fuel injected from the orifice 8 compared with the nozzle plate of the related art.

Twenty-Fifth Embodiment

Figure 30A:
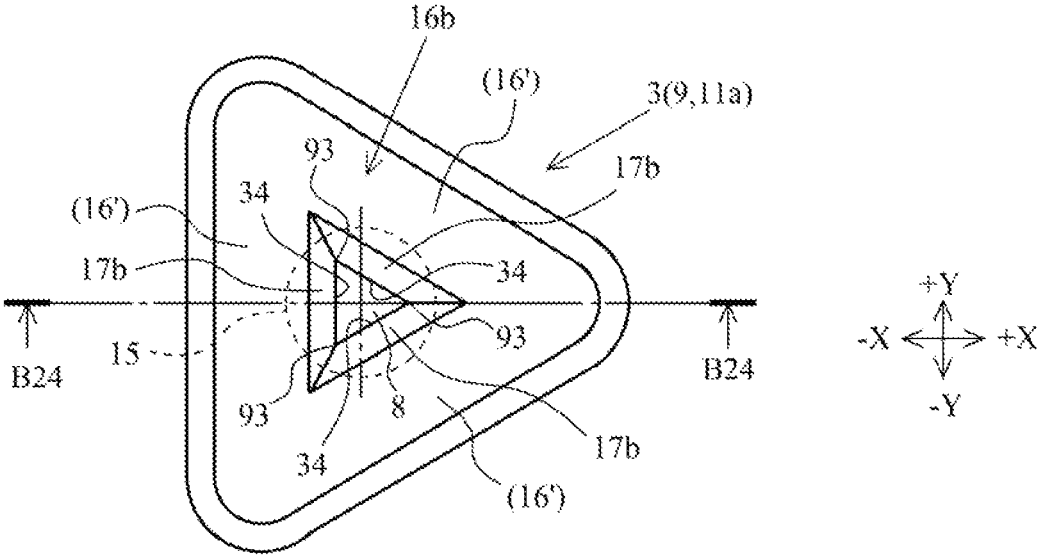
FIG. 30 illustrates a nozzle plate according to a twenty-fifth embodiment.
Figure 30B:
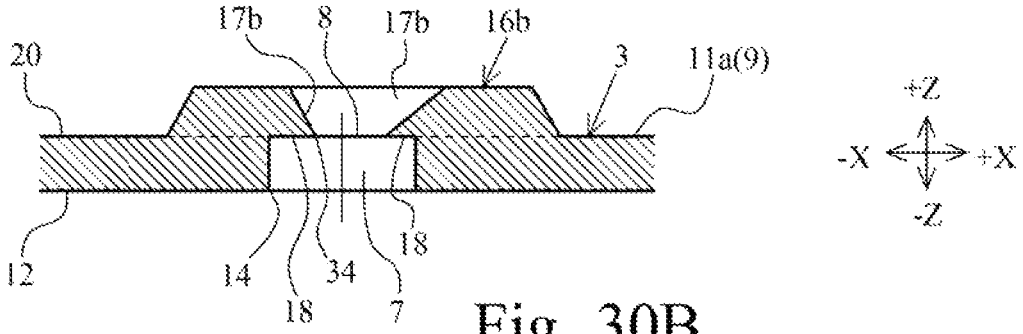
Figure 31D:
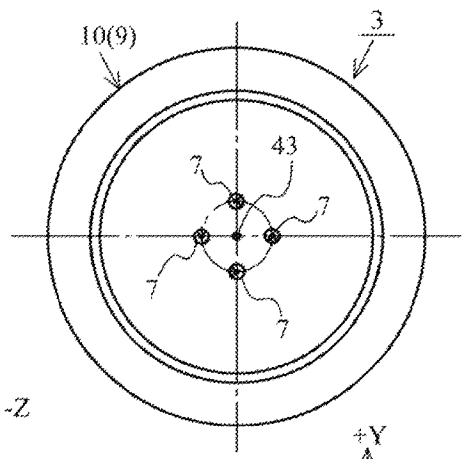
FIG. 31 illustrates a nozzle plate according to a twenty-sixth embodiment.
Figure 31B:
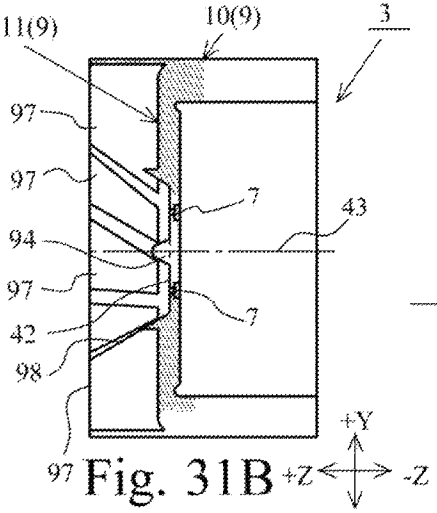
Figure 31C:
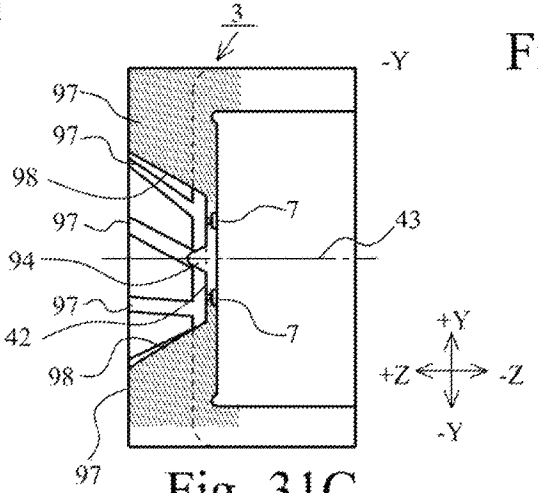
Figure 31A:
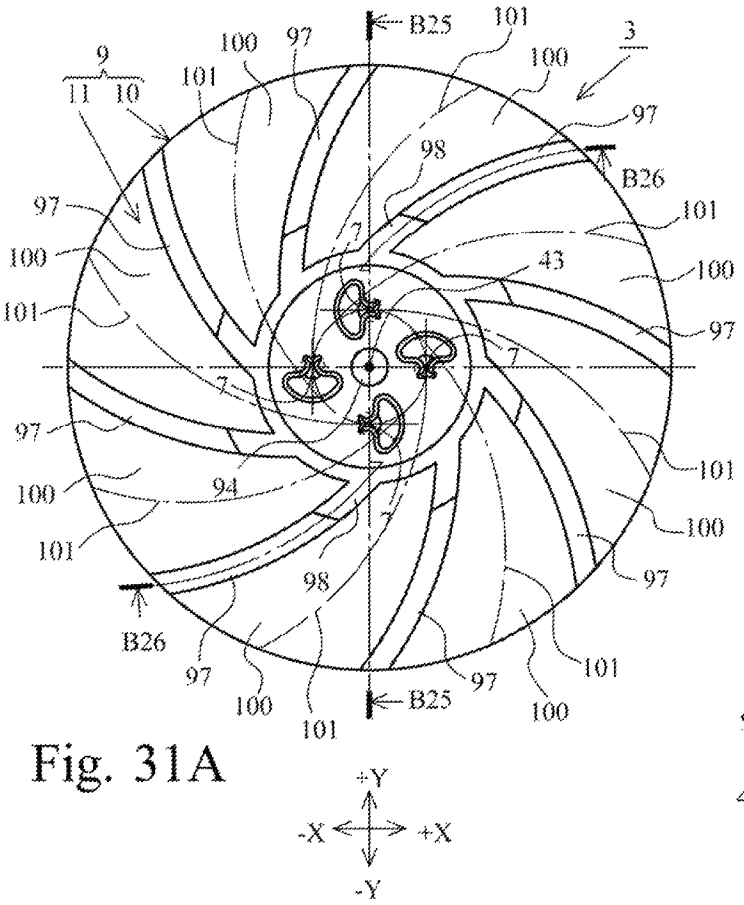

FIG. 30 illustrates a nozzle plate 3 according to a twenty-fifth embodiment of the present invention. FIG. 30(*a*) is a plan view of part of the nozzle plate 3 and FIG. 30(*b*) is a cross-sectional view of the nozzle plate 3 taken along line B24-B24 in FIG. 30(*a*). In the nozzle plate 3 of the present embodiment illustrated in FIG. 30, components common to the nozzle plates 3 of the embodiments described above are denoted by the same reference numerals as those of the components of the nozzle plates 3 of the embodiments described above, and overlapped description with those of the nozzle plates 3 of the embodiments described above will be omitted.

As illustrated in FIG. 30, in the nozzle plate 3 of the present embodiment, the circular outlet-side opening portion 15 of the nozzle hole 7 is partly occluded by a substantially triangle-shaped interference body 16*b* provided with a triangle-shaped orifice 8. The interference body 16*b* has a shape that the interference bodies 16' are combined and integrated into a triangular shape, and has a shape such that an outer edge of the triangle-shaped orifice 8 is framed by linear outer edge portions 34 of the interference body 16'. Corner portions of the orifice 8 at three positions where the linear outer edge portions 34, 34 intersect have a pointed V-shape without roundness, and end portions of the liquid film of fuel passing through the orifice 8 are likely to be atomized by friction with air. In the interference body 16*b*, side surfaces 17*b* which frame the orifice 8 are formed so as to intersect with the fuel colliding surface 18 at an acute angle.

As illustrated in FIG. 30, in the nozzle plate 3 of the present embodiment, the interference body 16*b* partly occludes the circular outlet-side opening portion 15 of the nozzle hole 7, part of fuel passing through the nozzle hole 7 collides with the fuel colliding surface 18 of the interference body 16*b* and hence the flowing direction is rapidly changed, and the fuel flow whereof the flowing direction is rapidly changed and the fuel flow proceeding straight forward in the nozzle hole 7 collide with each other to make the fuel flow passing through the nozzle hole 7 and the orifice 8 turbulent. In addition, as described above, corner portions of the orifice 8 having a triangle shape have a pointed V-shape without roundness, and end portions of the liquid film of fuel passing through the orifice 8 are easily atomized by friction with air. Therefore, the nozzle plate 3 of the present embodiment can further improve the degree of atomization of the fuel injected from the orifices 8 compared with the nozzle plate of the related art.

Twenty-Sixth Embodiment

Figure 32A:
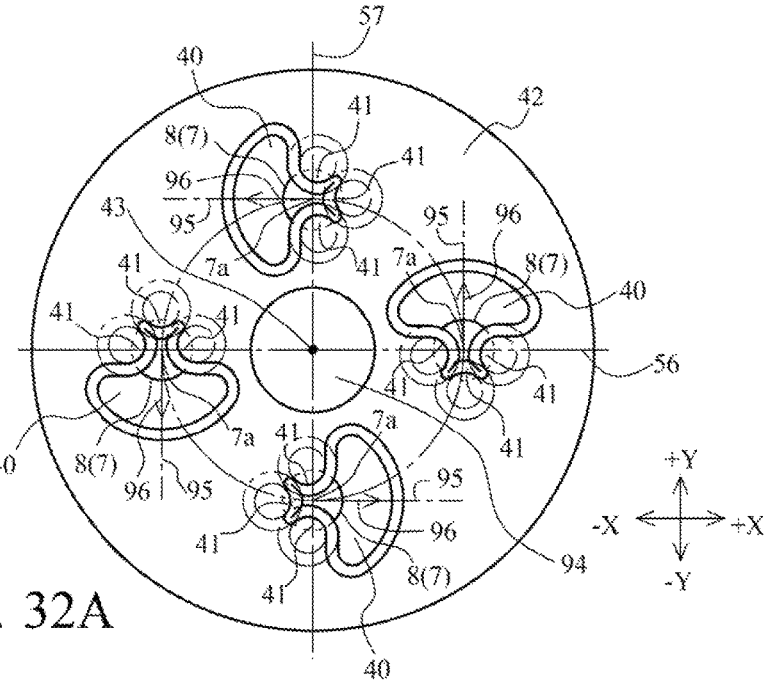
FIG. 32 illustrates a nozzle plate according to the twenty-sixth embodiment.
Figure 32B:
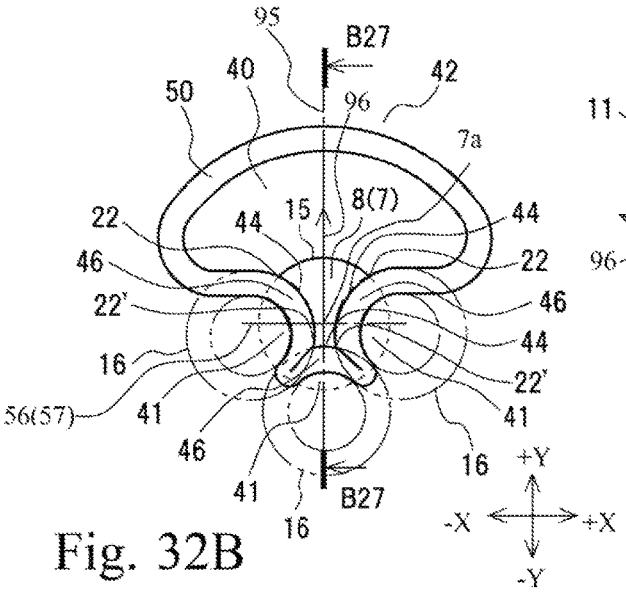
Figure 32C:
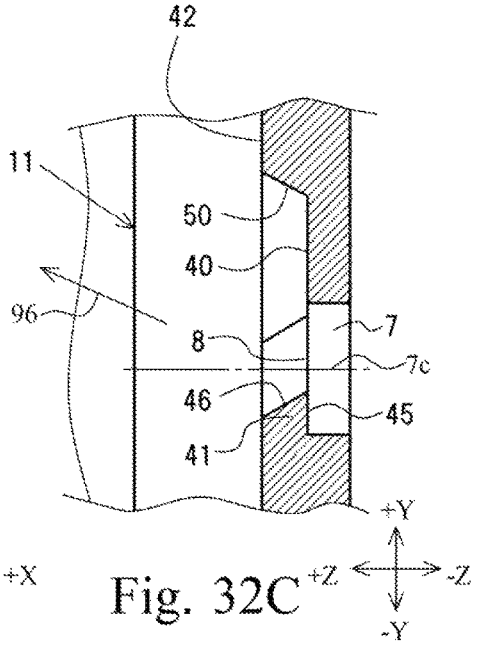

FIG. 31 and FIG. 32 illustrate a nozzle plate 3 according to a twenty-sixth embodiment of the present invention. FIG. 31(*a*) is a front view of the nozzle plate 3 of the present embodiment, FIG. 31(*b*) is a cross-sectional view of the nozzle plate 3 taken along line B25-B25 in FIG. 31(*a*), FIG. 31(*c*) is a cross-sectional view of the nozzle plate 3 taken along line B26-B26 in FIG. 31(*a*), and FIG. 31(*d*) is a back view of the nozzle plate 3 of the present embodiment. FIG. 32(*a*) is an enlarged view of part (center portion) of the nozzle plate 3 illustrated in FIG. 31(*a*), FIG. 32(*b*) is a partially enlarged view of the nozzle plate 3 of a nozzle hole 7 and the vicinity thereof, and FIG. 32(*c*) is an enlarged cross-sectional view taken along line B27-B27 in FIG. 32(*b*).

As illustrated in these drawings, in the nozzle plate 3 of the present embodiment, a nozzle plate body 9 includes a cylindrical wall portion 10 fitted to a distal end side of the valve body 5 and a bottom wall portion 11 formed so as to occlude one end side of the cylindrical wall portion 10 (see FIG. 2). The bottom wall portion 11 includes nozzle hole plate portions 40 having the nozzle holes 7 opened therein, and an interference body plate portion 42 provided with interference bodies 41 formed therein. The interference body plate portion 42 is provided with a truncated conical-shaped projection 94 rounded at a distal end thereof at a center (the position matching the center axis 43) of the bottom wall portion 11, and is formed by counterboring the bottom wall portion 11 around the truncated conical-shaped projection 94 into a disc shape. The nozzle hole plate portion 40 has a shape formed by partly counterboring the interference body plate portion 42 in the periphery of the nozzle hole 7, and is formed to be thinner than the interference body plate portion 42. The bottom wall portion 11 includes the four nozzle holes 7 at four positions equidistantly around the center axis 43 so that parts of the nozzle holes 7 penetrate from a front to a rear of the nozzle hole plate portion 40 (so as to open to the front and the rear). Each of the nozzle holes 7 is formed so that a center 7*a* of the nozzle hole is located on centerlines 56, 57 (the straight line 56 passing through the center axis 43 and parallel to the X-axis and the straight line 57 passing through the center axis 43 and parallel to the Y-axis) of the bottom wall portion 11 as illustrated in FIG. 32(*a*).

As illustrated in FIGS. 32(*a*) and (*b*), the interference body plate portion 42 of the bottom wall portion 11 is provided with three interference bodies 41 which occlude parts of the nozzle hole 7 per one nozzle hole 7. The interference bodies 41 at these three positions are configured to form an orifice 8 having a line-symmetrical shape with respect to a straight line 95 orthogonal to the centerline 56 (57) which passes through the center 7*a* of the nozzle hole, so that a central direction 96 of spray injected from the orifice 8 is inclined obliquely to the +Y direction side with respect to a center axis 7*c* of the nozzle hole 7, and the central direction 96 of the spray injected from the orifice 8 extends along the straight line 95. The central directions 96 of the spray injected from the orifices 8 at four positions are aligned in counterclockwise about the center axis 43 of the bottom wall portion 11. Consequently, the spray injected form the orifices 8 at four positions generates a counterclockwise swirl flow about the center axis 43 of the bottom wall portion 11.

As illustrated in FIG. 32(*b*) in detail, the three interference bodies 41 formed in the interference body plate portion 42 are similar in shape to the parts of the interference bodies 16 described in the first embodiment, and form the orifice 8 by closing parts of the nozzle hole 7. The corner portions 22 formed by arcuate-shaped outer edge portions 44 of the interference bodies 41 and the outlet-side opening portion 15 of the nozzle hole 7 and the corner portions 22' formed by the interference bodies 41 and the butting portions with the interference bodies 41 have a sharp shape without roundness, and are capable of making end portions of a liquid film of fuel passing through the orifice 8 have a sharply pointed shape for ease of atomization by friction with air. The orifice 8 on the nozzle plate 3 of the present embodiment is similar in shape to the orifice 8 illustrated in FIG. 17(*a*). In description of the nozzle plate 3 of the present embodiment with reference to FIG. 32, the same positions as those in the nozzle plate 3 are denoted by the same reference numerals as the nozzle plate 3 illustrated in FIG. 17(*a*) and description overlapped with the description of the nozzle plate 3 in FIG. 17(*a*) will be omitted as needed.

The three interference bodies 41 formed on the interference body plate portion 42 have fuel colliding surfaces 45 and side surfaces (inclined surfaces) 46 similar to the interference bodies 41 illustrated in FIG. 17 described in the thirteenth embodiment, and the similar advantageous effects to the advantageous effects achieved by the fuel colliding surfaces 45 and the side surfaces 46 of the interference bodies 41 described in the thirteenth embodiment are achieved.

The bottom wall portion 11 is formed integrally so that eight blades 97 having the same shape are located equidistantly around the center axis 43 and radially outward of the interference body plate portion 42. The blades 97 have an arcuate shape in plan view, and are formed to have a constant thickness from a radially inner end to a radially outer end. The blades 97 are cut upward from the radially inner end so as not to block spray injected from the orifices 8, and fuel collision avoiding portions 98 are formed so as to secure spaces sufficiently which intercept affecting a spraying state of fuel injected from the orifices 8. The blades 97 are formed to have the same blade height at a portion except for the fuel collision avoiding portion 98 on the radially inner end. A pair of the blades 97, 97 adjacent to each other are reduced in distance as they go from radially outward to inward, and blade grooves 100 between the blades 97 are formed to be reduced in width from radially outward toward the radially inward.

In FIG. 31(*a*), the nozzle hole 7 having a center on the centerline 56 extending in a +X-axis direction from the center axis 43 of the bottom wall portion 11 as a base point is defined as a first nozzle hole 7, and the nozzle holes 7 located at positions shifted by 90° counterclockwise from the first nozzle hole 7 are defined as second to fourth nozzle holes 7. In FIG. 31(*a*), when the center axis 43 of the bottom wall portion 11 is defined as a center of an X-Y coordinate surface of an orthogonal coordinate system, the blade groove 100 having a radially inner end located at a position biased to the +X axis of a first quadrant is defined as a first blade groove 100 and blade grooves 100 located at positions shifted by 45° counterclockwise with respect to the first blade groove 100 are defined as second to eighth blade grooves 100. In FIG. 31(*a*) as described above, a centerline 101 of the first blade groove 100 passes through the center of the second nozzle hole 7. The centerline 101 of the third blade groove 100 passes through the center of the third nozzle hole 7. The centerline 101 of the fifth blade groove 100 passes through the center of the fourth nozzle hole 7. The centerline 101 of the seventh blade groove 100 passes through the center of the first nozzle hole 7. The centerline 101 of the second blade groove 100 passes through the vicinity of the second nozzle hole 7. The centerline 101 of the fourth blade groove 100 passes through the vicinity of the third nozzle hole 7. The centerline 101 of the sixth blade groove 100 passes through the vicinity of the fourth nozzle hole 7. The centerline 101 of the eighth blade groove 100 passes through the vicinity of the first nozzle hole 7. The centerlines 101 of the first to eighth blade grooves 100 are located so as to pass around the center axis 43 of the bottom wall portion 11 (the periphery of the conical-shaped projection 94).

In the nozzle plate 3 configured as described above, when fuel is injected from each of the orifices 8, a pressure at a periphery of an outlet side of the orifice 8 drops (drops to a level lower than the atmospheric pressure), air in the periphery of the nozzle plate 3 is caused to flow (attracted) from the radially outer end side toward the radially inner end side of the first to eight blade grooves 100, and air flows out from the radially inner ends of the first to eight blade grooves 100 to the center of the nozzle hole 7 or to the vicinity of the nozzle hole 7. In other words, the air flows flowed out from the radially inner end of the first to eighth blade grooves 100 each flow around the center axis 43 of the bottom wall portion 11 at a predetermined distance apart (at least by an amount corresponding to the shape of the conical projection 94), and generate the counterclockwise swirl flow about the center axis 43 of the bottom wall portion 11. Atomized droplets in spray (fine particles of fuel) have momentum (counterclockwise speed component), involve air in the periphery thereof and air swirling in the periphery thereof, and provide the involved air with momentum. Air provided with momentum is converted into a helical flow and conveys droplets (fine particles of fuel). The droplets in spray (fine particles of fuel) are conveyed by the helical air flow and are prevented from scattering in the periphery thereof. Therefore, the nozzle plate 3 of the present embodiment achieves a reduction in amount of fuel adhered to the wall surface or the like of an inlet pipe 2, so that usage efficiency of fuel can be improved (see FIG. 1).

In the nozzle plate 3 of the present embodiment, since eight blades 97 are formed integrally with the bottom wall portion 11 equidistantly around the center axis 43 so as to be located radially outward of the interference body plate portion 42, collision of the tool or the like with the nozzle holes 7 and the peripheries thereof is prevented by the blades 97 when fastening the nozzle plate 3 on the valve body 5, and the nozzle holes 7 and an area in the periphery thereof of the bottom wall portion 11 are prevented from becoming damaged by the blades 97. In the nozzle plate 3 of the present embodiment, when fastening a fuel injection device 1 having the nozzle plate 3 fastened on the valve body 5 on the inlet pipe 2 of an engine, the blades 97 are capable of preventing engine components and the like from colliding with the nozzle holes 7 and the periphery thereof, and the nozzle holes 7 and an area in the periphery thereof of the bottom wall portion 11 are prevented from becoming damaged by the blades 97.

Twenty-Seventh Embodiment

Figure 33A:
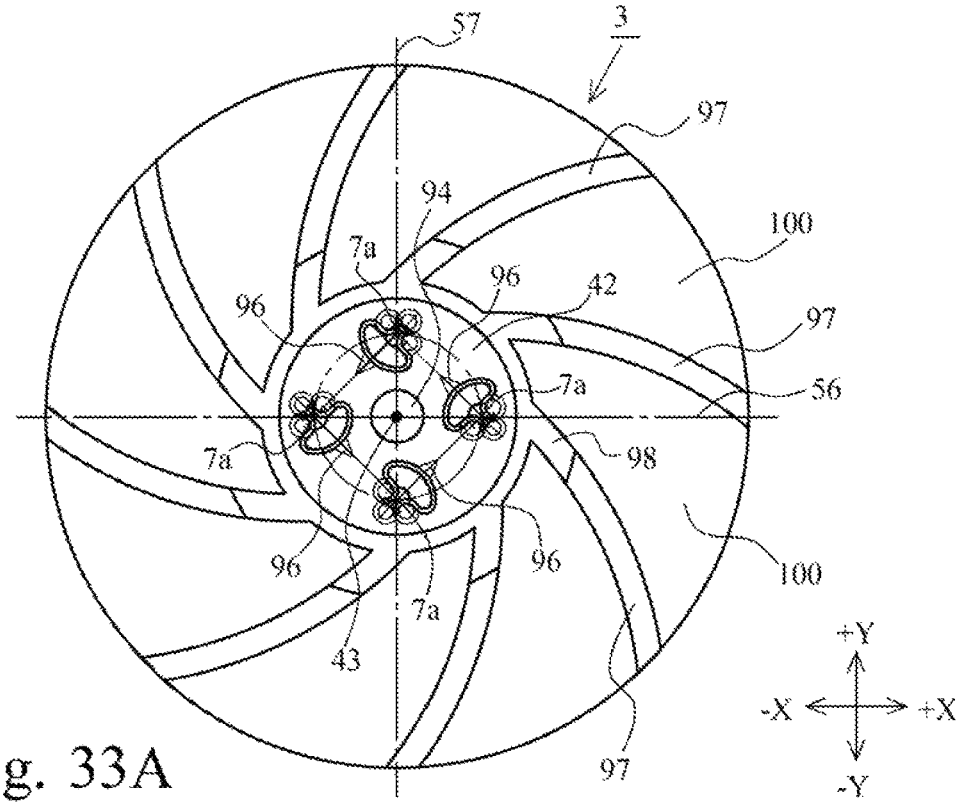
FIG. 33 illustrates a nozzle plate according to a twenty-seventh embodiment.
Figure 33B:
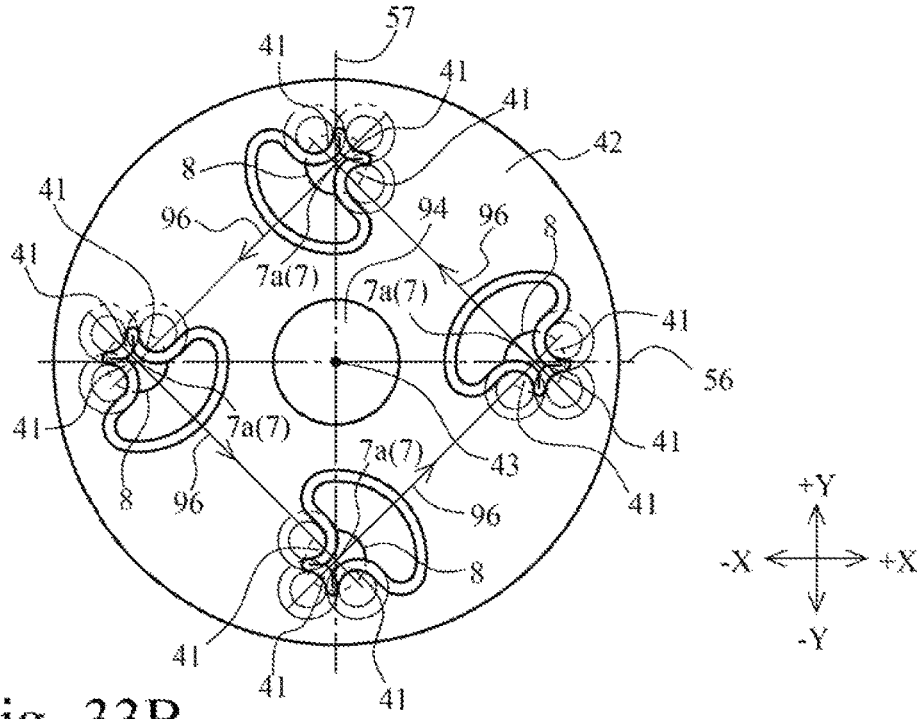

FIG. 33 illustrates a nozzle plate 3 according to a twenty-seventh embodiment of the present invention, and illustrates a modification of the nozzle plate 3 according to the twenty-sixth embodiment. FIG. 33(*a*) is a front view of the nozzle plate 3, which corresponds to FIG. 31(*a*). FIG. 33(*b*) is an enlarged view of a center portion of the nozzle plate 3, which corresponds to FIG. 32(*a*).

The nozzle plate 3 of the present embodiment is provided with the three interference bodies 41 for each nozzle hole 7 so that the central direction 96 of spray injected from each orifice 8 is directed to a center 7*a* of an adjacent (located on the front along the direction of fuel injection) another nozzle hole 7. In other words, the nozzle plate 3 of the present embodiment is formed by rotating the orifices 8 of the nozzle plate 3 according to the twenty-sixth embodiment (see FIG. 31(*a*)) counterclockwise by 45° about centers 7*a* of the nozzle holes 7 as centers of rotation and shifting the nozzle holes 7 and the orifices 8 at four positions of the nozzle plate 3 according to the twenty-sixth embodiment (see FIG. 31(*a*)) radially outward with respect to the center axis 43 of the bottom wall portion 11.

In the nozzle plate 3 of the present embodiment formed in this manner, sprays from adjacent orifices 8 interact significantly with each other, and fine particles of fuel in spray provide air swirled by a plurality of blades 13 with a larger degree of momentum in a swirling direction compared with the nozzle plate 3 according to the twenty-sixth embodiment, so that a further stronger helical air flow is generated.

Twenty-Eighth Embodiment

Figure 34C:
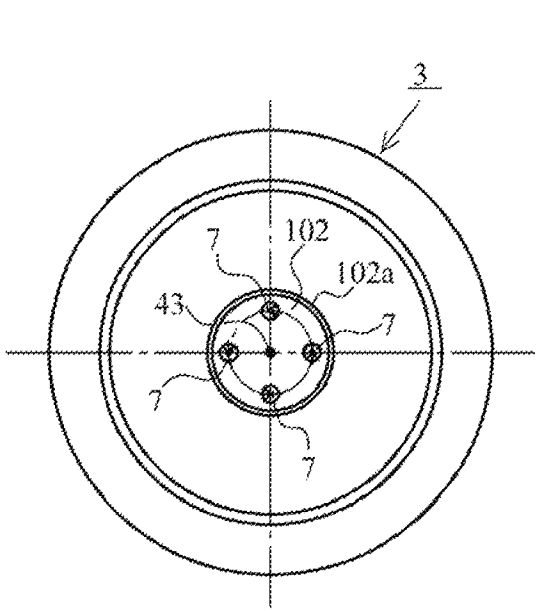
FIG. 34 illustrates a nozzle plate according to a twenty-eighth embodiment.
Figure 34B:
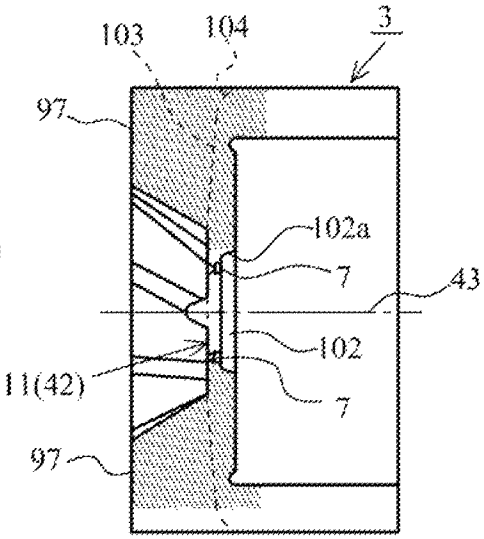
Figure 34A:
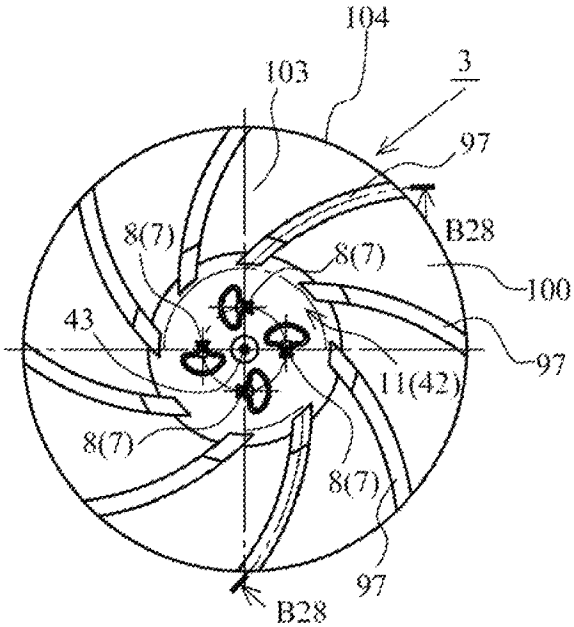

FIG. 34 illustrates a nozzle plate 3 according to a twenty-eighth embodiment of the present invention, and illustrates a modification of the nozzle plate 3 according to the twenty-sixth embodiment. FIG. 34(*a*) is a front view of the nozzle plate 3, which corresponds to FIG. 31(*a*). FIG. 34(*b*) is a cross-sectional view taken along line B28-B28 in FIG. 34(*a*). FIG. 34(*c*) is a back view of the nozzle plate, which corresponds to FIG. 31(*d*).

The nozzle plate 3 of the present embodiment includes a surface of the interference body plate portion 42 formed to be flush with the surface of the bottom wall portion 11, and is different from the nozzle plate 3 according to the twenty-sixth embodiment in which the interference body plate portion 42 is formed by counterboring the bottom wall portion 11 in a disc shape. In the nozzle plate 3 of the present embodiment, a bottomed round hole 102 is formed by being counterbored on the back surface side of the bottom wall portion 11 in order to make the thickness of the nozzle hole plate portion 40 and the thickness of the interference body plate portion 42 to be the same as that of the nozzle plate 3 according to the twenty-sixth embodiment. The bottom surface of the round hole 102 includes four nozzle holes 7 opened therethrough. In addition, a side surface 102*a* of the round hole 102 is located so as to surround the four nozzle holes 7.

In the nozzle plate 3 of the present embodiment, the bottom wall portion 11 is provided with a hollow disc-shaped inclined surface 103 by being formed so as to be scraped off from a position slightly radially outward of the radially inner end of the blades 97 toward a radially outer end. The radially outer end of the hollow disc-shaped inclined surface 103 is rounded by a smooth curved surface 104. Consequently, the nozzle plate 3 of the present embodiment is capable of introducing air in the periphery of the blade grooves 100 widely and into the blade grooves 100 compared with the nozzle plate 3 according to the twenty-sixth embodiment. In addition, the nozzle plate 3 of the present embodiment is formed so that the surface of the interference body plate portion 42 is flush with the surface of the bottom wall portion 11 as described above. Compared with the nozzle plate 3 according to the twenty-sixth embodiment in which the interference body plate portion 42 is formed by counterboring the bottom wall portion 11 in a disc shape, air flowing radially inner end of the blade grooves 100 into the interference plate portion side is not likely to be affected by the depression, so that the speed of air directed from the radially inner end of the blade grooves 100 toward the orifices 8 is increased.

In the nozzle plate 3 of the present embodiment having the configuration as described above, since the speed of air directed from the radially inner end of the blade grooves 100 toward the orifices 8 is high compared with the nozzle plate 3 according to the twenty-sixth embodiment, when fine particles of fuel in spray provide air flowing from the radially inner end of the blade grooves 100 toward the orifices 8 with momentum, a further stronger helical air flow is generated.

Twenty-Ninth Embodiment

Figure 35A:
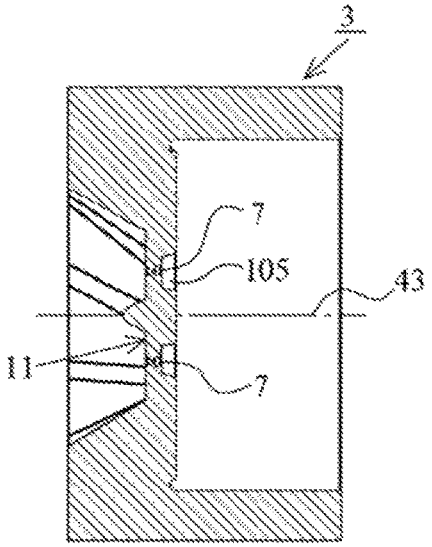
FIG. 35 illustrates a nozzle plate according to a twenty-ninth embodiment.
Figure 35B:
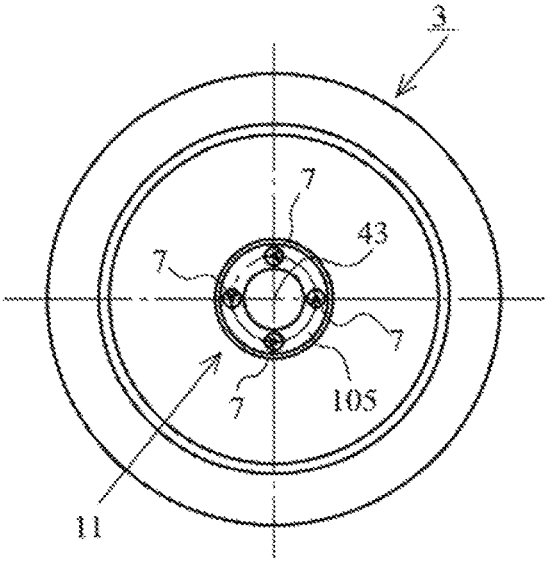

FIG. 35 illustrates a nozzle plate 3 according to a twenty-ninth embodiment of the present invention, and illustrates a modification of the nozzle plate 3 according to the twenty-eighth embodiment. FIG. 35(*a*) is a cross-sectional view of the nozzle plate 3 corresponding to FIG. 34(*b*), and FIG. 35(*b*) is a back view of the nozzle plate 3 corresponding to FIG. 34(*c*).

In the nozzle plate 3 of the present embodiment illustrated in FIG. 35, the round holes 102 formed on the back surface side of the bottom wall portion 11 of the nozzle plate 3 according to the twenty-eighth embodiment are changed into ring-shaped holes 105 to reduce an amount of fuel accumulated in the holes 105 to be smaller than an amount of fuel accumulated in the round hole 102.

Thirtieth Embodiment

Figure 36A:
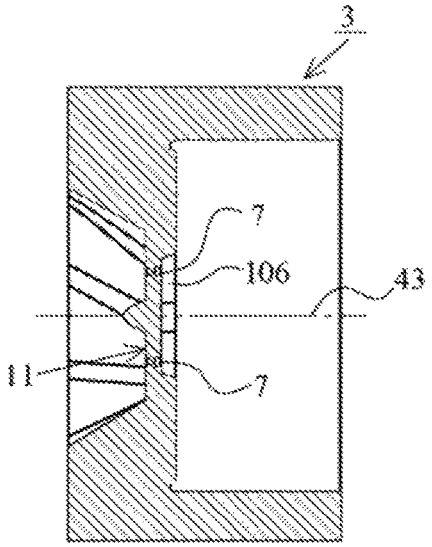
FIG. 36 illustrates a nozzle plate according to a thirtieth embodiment.
Figure 36B:
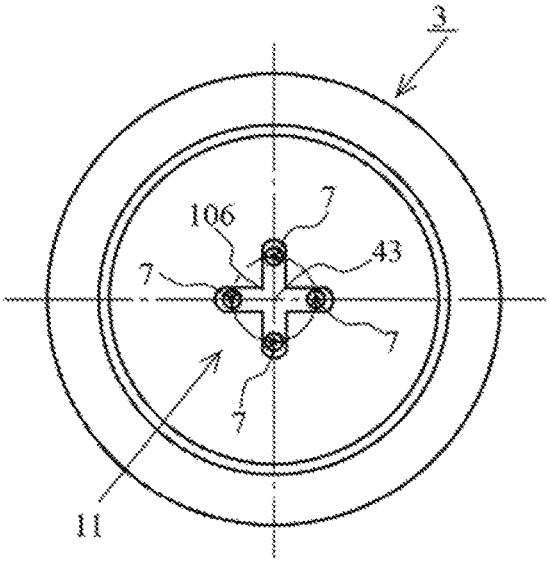

FIG. 36 illustrates a nozzle plate 3 according to a thirteenth embodiment of the present invention, and illustrates a modification of the nozzle plate 3 according to the twenty-eighth embodiment. FIG. 36(*a*) is a cross-sectional view of the nozzle plate 3 corresponding to FIG. 34(*b*), and FIG. 36(*b*) is a back view of the nozzle plate 3 corresponding to FIG. 34(*c*).

In the nozzle plate 3 of the present embodiment illustrated in FIG. 36, the round holes 102 formed on the back surface side of the bottom wall portion 11 of the nozzle plate 3 according to the twenty-eighth embodiment are changed into cross-shaped holes 106 to reduce the amount of fuel accumulated in the holes 106 to be smaller than the amount of fuel accumulated in the round hole 102.

Thirty-first Embodiment

Figure 37A:
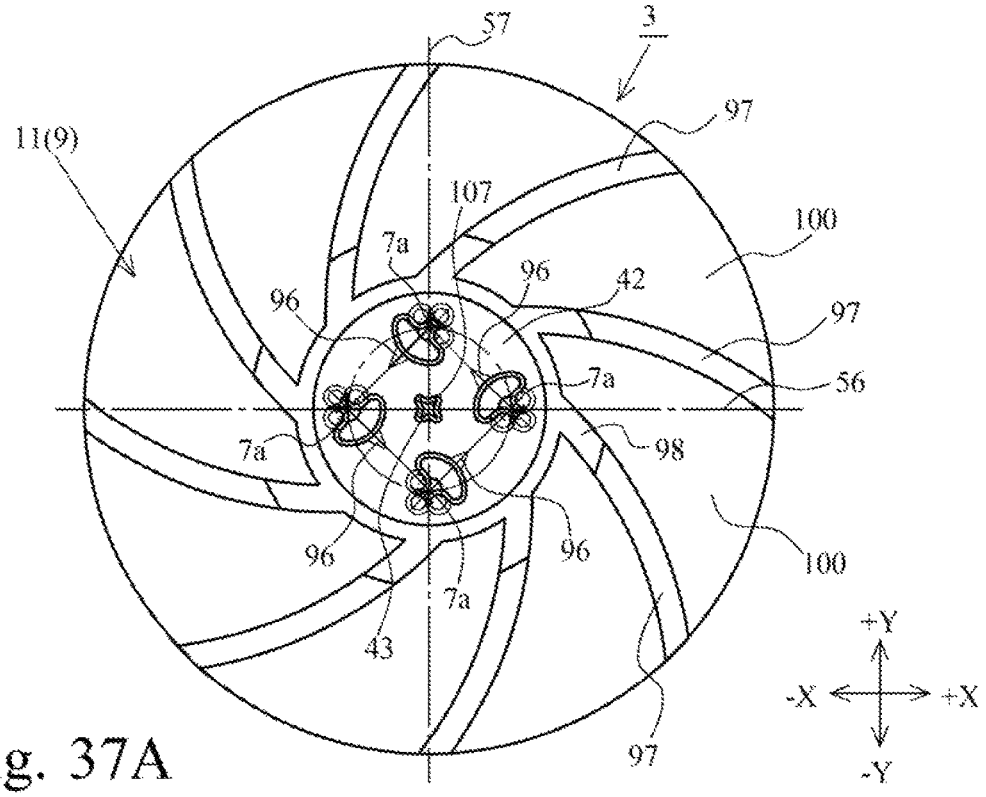
FIG. 37 illustrates a nozzle plate according to a thirty-first embodiment, and illustrates a modified structure of the nozzle plate according to the twenty-seventh embodiment.
Figure 37B:
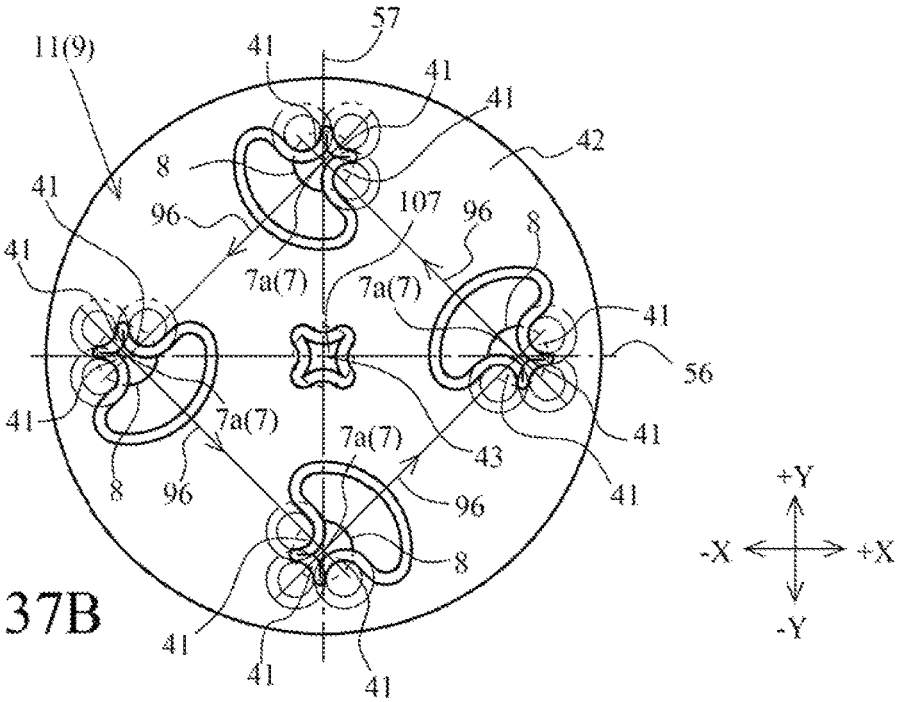
Figure 38A:
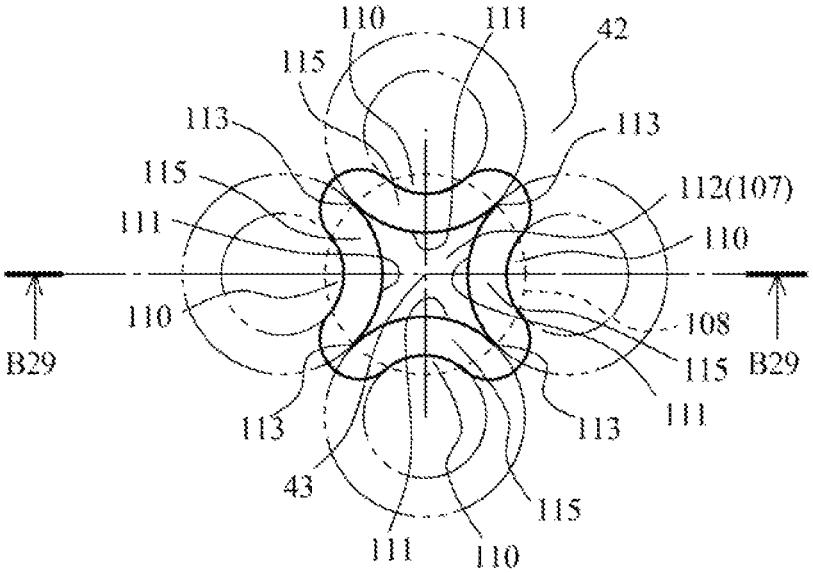
FIG. 38 is a drawing illustrating a center portion of the nozzle plate illustrated in FIG. 37 in an enlarged scale.
Figure 38B:
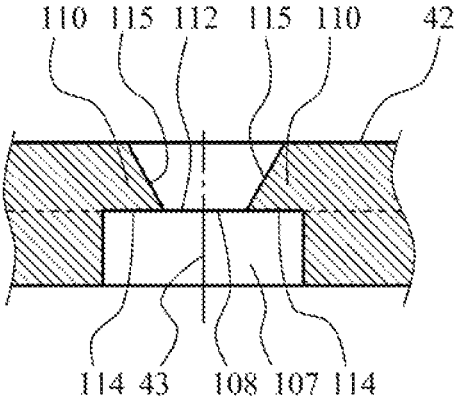
Figure 39A:
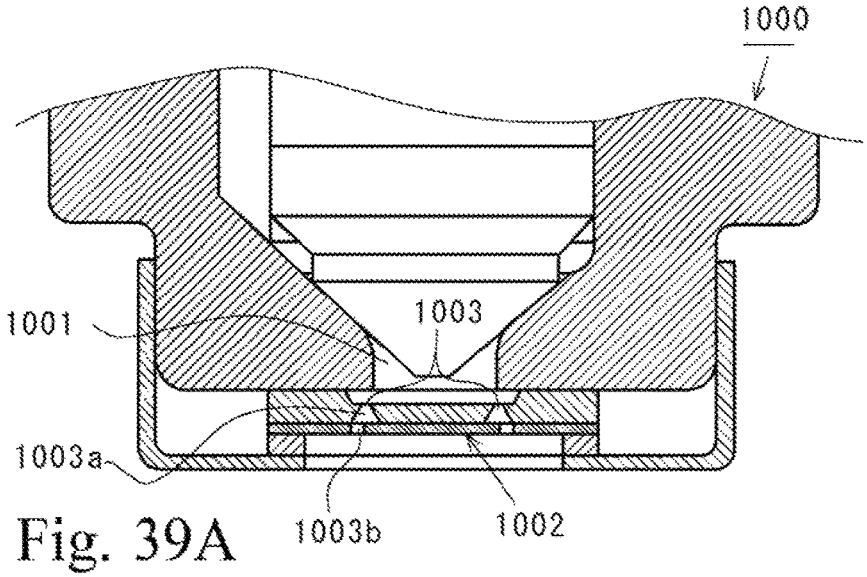
FIG. 39 illustrates a nozzle plate of the related art mounted at a fuel injection port of a fuel injection device.
Figure 39B:
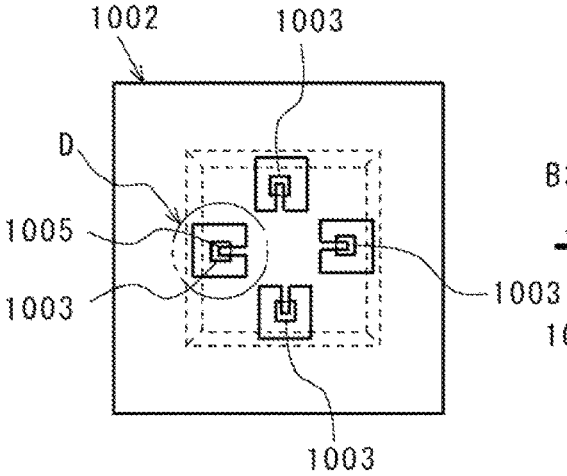
Figure 39C:
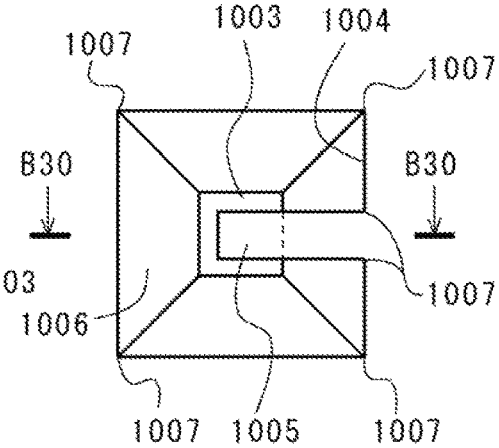
Figure 39D:
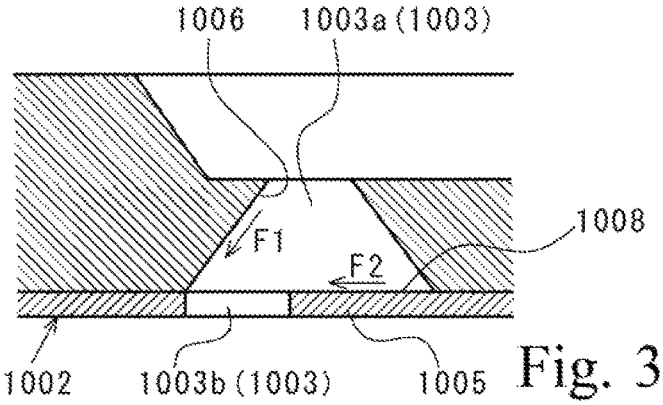

FIG. 37 and FIG. 38 illustrate a nozzle plate 3 according to a thirty-first embodiment of the present invention. FIG. 37 illustrates a structure in which the nozzle plate 3 according to the twenty-seventh embodiment is modified. FIG. 38 is a drawing illustrating a center portion of the nozzle plate 3 illustrated in FIG. 37 in an enlarged scale.

As illustrated in these drawings, the nozzle plate 3 is provided with a center nozzle hole 107 formed to penetrate through the bottom wall portion 11 along the center axis 43 at a center (the position matching the center axis 43) of the bottom wall portion 11. This center nozzle hole 107 is occluded partly at four positions of an outlet-side opening portion 108 on the outer surface side by interference bodies 110. The four interference bodies 110 are protruded at arcuate-shaped outer edge portions 111 radially inward of the center nozzle hole 107 to partly occlude the outlet-side opening portion 108 of the center nozzle hole 107, thereby forming a central orifice 112. The arcuate-shaped outer edge portions 111, 111 of the adjacent interference bodies 110, 110 are in contact with each other on an opening edge of the outlet-side opening portion 108 of the center nozzle hole 107. Corner portions 113 are formed at intersecting portions between the pairs of arcuate-shaped outer edge portions 111, 111. The corner portions 113 are formed equidistantly at four positions at an opening edge of the central orifice 112, and have a sharply pointed shape without roundness. Consequently, the corner portions 113 can make end portions of a liquid film of fuel passing through the central orifice 112 into a sharply pointed shape for ease of atomization by friction with air. Each of the interference bodies 110 has a fuel colliding surface 114 which is a flat surface orthogonal to the center axis 43 of the center nozzle hole 107 and side surfaces (inclined surfaces) 115 cut obliquely upward from the arcuate-shaped outer edge portion 111. The side surfaces 115 of the adjacent interference bodies 110, 110 are connected smoothly into an arcuate shape with the corner portions 113.

In the nozzle plate 3 of the present embodiment as described above, spray generated by fuel being injected from the central orifice 112 at the center of the bottom wall portion 11 is added to spray generating by fuel being injected from the orifices 8 at four positions of the bottom wall portion 11, spray in the periphery is attracted by the spray at the center, and fine particles of fuel in the spray provide air swirled by the plurality of blades 97 with larger momentum in the swirling direction, and a further stronger helical air flow is generated.

The nozzle plate 3 of the present embodiment may be applied to the nozzle plate 3 according to the twenty-sixth embodiment, and may achieve the similar advantageous effects to the nozzle plate 3 according to the twenty-sixth embodiment. The central orifice 112 is not limited to the shape in the present embodiment, and the orifice shape of other embodiments described above may also be applied.

(Other Modifications)

The nozzle plate 3 formed of a synthetic resin material has been exemplified in the first to thirty-first embodiments described above. However, the material is not limited thereto, and a nozzle plate formed of a sintered metal by using a metal injection molding method is also applicable.

In the first to twelfth embodiments described above, a mode in which the pair of nozzle holes 7, 7 and the pair of orifices 8 are formed in the nozzle plate body 9 has been exemplified. However, the present invention is not limited thereto, and a configuration in which a single nozzle hole 7 and a single orifice 8 are formed in the nozzle plate body 9 or a configuration in which a plurality of, namely, three or more nozzle holes 7 and the same number of orifices 8 as the nozzle holes 7 or a larger number of the orifices 8 than the number of the nozzle holes 7 are formed in the nozzle plate body 9 is also applicable.

In the first to twelfth embodiments described above, a mode in which the corner portions 22' are formed at the butting portion P between the arcuate-shaped outer edge portions (21, 33) of the interference bodies 16, 16' has been exemplified. However, a corner portion formed by a substantially triangle shape by butting linear shaped outer edge portions (linear outer edge portions such as chords of an arc instead of the arcuate-shaped outer edge portions) of the interference bodies 16, 16' is also applicable.

In the nozzle plates 3 of the eleventh and twelfth embodiments described above, the nozzle plate 3 has been described as having the configuration provided with four interference bodies 16. However, the present invention is not limited thereto, and a configuration in which the nozzle plate 3 is provided with the three interference bodies is also applicable. In addition, the nozzle plate 3 of the eleventh and twelfth embodiments described above may include four or more interference bodies, for example, five or six interference bodies.

The technologies described in the thirteenth to fifteenth embodiments described above may be applied to the nozzle plate 3 according to the sixteenth to twenty-fifth embodiments.

In the nozzle plate 3 according to the twenty-sixth to thirty-first embodiments described above, a mode in which the nozzle holes 7 are formed at four positions, and double the number of the nozzle holes 7 of the blades 97 (8 blades) are provided has been exemplified. However, the present invention is not limited thereto, and a configuration in which a plurality of (two or more) nozzle holes 7 are provided and double the number of the nozzle holes 7 of the blades 97 are provided is also applicable. In the nozzle plate 3 according to the twenty-sixth to thirtieth embodiments described above, double the number of nozzle holes 7 of the blade grooves 100 are formed. However, the present invention is not limited thereto and as many blade grooves 100 as the nozzle holes 7 may be provided. In the nozzle plate 3 according to the twenty-sixth to thirty-first embodiments described above, double the number of nozzle holes 7 of the blade grooves 100 are formed. However, the invention is not limited thereto and the number of the blade grooves 100 may be a given multiple of the number of the nozzle holes 7.

In the nozzle plate 3 according to the twenty-sixth to thirty-first embodiments described above, the shapes (rightward twisted shape) of the orifices 8 and the blades 97 are determined so that a counterclockwise swirl flow is generated around the center axis 43 of the bottom wall portion 11. However, the present invention is not limited to the nozzle plate 3 according to the twenty-sixth to thirty-first embodiments described above, and a configuration in which the shapes (leftward twisted shape) of the orifices 8 and the blades 97 may be formed so that a clockwise swirl flow is generated around the center axis 43 of the bottom wall portion 11 is also applicable.

The nozzle plates 3 according to the twenty-sixth to thirty-first embodiments described above, the nozzle plate 3 has the blades 97 having an arcuate shape in plan view. However, the present invention is not limited thereto, and the shape of the blades 97 in plan view may be a linear shape.

REFERENCE SIGNS LIST

1 . . . fuel injection device, 3 . . . nozzle plate (nozzle plate for a fuel injection device), 4 . . . fuel injection port, 7 . . . nozzle hole, 8 . . . orifice, 9 . . . nozzle plate body, 15 . . . outer side opening portion, 16, 16', 16*a*, 16*b*, 41, 54 . . . interference body, 17, 17', 17*a*, 17*b*, 46, 61 . . . side surface (inclined surface), 21 . . . circular outer edge portion (arcuate-shaped outer edge portion, outer edge portion), 22, 22', 92, 93 . . . corner portion, 27 . . . cavity, 33 . . . semicircular-shaped outer edge portion (arcuate-shaped outer edge portion, outer edge portion), 34, 86 . . . linear outer edge portions (outer edge portion), 44, 58 . . . arcuate-shaped outer edge portion, P . . . butting portion

The invention claimed is:

1. A nozzle plate for a fuel injection device, the nozzle plate being configured to be mounted at a fuel injection port of the fuel injection device, and the nozzle plate comprising:

a nozzle hole configured to allow passage of fuel injected from the fuel injection port, wherein:

the nozzle hole is formed in a nozzle plate body, and an orifice which is configured to narrow down a fuel flow on an outlet-side opening portion side of the nozzle hole is formed by an outlet-side opening portion, the outlet-side opening portion being on a side where the fuel is to flow out, and the outlet-side opening portion being partly occluded by a plurality of interference bodies, each of the plurality of interference bodies includes an arcuate-shaped outer edge portion configured to form a part of an opening edge of the orifice, the nozzle plate body and the plurality of interference bodies are integrally molded by cooling and solidifying a melted material filled in a cavity, the orifice includes corner portions respectively defined by the arcuate-shaped outer edge portions of the plurality of interference bodies such that each of the corner portions has a pointed shape without roundness at the part of the opening edge of the orifice such that the opening edge of the orifice is noncircular, the nozzle hole is partly occluded at the outlet-side opening portion by the plurality of interference bodies, and the nozzle hole formed in the nozzle plate body has a circular cross section.

2. The nozzle plate according to claim 1, wherein at least one of the corner portions is formed at a butting portion between the arcuate-shaped outer edge portion of a first of the plurality of interference bodies and the arcuate-shaped outer edge portion of a second of the plurality of interference bodies, the first of the plurality of interference bodies being adjacent to the second of the plurality of interference bodies.

3. The nozzle plate according to claim 2, wherein each of the interference bodies includes:

a fuel colliding surface configured to collide with a part of the fuel passing through the nozzle hole, and an inclined surface intersecting the fuel colliding surface at an acute angle, and the nozzle plate is configured to form an air layer between the fuel that has passed through the orifice and the inclined surface.

4. The nozzle plate according to claim 3, wherein:

the nozzle plate body includes a cylindrical wall portion configured to be fitted with a valve body of the fuel injection device including the fuel injection port and a bottom wall portion formed so as to occlude one end side of the cylindrical wall portion, the bottom wall portion includes a nozzle hole plate portion having the nozzle hole formed therein, and an interference plate portion having the interference bodies formed therein, and a shape of the nozzle hole plate portion is formed by partly counterboring the interference plate portion.

5. The nozzle plate according to claim 4, wherein:

the bottom wall portion includes a nozzle guard projection protruding along a direction in which a center axis of the valve body extends on an outer surface thereof at a position surrounding the nozzle hole plate portion, and the nozzle guard projection is an annular member formed on the bottom wall portion so as to surround the nozzle hole plate portion or a plurality of block members formed on the bottom wall portion so as to surround the nozzle hole plate portion, is formed so as to form a gap between a virtual plane and the bottom wall portion when a distal end thereof comes into contact with the virtual plane, and is formed so as not to intercept spray injected from the nozzle hole.

6. The nozzle plate according to claim 2, wherein:

the nozzle plate body includes a cylindrical wall portion configured to be fitted with a valve body of the fuel injection device including the fuel injection port and a bottom wall portion formed so as to occlude one end side of the cylindrical wall portion, the bottom wall portion includes a nozzle hole plate portion having the nozzle hole formed therein, and an interference plate portion having the interference bodies formed therein, and a shape of the nozzle hole plate portion is formed by partly counterboring the interference plate portion.

7. The nozzle plate according to claim 6, wherein:

the bottom wall portion is includes a nozzle guard projection protruding along a direction in which a center axis of the valve body extends on an outer surface thereof at a position surrounding the nozzle hole plate portion, and the nozzle guard projection is an annular member formed on the bottom wall portion so as to surround the nozzle hole plate portion or a plurality of block members formed on the bottom wall portion so as to surround the nozzle hole plate portion, is formed so as to form a gap between a virtual plane and the bottom wall portion when a distal end thereof comes into contact with the virtual plane, and is formed so as not to intercept spray injected from the nozzle hole.

8. The nozzle plate according to claim 1, wherein each of the interference bodies includes:

a fuel colliding surface configured to collide with a part of the fuel passing through the nozzle hole, and an inclined surface intersecting the fuel colliding surface at an acute angle, and the nozzle plate is configured to form an air layer between the fuel that has passed through the orifice and the inclined surface.

9. The nozzle plate according to claim 8, wherein:

the nozzle plate body includes a cylindrical wall portion configured to be fitted with a valve body of the fuel injection device including the fuel injection port and a bottom wall portion formed so as to occlude one end side of the cylindrical wall portion, the bottom wall portion includes a nozzle hole plate portion having the nozzle hole formed therein, and an interference plate portion having the interference bodies formed therein, and a shape of the nozzle hole plate portion is formed by partly counterboring the interference plate portion.

10. The nozzle plate according to claim 9, wherein:

the bottom wall portion includes a nozzle guard projection protruding along a direction in which a center axis of the valve body extends on an outer surface thereof at a position surrounding the nozzle hole plate portion, and the nozzle guard projection is an annular member formed on the bottom wall portion so as to surround the nozzle hole plate portion or a plurality of block members formed on the bottom wall portion so as to surround the nozzle hole plate portion, is formed so as to form a gap between a virtual plane and the bottom wall portion when a distal end thereof comes into contact with the virtual plane, and is formed so as not to intercept spray injected from the nozzle hole.

11. The nozzle plate according to claim 1, wherein:

the nozzle plate body includes a cylindrical wall portion configured to be fitted with a valve body of the fuel injection device including the fuel injection port and a bottom wall portion formed so as to occlude one end side of the cylindrical wall portion, the bottom wall portion includes a nozzle hole plate portion having the nozzle hole formed therein, and an interference plate portion having the interference bodies formed therein, and a shape of the nozzle hole plate portion is formed by partly counterboring the interference plate portion.

12. The nozzle plate according to claim 11, wherein:

the bottom wall portion includes a nozzle guard projection protruding along a direction in which a center axis of the valve body extends on an outer surface thereof at a position surrounding the nozzle hole plate portion, and the nozzle guard projection is an annular member formed on the bottom wall portion so as to surround the nozzle hole plate portion or a plurality of block members formed on the bottom wall portion so as to surround the nozzle hole plate portion, is formed so as to form a gap between a virtual plane and the bottom wall portion when a distal end thereof comes into contact with the virtual plane, and is formed so as not to intercept spray injected from the nozzle hole.

* * * * *